US011417506B1

(12) United States Patent
Birmingham

(10) Patent No.: US 11,417,506 B1
(45) Date of Patent: Aug. 16, 2022

(54) APPARATUS INCLUDING THERMAL ENERGY HARVESTING THERMIONIC DEVICE INTEGRATED WITH ELECTRONICS, AND RELATED SYSTEMS AND METHODS

(71) Applicant: Birmingham Technologies, Inc., Arlington, VA (US)

(72) Inventor: Joseph Birmingham, Arlington, VA (US)

(73) Assignee: Birmingham Technologies, Inc., Arlington, VA (US)

( * ) Notice: Subject to any disclaimer, the term of this patent is extended or adjusted under 35 U.S.C. 154(b) by 0 days.

(21) Appl. No.: 17/071,712

(22) Filed: Oct. 15, 2020

(51) Int. Cl.
*H01J 45/00* (2006.01)
*H01J 9/04* (2006.01)

(52) U.S. Cl.
CPC ..... *H01J 45/00* (2013.01); *H01J 9/042* (2013.01)

(58) Field of Classification Search
CPC ..... H01J 9/042; H01J 45/00
See application file for complete search history.

(56) References Cited

U.S. PATENT DOCUMENTS

| | | | |
|---|---|---|---|
| 2,876,368 | A | 3/1959 | Thomas |
| 3,376,437 | A | 4/1968 | Meyerand, Jr. et al. |
| 3,798,475 | A | 3/1974 | Campagnuolo et al. |
| 3,839,094 | A | 10/1974 | Campagnuolo |
| 4,264,641 | A | 4/1981 | Mahoney et al. |
| 4,628,143 | A | 12/1986 | Brotz |
| 4,762,975 | A | 8/1988 | Mahoney et al. |
| 4,900,368 | A | 2/1990 | Brotz |
| 4,995,231 | A | 2/1991 | Smith et al. |
| 5,008,579 | A | 4/1991 | Conley et al. |
| 5,578,886 | A | 11/1996 | Holmlid et al. |
| 5,606,213 | A | 2/1997 | Kherani et al. |

(Continued)

FOREIGN PATENT DOCUMENTS

| | | |
|---|---|---|
| CN | 100382256 | 4/2008 |
| EP | 2849334 | 3/2015 |

(Continued)

OTHER PUBLICATIONS

Benedict, Lorin X. et al., "Static polarizabilities of single-wall carbon nanotubes," Physical Review B, vol. 52, pp. 8541-8549 (1995).

(Continued)

*Primary Examiner* — Anne M Hines
(74) *Attorney, Agent, or Firm* — Lieberman & Brandsdorfer, LLC

(57) ABSTRACT

Embodiments relate to an apparatus that includes an electronics layer with at least one electronic component, and a thermal energy harvesting thermionic device to receive thermal energy and generate an electrical output for powering the electronic component. The thermionic device includes a cathode, an anode spaced from the cathode, and a plurality of nanoparticles in at least one medium contained between the cathode and the anode to permit electron transfer between the cathode and the anode. An intermediate layer is positioned between the thermionic device and the electronics layer. The intermediate layer is made of a gradient thermal expansion material (TEM). Related systems and methods are also provided.

21 Claims, 22 Drawing Sheets

(56) References Cited

U.S. PATENT DOCUMENTS 5,787,965 A 8/1998 Sterett et al.
5,960,853 A 10/1999 Sterett et al.
5,989,824 A 11/1999 Birmingham et al.
5,994,638 A 11/1999 Edelson
6,062,392 A 5/2000 Birmingham et al.
6,110,247 A 8/2000 Birmingham et al.
6,287,714 B1 9/2001 Xiao et al.
6,294,858 B1 9/2001 King et al.
6,492,792 B1 12/2002 Johnson, Jr. et al.
6,722,872 B1 4/2004 Swanson et al.
6,774,532 B1 8/2004 Marshall et al.
7,073,561 B1 7/2006 Henn
7,081,684 B2 7/2006 Patel et al.
7,259,109 B2 8/2007 Meagley
7,327,026 B2 2/2008 Shimogishi et al.
7,524,528 B2 4/2009 Kodas et al.
7,651,926 B2 1/2010 Jacobson et al.
7,701,576 B2 4/2010 Moore et al.
7,737,356 B2 5/2010 Goldstein
7,906,182 B1 3/2011 Schlat
8,093,144 B2 1/2012 Jacboson et al.
8,182,982 B2 5/2012 Korbin
8,188,456 B2 5/2012 Nemanich et al.
8,192,920 B2 6/2012 Korbin
8,318,386 B2 11/2012 Korbin
8,334,217 B2 12/2012 Korbin
8,367,525 B2 2/2013 Jacobson et al.
8,425,789 B2 4/2013 Korbin
8,518,633 B2 8/2013 Korbin et al.
8,621,245 B2 12/2013 Shearer et al.
8,816,633 B1 8/2014 Neal et al.
8,907,352 B2 12/2014 Naito
9,069,244 B2 6/2015 Korbin
9,073,937 B2 7/2015 Frazier et al.
9,116,430 B2 8/2015 Korbin et al.
9,166,405 B2 10/2015 Brandt et al.
9,244,356 B1 1/2016 Korbin et al.
9,465,296 B2 10/2016 Korbin
9,472,699 B2 10/2016 Kotter
9,481,112 B2 11/2016 Korbin et al.
9,559,617 B2 1/2017 Landa et al.
9,645,504 B2 5/2017 Korbin
9,722,420 B2 8/2017 Teggatz et al.
9,726,790 B2 8/2017 Boyd et al.
9,726,791 B2 8/2017 Boyd et al.
9,782,917 B2 10/2017 Korbin et al.
9,786,718 B1 10/2017 Boyd
9,793,317 B1 10/2017 Boyd et al.
9,865,789 B2 * 1/2018 Geballe ..... H01J 45/00
9,893,261 B1 2/2018 Boyd et al.
9,923,514 B1 3/2018 Boyd et al.
9,981,410 B2 5/2018 Korbin et al.
10,014,461 B1 7/2018 Boyd et al.
10,056,538 B1 8/2018 Boyd
10,079,561 B1 9/2018 Boyd
10,096,648 B2 10/2018 Boyd
10,103,654 B2 10/2018 Yun et al.
10,109,672 B2 10/2018 Boyd et al.
10,109,781 B1 10/2018 Boyd
10,110,163 B2 10/2018 Boyd et al.
10,247,861 B2 4/2019 Boyd et al.
10,249,810 B2 4/2019 Boyd et al.
10,345,491 B2 7/2019 Boyd et al.
10,345,492 B2 7/2019 Boyd et al.
10,347,777 B2 7/2019 Boyd et al.
10,525,684 B2 1/2020 Boyd et al.
10,529,871 B2 1/2020 Boyd et al.
10,546,991 B2 1/2020 Boyd
10,553,774 B2 2/2020 Boyd
10,559,864 B2 2/2020 Birmingham
10,690,485 B2 6/2020 Koester et al.
10,859,480 B2 12/2020 Koester et al.
10,905,011 B2 * 1/2021 Kami ..... H05K 1/118
10,985,677 B2 4/2021 Boyd et al.
2005/0016575 A1 1/2005 Kumar et al.
2005/0104185 A1 5/2005 Shimogishi et al.
2006/0137732 A1 6/2006 Farahani et al.
2007/0182362 A1 8/2007 Trainor et al.
2008/0066796 A1 3/2008 Mitchell et al.
2010/0051092 A1 3/2010 Dumitru et al.
2010/0068406 A1 3/2010 Man
2010/0326487 A1 12/2010 Komori et al.
2011/0104546 A1 5/2011 Seino et al.
2011/0148248 A1 6/2011 Landa
2011/0298333 A1 * 12/2011 Pilon ..... H01L 37/02 310/306
2012/0153772 A1 6/2012 Landa
2013/0062457 A1 3/2013 Deakin
2013/0101729 A1 4/2013 Keremes et al.
2013/0313745 A1 11/2013 Ikushima
2014/0349430 A1 11/2014 Kim
2015/0024516 A1 1/2015 Seibel et al.
2015/0087144 A1 3/2015 Liu et al.
2015/0210400 A1 7/2015 Gonidec et al.
2015/0211499 A1 7/2015 Morin
2015/0229013 A1 8/2015 Birmingham et al.
2015/0251213 A1 9/2015 Birmingham et al.
2017/0106082 A1 4/2017 Birmingham
2017/0126150 A1 5/2017 Wang
2017/0155098 A1 6/2017 Park et al.
2017/0252807 A1 9/2017 Lund et al.
2017/0358432 A1 12/2017 Wang
2018/0083176 A1 3/2018 Ryu et al.
2019/0214675 A1 7/2019 Christensen et al.
2019/0214845 A1 7/2019 Hausman, Jr. et al.
2019/0267846 A1 8/2019 Shearer et al.
2020/0153069 A1 5/2020 Birmingham
2020/0273959 A1 8/2020 Birmingham
2020/0274045 A1 8/2020 Birmingham
2020/0274046 A1 8/2020 Birmingham
2020/0303132 A1 9/2020 Bhattacharjee et al.
2020/0346736 A1 11/2020 Krasnoff
2020/0368848 A1 11/2020 Birmingham
2020/0369516 A1 11/2020 Birmingham
2020/0370158 A1 11/2020 Birmingham
2021/0050800 A1 2/2021 Jones et al.
2021/0050801 A1 2/2021 Jones et al.
2021/0086208 A1 3/2021 Birmingham et al.
2021/0091291 A1 3/2021 Birmingham et al.
2021/0091685 A1 3/2021 Birmingham et al.
2021/0135600 A1 5/2021 Thibado et al.
2021/0251548 A1 * 8/2021 Bose ..... A61B 5/7225

FOREIGN PATENT DOCUMENTS

JP 2006086510 3/2006
JP 4901049 3/2012
JP 6147901 6/2017
JP 6411612 10/2018
JP 6411613 10/2018
JP 6521400 5/2019
JP 6521401 5/2019
JP 6524567 6/2019
JP 6598339 10/2020
JP 6828939 2/2021
KR 20170138772 12/2017
KR 20180107194 10/2018
WO 2006076036 7/2006
WO 2009004345 1/2009
WO 2012114366 8/2012
WO 2014186783 11/2014
WO 2014204549 12/2014
WO 2017214179 12/2017
WO 2020176344 9/2020
WO 2020176345 9/2020
WO 2020184234 9/2020
WO 2020184235 9/2020
WO 2020235254 11/2020
WO 2020236776 11/2020
WO 2021030489 2/2021
WO 2021061995 4/2021

(56) References Cited

FOREIGN PATENT DOCUMENTS

| | | |
|---|---|---|
| WO | 2021061996 | 4/2021 |
| WO | 2021061997 | 4/2021 |

OTHER PUBLICATIONS

Birmingham, J.G., "DEP-Enhanced Micro-Injector Array for Liquid Fuel Atomizer," Final Report for U.S. Army SBIR 02.2 N02-148 (2001).
Birmingham, J.G., "E-Field Micro-Injector Array Liquid Fuel Atomizer," Final Report for NASA SBIR Phase I: NASA 01.1-A8.02 (2002).
Brodie, I. et al., "Impregnated Barium Dispenser Cathodes Containing Strontium or Calcium Oxide," Journal of Applied Physics, vol. 27, pp. 417-418 (1956).
Brodie, I. et al., "Secondary electron emission from barium dispenser cathodes," British Journal of Applied Physics, vol. 8, pp. 202-204 (1957).
Chattopadhyay, Debjit et al., "Complete elimination of metal catalysts from single wall carbon nanotubes," Carbon, vol. 40, pp. 985-988 (2002).
Chen, Zhihong et al., "An Integrated Logic Circuit Assembled on a Single Carbon Nanotube," Science, vol. 311, p. 1735 (2006).
Chou, S.H. et al.,"An orbital-overlap model for minimal work functions of cesiated metal surfaces," Journal of Physics: Condensed Matter, vol. 24, p. 445007 (2012).
Committee on Thermionic Research and Technology et al., "Thermionics: Quo Vadis? An Assessment of the DTRA's Advanced Thermionics Research and Development Program," National Academy Press (2001).
Dillon, A.C. et al., "A Simple and Complete Purification of Single-Walled Carbon Nanotube Materials," Advanced Materials, vol. 11, pp. 1354-1358 (1999).
Dimaki, Maria et al., "Frequency dependence of the structure and electrical behaviour of carbon nanotube networks assembled by dielectrophoresis," Nanotechnology, vol. 16, pp. 759-763 (2005).
Dimaki, Maria et al., "Single and multiwalled carbon nanotube networks and bundles assembled on microelectrodes," Proceedings of the Institution of Mechanical Engineers, Part N: Journal of Nanoengineering and Nanosystems, vol. 218, pp. 17-23 (2005).
Fall, C.J. et al., "Deriving accurate work functions from thin-slab calculations," Journal of Physics: Condensed Matter, vol. 11 2689-2696 (1999).
Fall, C.J. et al., "Theoretical maps of work-function anisotropies," Physical Review B, vol. 65, p. 045401 (2001).
Giordano, L. et al., "Tuning the surface metal work function by deposition of ultrathin oxide films: Density functional calculations," Physical Review B, vol. 73, p. 045414 (2005).
Green, Nicolas G. et al., "Dielectrophoresis of Submicrometer Latex Spheres. 1. Experimental Results," Journal of Phsysical Chemistry B, vol. 103, pp. 41-50 (1999).
Gyftopoulos, E.P. et al., "Work Function Variation of Metals Coated by Metallic Films," Journal of Applied Physics, vol. 33, pp. 67-73 (1962).
Haas, G.A. et al., "Interatomic Auger Analysis of the Oxidation of Thin Ba Films," Applications of Surface Science, vol. 16, pp. 139-162 (1983).
Hafner, J. et al., "Toward Computational Materials Design: The Impact of Density Functional Theory on Materials Research," MRS Bulletin, vol. 31, pp. 659-668 (2006).
Houston, J.M., "Theoretical Efficiency of the Thermionic Energy Converter," Journal of Applied Physics, vol. 30, pp. 481-487 (1959).
Incropera, F.P. et al., "Fundamentals of Heat and Mass Transfer, 6th Edition," John Wiley & Sons, pp. 2-42 (2007).
Jensen, K.L. et al., "A photoemission model for low work function coated metal surfaces and its experimental validation," Journal of Applied Physics, vol. 99, p. 124905 (2006).
Kawano, H., "Effective work functions for ionic and electronic emissions from mono- and polycrystalline surfaces," Progress in Surface Science, vol. 83, pp. 1-165 (2008).
Krupke, R. et al., "Simultaneous Deposition of Metallic Bundles of Single-walled Carbon Nanotubes Using Ac-dielectrophoresis," Nano Letters, vol. 3, pp. 1019-1023 (2003).
Krupke, Ralph et al., "Separation of Metallic from Semiconducting Single-Walled Carbon Nanotubes," Science, vol. 301, pp. 344-347 (2003).
Krupke, Ralph et al., "Surface Conductance Induced Dielectrophoresis of Semiconducting Single-Walled Carbon Nanotubes," Nano Letters, vol. 4, pp. 1395-1399 (2004).
Lee, J.-H. et al., "Thermionic Emission From Microfabricated Silicon-Carbide Filaments," Proceedings Power MEMS, pp. 149-152 (2009).
Lenggoro, I.W. et al., "Nanoparticle Assembly on Patterned "plus/minus" Surfaces From Electrospray of Colloidal Dispersion," Journal of Colloid and Interface Science, vol. 303, pp. 124-130 (2006).
Levine, J.D., "Structural and Electronic Model of Negative Electron Affinity on The Si/Cs/O Surface," Surface Science, vol. 34, pp. 90-107 (1973).
Lin, M.C. et al., "Work functions of cathode surfaces with adsorbed atoms based on ab initio calculations," Journal of Vacuum Science and Technology B, vol. 26, pp. 821-825 (2008).
Lindell, L. et al., "Transparent, Plastic, Low-Work-Function Poly (3,4-ethylenedioxythiophene) Electrodes," Chemistry of Materials, vol. 18, pp. 4246-4252 (2006).
Love, J.C. et al., "Self-Assembled Monolayers of Thiolates on Metals as a Form of Nanotechnology," Chemical Reviews, vol. 105, pp. 1103-1169 (2005).
Maboudian, R. et al., "Critical Review: Adhesion in surface micromechanical structures," Journal of Vacuum Science and Technology B, vol. 15, pp. 1-20 (1997).
Maboudian, R. et al., "Self-assembled monolayers as anti-stiction coatings for MEMS: characteristics and recent developments," Sensors and Actuators, vol. 82, pp. 219-223 (2000).
Maboudian, R., "Surface processes in MEMS technology," Surface Science Reports, vol. 30, 207-269 (1998).
Magkoev, T.T. et al., "Aluminium oxide ultrathin-film growth on the Mo(110) surface: a work-function study," Journal of Physics: Condensed Matter, vol. 13, pp. L655-L661 (2001).
Modinos, A., "Theory of Thermionic Emission," Surface Science, vol. 115, pp. 469-500 (1982).
Musho, T.D. et al., "Quantum simulation of thermionic emission from diamond films," Journal of Vacuum Science and Technology B, vol. 31, p. 021401 (2013).
Natan, A. et al., "Computing surface dipoles and potentials of self-assembled monolayers from first principles," Applied Surface Science, vol. 252, pp. 7608-7613 (2006).
Neugebauer, J. et al., "Adsorbate-substrate and adsorbate-adsorbate interactions of Na and K adlayers on Al (111)," Physical Review B, vol. 46, pp. 16067-16080 (1992).
Nichols, M.H., "The Thermionic Constants of Tungsten as a Function of Crystallographic Direction," Physical Review, vol. 57, pp. 297-306 (1940).
Prada, S. et al., "Work function changes induced by deposition of ultrathin dielectric films on metals: A theoretical analysis," Physical Review B, vol. 78, p. 235423 (2008).
Schwede, J.W. et al., "Photon-enhanced thermionic emission for solar concentrator systems," Nature Materials, vol. 9, p. 762-767 (2010).
Singh-Miller, N.E. et al., "Surface energies, work functions, and surface relaxations of low-index metallic surfaces from first principles," Physical Review B, vol. 80, p. 235407 (2009).
Vaccarini, L. et al., "Purification procedure of carbon nanotubes," Synthetic Metals, vol. 103, pp. 2492-2493 (1999).
Vlahos, V. et al., "Ab initio investigation of barium-scandium-oxygen coatings on tungsten for electron emitting cathodes," Physical Review B, vol. 81, p. 054207 (2010).
Wang, C.S., "High photoemission efficiency of submonolayer cesium-covered surfaces," Journal of Applied Physics, vol. 48, pp. 1477-1479 (1977).

(56) References Cited

OTHER PUBLICATIONS

Wooten, L.A. et al., "Evaporation of Barium and Strontium from Oxide-Coated Cathodes," Journal of Applied Physics, vol. 26, pp. 44-51 (1955).
Xiao, T.D. et al., "Synthesis of Nanostructured Ni/Cr and Ni—Cr3C2 Powders by an Organic Solution Reaction Method," Nanostructured Materials, vol. 7, No. 8, pp. 857-871 (1996).
Zhao, Y.P., "Morphological stability of epitaxial thin elastic films by van der Waals force," Archive of Applied Mechanics, vol. 72, pp. 77-84 (2002).
Alhuwaidi, S.A., "3D Modeling Analysis, and Design of a Traveling-Wave Tube Using a Modified Ring-Bar Structure with Rectangular Transmission Lines Geometry," Dissertation submitted to the University of Colorado Colorado Springs (2017).
Datta, S., "Electronic Transport in Mesoscopic Systems," Cambridge University Press, New York, pp. 246-275 (1995).
Fomenko, V.S., "Handbook of Thermionic Properties, Electronic Work Functions and Richardson Constants of Elements and Compounds," Plenum Press Data Division, New York, pp. 126-137 (1966).
Hatsopoulos, G.N. et al., "Thermionic Energy Conversion vol. I: Process and Devices," The MIT Press, Cambridge, MA, pp. 5-37 (1973).
Morris, J.E., "Nanopackaging: Nanotechnologies and Electronics Packaging," Springer-Verlag, pp. 93-107 (2008).
Prieto Rojas, J. et al., "Folding and Stretching a Thermoelectric Generator," Proceedings of the Society of Photo-Optical Instrumentation Engineers, vol. 10639, p. 10639E (2018).
Xiao, T.D. et al., "Synthesis of Si(N,C) nanostructured powders from an organometallic aerosol using a hot-wall reactor," Journal of Materials Science, vol. 28, pp. 1334-1340 (1993).
Yamamoto, Shigehiko, "Fundamental physics of vacuum electron sources," Reports on Progress in Physics, vol. 69, pp. 181-232 (2006).
Yamasaki, T. et al., "Formation of metal-TiN/TiC nanocomposite powders by mechanical alloying and their consolidation," Materials Science and Engineering A, vol. 350, pp. 168-172 (2003).
Zharin, Anatoly L. et al., "Application of the contact potential difference technique for on-line rubbing surface monitoring (review)," Tribology Letters, vol. 4, pp. 205-213 (1998).
Zhu, Moxuan, "Experimental Measurements of Thermoelectric Phenomena in Nanoparticle Liquid Suspensions (Nanofluids)," Graduate Thesis, Arizona State University, Dec. 2010.
Office Action for U.S. Appl. No. 16/284,979, dated Sep. 2020.
Office Action for U.S. Appl. No. 16/416,849, dated Nov. 2020.
International Search Report for PCT/US2020/052506, dated Dec. 2020.
International Search Report for PCT/US2020/052507, dated Dec. 2020.
International Search Report for PCT/US2020/052508, dated Dec. 2020.
Olawole, O.C. et al., "Theoretical studies of thermionic conversion of solar energy with graphene as emitter and collector," Journal of Photonics for Energy, vol. 8(1), p. 018001 (2018).
Sindhuja, M. et al., "High Efficiency Graphene Coated Copper Based Thermocells Connected in Series," Frontiers in Physics, vol. 6, Article 35 (2018).
International Search Report for PCT/US2021/029351, dated Jul. 2021.
Satterley, C.J. et al., "Electrospray deposition of fullerenes in ultra-high vacuum: in situ scanning tunneling microscopy and photoemission spectroscopy," Nanotechnology, vol. 18, p. 455304 (2007).
Shin, H. et al., "Improved electrical performance and transparency of bottom-gate, bottom-contact single-walled carbon nanotube transistors using graphene source/drain electrodes," Journal of Industrial and Engineering Chemistry, vol. 81, pp. 488-495 (2020).
ASTM, "StandardTest Method for Linear Thermal Expansion of Solid Materials With a Push-Rod Dilatometer," Designation E228 (2011).
Baram, M. et al., "Nanometer-Thick Equilibrium Films: The Interface Between Thermodynamics and Atomistics," Science, vol. 332, Issue 6026, pp. 206-209 (2011).
Bassani, J.L., "Incompatibility and a simple gradient theory of plasticity," Journal of Mechanics and Physics of Solids vol. 49, pp. 1983-1996 (2001).
Battezzati, L. et al., "Solid state reactions in Al/Ni alternate foils induced by cold rolling and annealing," Acta Materialia, vol. 47, Issue 6, pp. 1901-1914 (1999).
Bell, Lon E., "Cooling, heating, generating power, and recovering waste heat with thermoelectric systems," Science, vol. 321, pp. 1457-1461 (2008).
Bhadrachalam, Pradeep et al., "Energy-filtered cold electron transport at room temperature," Nature Communications, Sep. 10, 2014.
Birmingham, Joseph, "Printed Self-Powered Miniature Air Sampling Sensors," Sensors and Transducers, vol. 214, pp. 1-11 (2017).
Brezonik, Patrick L. et al., "Water Chemistry: An Introduction to the Chemistry of Natural and Engineered Aquatic Systems," Oxford University Press, Inc., pp. 170-175 (2011).
Chung, M.S. et al., "Energy exchange processes in electron emission at high fields and temperatures," Journal of Vacuum Science and Technology B, vol. 12, pp. 727-736 (1994).
Cronin, J.L., "Modern dispenser cathodes," IEE Proc., vol. 128, Pt. 1, No. 1, pp. 19-32 (1981).
Curzon, F.L. et al., "Efficiency of a Carnot engine at maximum power output," American Journal of Physics, vol. 43, pp. 22-24 (1975).
Cutler, P.H. et al., "A new model for the replacement process in electron emission at high fields and temperatures," Applied Surface Science, vol. 76-77, pp. 1-6 (1994).
Daniel, Marie-Christine et al., "Gold Nanoparticles: Assembly, Supramolecular Chemistry, Quantum-Size-Related Properties, and Applications toward Biology, Catalysis, and Nanotechnology," Chemical Reviews, vol. 104, No. 1, pp. 293-346 (2004).
Darling, K.A. et al., "Thermal stability of nanocrystalline Fe—Zr alloys," Materials Science and Engineering A, vol. 527, pp. 3572-3580 (2010).
De Juan, L. et al., "Charge and size distribution of electrospray drops," Journal of Colloid Interface Science, vol. 186, No. 2, pp. 280-293 (1997).
Deng et al., "Digital electrospray for controlled deposition," Review of Scientific Instruments, vol. 81, pp. 035114-1-035114-6 (2010).
Deng, Weiwei et al., "Influence of space charge on the scale-up of multiplexed electrosprays," Aerosol Science 38, pp. 1062-1078 (2007).
Detor, Andrew J. et al., "Grain boundary segregation, chemical ordering and stability of nanocrystalline alloys: Atomistic computer simulations in the Ni—W system," Acta Materialia, vol. 55, pp. 4221-4232 (2007).
Dillner, U., "The effect of thermotunneling on the thermoelectric figure of merit," Energy Conversion and Management, vol. 49, No. 12, pp. 3409-3425 (2008).
Dinda, G.P. et al., "Synthesis of bulk nanostructured Ni, Ti and Zr by repeated cold-rolling," Scripta Materialia, vol. 52, Issue 7, pp. 577-582 (2005).
Fernandez De La Mora, J. et al., "Generation of submicron monodisperse aerosols by electrosprays," Journal of Aerosol Science, vol. 21, Supplement 1, pp. S673-S676 (1990).
Fisher, T.S. et al., "Thermal and Electrical Energy Transport and Conversion in Nanoscale Electron Field Emission Processes," Journal of Heat Transfer, vol. 124, pp. 954-962 (2002).
Fu, Xinyong et al., "Realization of Maxwell's Hypothesis," Shanghai Jiao Tong University (2008).
Gertsman, V. Y. et al., "Deformation behavior of ultrafine-grained materials," Materials Science Forum, vols. 225-227, pp. 739-744 (1996).
Go, David B. et al., "Thermionic Energy Conversion in the Twenty-first Century: Advances and Opportunities for Space and Terrestrial Applications," Frontiers in Mechanical Engineering, vol. 3 (2017).
Gudmundson, Peter, "A unified treatment of strain gradient plasticity," Journal of the Mechanics and Physics of Solids, vol. 52, pp. 1379-1406 (2004).

(56) References Cited

OTHER PUBLICATIONS

Hentschel, T. et al., "Nanocrytsalline Ni-3.6 at.% P and its Transformation Sequence Studied by Atom-Probe Field-Ion Microscopy," Acta Materialia, vol. 48, pp. 933-941 (2000).
Hishinuma, Y. et al., "Refrigeration by combined tunneling and thermionic emission in vacuum: use of nanometer scale design," Applied Physics Letters, vol. 78, No. 17, pp. 2572-2574 (2001).
Hishinuma, Yoshikazu et al., "Measurements of cooling by room-temperature thermionic emission across a nanometer gap," Journal of Applied Physics, vol. 94, No. 7, p. 4690 (2003).
International Search Report for PCT/US2020/019230, dated Jun. 2020.
International Search Report for PCT/US2020/019232, dated Jun. 2020.
International Search Report for PCT/US2020/033528, dated Aug. 2020.
Ioffe, A.F., "Semiconductor Thermoelements and Thermoelectric Cooling Infosearch," Infosearch Ltd., 1957.
Jaworek, A., "Electrospray droplet sources for thin film deposition," Journal of Materials Science, vol. 42, Issue 1, pp. 266-297 (2007).
Kirchheim, Reiner, "Grain coarsening inhibited by solute segregation," Acta Materialia, vol. 50, pp. 413-419 (2002).
Kirchheim, Reiner, "Reducing grain boundary, dislocation line and vacancy formation energies by solute segregation II. Experimental evidence and consequences," Acta Materialia, vol. 55, pp. 5139-5148 (2007).
Kirchheim, Reiner, "Reducing grain boundary, dislocation line and vacancy formation energies by solute segregation. I. Theoretical backround," Acta Materialia, vol. 55, pp. 5129-5138 (2007).
Klimeck et al., "Quantum device simulation with a generalized tunneling formula," Appl. Phys. Lett., vol. 67, pp. 2539-2541 (1995).
Koch, C.C. et al., "Stabilization of nanocrystalline grain sizes by solute additions," Journal of Materials Science, vol. 43, Issue 23-24, pp. 7264-7272 (2008).
Koch, C.C. et al., "Ductility of Nanostructured Materials," Materials Research Society Bulletin, vol. 24, pp. 54-58 (1999).
Koch, C.C., "Synthesis of nanostructured materials by mechanical milling: problems and opportunities," Nanostructured Materials, vol. 9, Issues 1-8, pp. 13-22 (1997).
Koeck, Franz A.M. et al., "Thermionic electron emission from low work-function phosphorus doped diamond films," Diamond Related Material, vol. 18, pp. 789-791 (2009).
Landauer, R., "Spatial Variation of Currents and Fields Due to Localized Scatterers in Metallic Conduction," IBM Journal of Research and Development, vol. 1, pp. 223-231 (1957).
Lee, Z. et al., "Bimodal microstructure and deformation of cryomilled bulk nanocrystalline Al-7.5Mg alloy," Materials Science and Engineering A, vols. 410-411, pp. 462-467 (2005).
Legros, M. et al., "Microsample tensile testing of nanocrystalline metals," Philosophical Magazine A, vol. 80, No. 4, pp. 1017-1026 (2000).
Likharev, Konstantin K., "Single-Electron Devices and Their Applications," Proc. IEEE, vol. 87, pp. 606-632 (1999).
List of Birmingham Technologies Patents or Applications Treated as Related, Jan. 2021.
Lloyd, D.J., "Particle reinforced aluminum and magnesium matrix composites," International Materials Reviews, vol. 39, Issue 1, pp. 1-23 (1994).
Luo, Jian et al., "The Role of a Bilayer Interfacial Phase on Liquid Metal Embrittlement," Science, vol. 333, Issue 6050, pp. 1730-1733 (2011).
Mahan, G.D., "Thermionic refrigeration," Journal of Applied Physics, vol. 76, No. 7, pp. 4362-4366 (1994).
Marzari, Nicola et al., "Maximally localized generalized Wannier functions for composite energy bands," Physical Review B, vol. 56, No. 20, pp. 12847-12865 (1997).
Mayr, S.G. et al., "Stabilization of Cu nanostructures by grain boundary doping with Bi: Experiment versus molecular dynamics simulation," Physical Review B, vol. 76, p. 024111 (2007).
McCandlish L.E. et al., "Chemical processing of nanophase WC-Co composite powders," Materials Science and Technology, vol. 6, Issue 10, pp. 953-957 (1990).
Millett, Paul C. et al., "Stabilizing nanocrystalline materials with dopants," Acta Materialia, vol. 55, pp. 2329-2336 (2007).
Moon, Kyoung II et al., "A study of the microstructure of nanocrystalline Al—Ti alloys synthesized by ball milling in a hydrogen atmosphere and hot extrusion," Journal of Alloys Compounds, vol. 291, pp. 312-321 (1999).
Mortensen, A. et al., "Metal Matrix Composites," Annual Review of Materials Research, vol. 40, pp. 243-270 (2010).
Muller-Steinhagen, Hans et al., "Concentrating solar power," Ingenia, pp. 1-9 (2004).
Murata, Kazuhiro, "Super-fine ink-jet printing for nanotechnology," Proceedings International Conference on MEMS, NANO and Smart Systems, pp. 346-349 (2003).
Murray, Royce W., "Nanoelectrochemistry: Metal Nanoparticles, Nanoelectrodes, and Nanopores," Chemical Reviews, vol. 108, No. 7, pp. 2688-2720 (2008).
Nabarro, F.R.N., "The theory of solution hardening," The Philosophical Magazine: A Journal of Theoretical Experimental and Applied Physics, vol. 35, pp. 613-622 (1977).
Nan, C.W. et al., "The Influence of Particle Size and Particle Fracture on the Elastic/Plastic Deformation of Metal Matrix Composites," Acta Materialia, vol. 44, No. 9, pp. 3801 3811 (1996).
Nguyen, Hoang M. et al., "Thermionic emission via a nanofluid for direct electrification from low-grade heat energy," Nano Energy, vol. 49, pp. 172-178 (2018).
Obraztsov, Alexander et al., "Cold and Laser Stimulated Electron Emission from Nanocarbons," Journal Nanoelectronics and Optoelectronics, vol. 4, pp. 1-13 (2009).
Office Action for U.S. Appl. No. 16/284,967, dated Jul. 2020.
Park, Jang-Ung et al., "High-resolution electrohydrodynamic jet printing," Nature Materials, vol. 6, pp. 782-789 (2007).
Park, Jang-Ung et al., "Nanoscale Patterns of Oligonucleotides Formed by Electrohydrodynamic Jet Printing with Applications in Biosensing and Nanomaterials Assembly," Nano Letters, vol. 8, pp. 4210-4216 (2008).
Perepezko, J.H., et al., "Amorphization and nanostructure synthesis in Al alloys", Intermetallics 10 (2002) p. 1079-1088.
Redko, Mikhail et al., "Design and Synthesis of a Thermally Stable Organic Electride," J. Am. Chem. Soc., vol. 127, No. 35, pp. 12416-12422 (2005).
Rusu, Paul et al., "Work functions of self-assembled monolayers on metal surfaces by first-principles calculations," Physical Review B, vol. 74, pp. 073414-1-073414-4 (2006).
Sanders, P.G. et al., "Elastic and Tensile Behavior of Nanocrystalline Copper and Palladium," Acta Materialia, vol. 45, No. 10, pp. 4019-4025 (1997).
Sanders, P.G. et al., "The strength of nanocrystalline metals with and without flaws," Materials Science Engineering A, vol. 234-236, pp. 77-82 (1997).
Scheible, Dominik V. et al., "Tunable coupled nanomechanical resonators for single-electron transport," New Journal of Physics, vol. 4, pp. 86.1-86.7 (2002).
Schneider, Julian, "Electrohydrodynamic nanoprinting and its applications," Diss. ETH No. 22694 (2015).
Schreiber, Frank, "Structure and growth of self-assembling monolayers," Progress in Surface Science, vol. 65, pp. 151-256 (2000).
Scoville, N. et al., "Thermal Conductivity Reductions in SiGe Via Addition of Nanophase Particles," Materials Research Society Symposium Proceedings, vol. 351, pp. 431-436 (1994).
Sekine, H. et al., "A combined microstructure strengthening analysis of SiC—p/Al metal matrix composites," Composites, vol. 26, pp. 183-188 (1995).
Shakouri, Ali, "Nanoscale Thermal Transport and Microrefrigerators on a Chip," Proceedings of the IEEE, vol. 94, No. 8, pp. 1613-1638 (2006).
Shockley, William et al., "Detailed Balance Limit of Efficiency of pn Junction Solar Cells," Journal of Applied Physics, vol. 32, pp. 510-519 (1961).

(56) References Cited

OTHER PUBLICATIONS

Snider, D.R. et al., "Variational calculation of the work function for small metal spheres," Solid State Communications, vol. 47, No. 10, pp. 845-849 (1983).
Snyder, G. et al., "Complex thermoelectric materials," Nature Materials, vol. 7, pp. 105-114 (2008).
Sodha, M.S. et al., "Dependence of Fermi energy on size," Journal of Physics D: Applied Physics, vol. 3, No. 2, pp. 139-144 (1970).
Stephanos, Cyril, "Thermoelectronic Power Generation from Solar Radiation and Heat," University of Augsburg, Ph.D. Thesis, Nov. 2012.
Taylor, Geoffrey, "Disintegration of water drops in an electric field," Proc. R. Soc. A, vol. 280, pp. 383-397 (1964).
Templeton, Allen C. et al., "Monolayer-Protected Cluster Molecules," Accounts of Chemical Research, vol. 33, No. 1, pp. 27-36 (2000).
Tepper, Gary et al., "An electrospray-based, ozone-free air purification technology," Journal of Applied Physics, vol. 102, pp. 113305-1-113305-6 (2007).
Thygesen, Kristian S. et al., "Partly occupied Wannier functions," Physical Review Letters, vol. 94, pp. 026405-1-026405-4 (2005).
Tsuji, N. et al., "Strength and ductility of ultrafine grained aluminum and iron produced by ARB and annealing," Scripta Materialia, vol. 47, pp. 893-899 (2002).
Ulrich, Marc D. et al., "Comparison of solid-state thermionic refrigeration with thermoelectric refrigeration," Journal of Applied Physics, vol. 90, No. 3, pp. 1625-1631 (2001).
Valiev, R. Z. et al., "Bulk nanostructured materials from severe plastic deformation," Progress in Materials Science, vol. 45, pp. 103-189 (2000).
Valiev, R.Z. et al., "Producing Bulk Ultrafine-Grained Materials by Severe Plastic Deformation," Journal of Materials, vol. 58, Issue 4, p. 33 (2006).
Valiev, R.Z. et al., "Paradox of strength and ductility in metals processed by severe plastic deformation," Journal of Materials Research, vol. 17, No. 1, pp. 5-8 (2002).
Vanherpe, L. et al., "Pinning effect of spheroid second-phase particles on grain growth studied by three-dimensional phase-field simulations", Computational Materials Science 49 (2010) 340-350.
Wada, Motoi et al., "Effective Work Function of an Oxide Cathode in Plasma," J. Plasma Fusion Res. Series, vol. 8, pp. 1366-1369 (2009).
Wang, Y. et al.,"High tensile ductility in a nanostructured metal", Nature, 419 (2002), 912-915.
Wang, Y. M. et al., "Enhanced tensile ductility and toughness in nanostructured Cu," Applied Physics Letters, vol. 80, pp. 2395-2397 (2002).
Watanabe, Satoru et al., "Secondary electron emission and glow discharge properties of 12CaO—7Al2O3 electride for fluorescent lamp applications," Science and Technology of Advanced Materials, vol. 12, pp. 1-8 (2011).
Weaver, Stan et al., "Thermotunneling Based Cooling Systems for High Efficiency Buildings," GE Global Research, DOE Project: DE-FC26-04NT42324 (2007).
Weertman, J.R. et al., "Structure and Mechanical Behavior of Bulk Nanocrystalline Materials," Materials Research Society Bulletin, vol. 24, pp. 44-50 (1999).
Weiss, C. et al., "Accuracy of a mechanical single-electron shuttle," Europhysics Letters, vol. 47, No. 1, p. 97 (1999).
Weissmuller, J., "Alloy Effects in Nanostructures" Nanostructured Materials, vol. 3, pp. 261-272 (1993).
International Search Report for PCT/US2021/037166, dated Sep. 2021.
Notice of Allowance for U.S. Appl. No. 16/745,071, dated Oct. 2021.
International Search Report and Written Opinion for PCT/US2021/021676, dated May 2021.
Office Action for U.S. Appl. No. 16/582,545 dated Nov. 30, 2021.
Office Action for U.S. Appl. No. 17/483,916 dated Nov. 23, 2021.
Updated List of Assignee Patents and/or Patent Applications of Assignee, Dec. 2021.
International Search Report PCT/US2021/050831, dated Jan. 7, 2022.
Provisional Written Opinion PCT/US2021/050831, dated Jan. 7, 2022.
Matthew F. Campbell, et al., "Progress Toward High Power Output in Thermionic Energy Converters", Advanced Science, vol. 8, No. 9, pp. 1-23, May 1, 2021.
Office Action, U.S. Appl. No. 16/817,112, dated Apr. 12, 2022.
Office Action, U.S. Appl. No. 16/817,122, dated Apr. 7, 2022.
Im, Hyeongwook, et al., "High-efficiency electrochemical thermal energy harvester using carbon nanotube aerogel sheet electrodes", Nature Communications 7, Article No. 10600, (2016).
Pearson, Amanda, "10 advantages of 3D printing", (2018).
Updated List of Assignee Patents and/or Patent Applications of Assignee, May 2022.
Updated International Search Report PCT/US2021/050831, dated Apr. 20, 2022.
Updated Written Opinion PCT/US2021/050831, dated Apr. 20, 2022.
Eaton Ellipse ECO spec sheet, pp. 1-2 (2011).

* cited by examiner

APPARATUS INCLUDING THERMAL ENERGY HARVESTING THERMIONIC DEVICE INTEGRATED WITH ELECTRONICS, AND RELATED SYSTEMS AND METHODS

BACKGROUND

Embodiments disclosed herein relate to an apparatus including a thermal energy harvesting thermionic device integrated with at least one electronic component, and in one or more particularly exemplary embodiments a unitary apparatus including the thermal energy harvesting thermionic device and the at least one integrated electronic component. Also provided are related systems and methods, including systems incorporating the apparatus and methods of making and using the apparatus.

Existing electrochemical technologies, such as lithium-ion, lead-acid, and nickel-cadmium battery technology, have performance limitations and are burdened by limited operational durations due to limited energy storage. Further, existing electrochemical technologies include hazardous material subject to sometimes onerous handling, shipping, and disposal requirements. Furthermore, electrochemical technologies are also constrained by battery service and shelf-life limitations, particularly caused by electrochemical degradation under mechanical stress, and charge and discharge rates that limit operational lifetime.

SUMMARY

The embodiments include systems, apparatus, and methods that involve a thermal energy harvesting thermionic device and at least one electronic component.

In an aspect, an apparatus is provided that includes an electronics layer comprising at least one electronic component, a thermal energy harvesting thermionic device to receive thermal energy and generate an electrical output for powering the at least one electronic component, and an intermediate layer positioned between the thermal energy harvesting thermionic device and the electronics layer. The thermionic device comprises a cathode, an anode spaced from the cathode, and a plurality of nanoparticles in at least one medium between the cathode and the anode to permit electron transfer between the cathode and the anode. The intermediate layer comprises a gradient thermal expansion material (TEM), and has a first surface with a first coefficient of thermal expansion (CTE) facing the thermal energy harvesting thermionic device, and a second surface with a second CTE facing the electronics layer. The first CTE is quantitatively closer than the second CTE to a CTE of a first surface of the thermal energy harvesting thermionic device facing the first surface of the intermediate layer. The second CTE is quantitatively closer than the first CTE to a CTE of a surface of the electronics layer facing the second surface of the first intermediate layer.

Another aspect provides a system comprising an apparatus and an electrically conductive path. The apparatus comprises an electronics layer comprising at least one electronic component, a thermal energy harvesting thermionic device configured to receive thermal energy and generate an electrical output for powering the at least one electronic component, and an intermediate layer. The thermal energy harvesting thermionic device comprises a cathode, an anode spaced from the cathode, and a plurality of nanoparticles in at least one medium between the cathode and the anode. The nanoparticles are configured to permit electron transfer between the cathode and the anode. The intermediate layer is positioned between the thermal energy harvesting thermionic device and the electronics layer. The intermediate layer comprises a gradient thermal expansion material (TEM). The intermediate layer has a first surface with a first coefficient of thermal expansion (CTE) facing the thermal energy harvesting thermionic device, and a second surface with a second CTE facing the electronics layer. The first CTE is quantitatively closer than the second CTE to a CTE of a first surface of the thermal energy harvesting thermionic device facing the first surface of the intermediate layer. The second CTE is quantitatively closer than the first CTE to a CTE of a surface of the electronics layer facing the second surface of the intermediate layer. The electrically conductive path is configured to electrically couple the thermal energy harvesting thermionic device and the at least one electronic component of the electronics layer.

In another aspect, a method is provided that includes providing an apparatus. In an embodiment of the method, an electronics layer comprising at least one electronic component is electrospray deposited. A thermal energy harvesting thermionic device is electrospray deposited. The thermal energy harvesting thermionic device comprises a cathode, an anode spaced from the cathode, and a plurality of nanoparticles in at least one medium contained between the cathode and the anode. The nanoparticles are configured to permit electron transfer between the cathode and the anode. An intermediate layer is electrospray deposited. The intermediate layer is positioned in the apparatus between the thermal energy harvesting thermionic device and the electronics layer. The intermediate layer comprises a gradient thermal expansion material (TEM). The intermediate layer has a first surface with a first coefficient of thermal expansion (CTE) facing the thermal energy harvesting thermionic device, and a second surface with a second CTE facing the electronics layer. The first CTE is quantitatively closer than the second CTE to a CTE of a first surface of the thermal energy harvesting thermionic device facing the first surface of the intermediate layer. The second CTE is quantitatively closer than the first CTE to a CTE of a surface of the electronics layer facing the second surface of the intermediate layer.

Other aspects disclosed herein include systems, devices, components, apparatus, methods, and processes. Features of these and other aspects will become apparent from the following detailed description of exemplary embodiments, taken in conjunction with the accompanying drawings.

BRIEF DESCRIPTION OF THE SEVERAL VIEWS OF THE DRAWINGS

The drawings referenced herein form a part of and are incorporated into the specification. Features shown in the drawings are meant as illustrative of only some embodiments, and not of all embodiments, unless otherwise explicitly indicated.

DETAILED DESCRIPTION OF EXEMPLARY EMBODIMENTS

It will be readily understood that the components and features of the exemplary embodiments, as generally described herein and illustrated in the Figures, may be arranged and designed in a wide variety of different configurations. Thus, the following detailed description of the embodiments of the methods, devices, assemblies, apparatus, systems, compositions, etc. of the exemplary embodiments, as presented in the Figures, is not intended to limit the scope of the embodiments, as claimed, but is merely representative of selected embodiments.

The illustrated embodiments will be best understood by reference to the drawings, wherein like parts are designated by like numerals throughout. The following description is intended only by way of example, and illustrates certain selected embodiments of methods, devices, assemblies, apparatus, systems, etc. that are consistent with the embodiments as claimed herein.

Reference throughout this specification to "a select embodiment," "one embodiment," "an exemplary embodiment," or "an embodiment" means that a particular feature, structure, or characteristic described in connection with the embodiment is included in at least one embodiment. Thus, appearances of the phrases "in a select embodiment," "in one embodiment," "in an exemplary embodiment," or "in an embodiment" in various places throughout this specification are not necessarily referring to the same embodiment. The embodiments may be combined with one another in various combinations and modified to include features of one another.

Figure 1A:
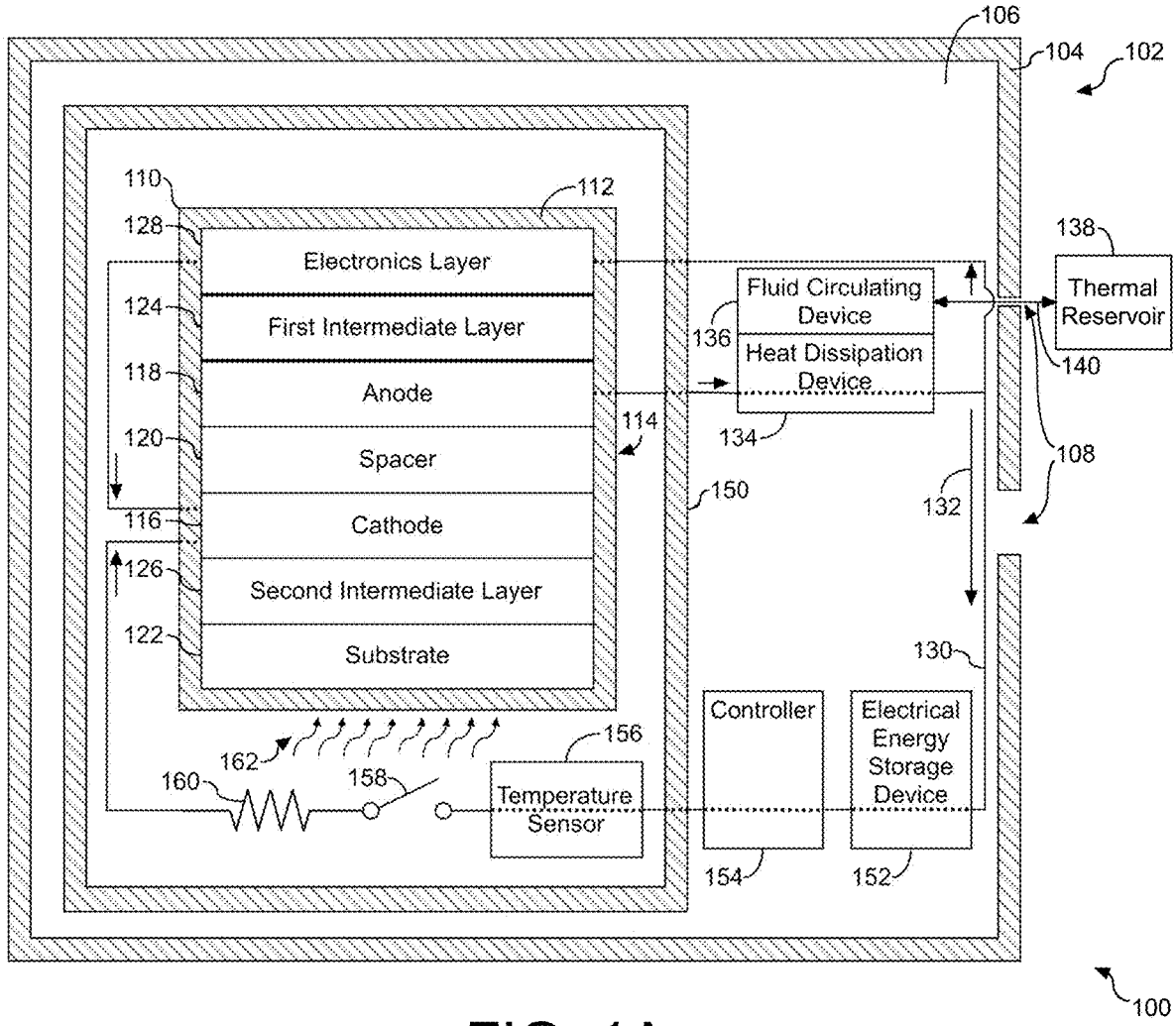
FIG. 1A depicts a block diagram of a system comprising an apparatus including a thermal energy harvesting thermionic device and an electronics layer according to an exemplary embodiment.
Figure 1B:
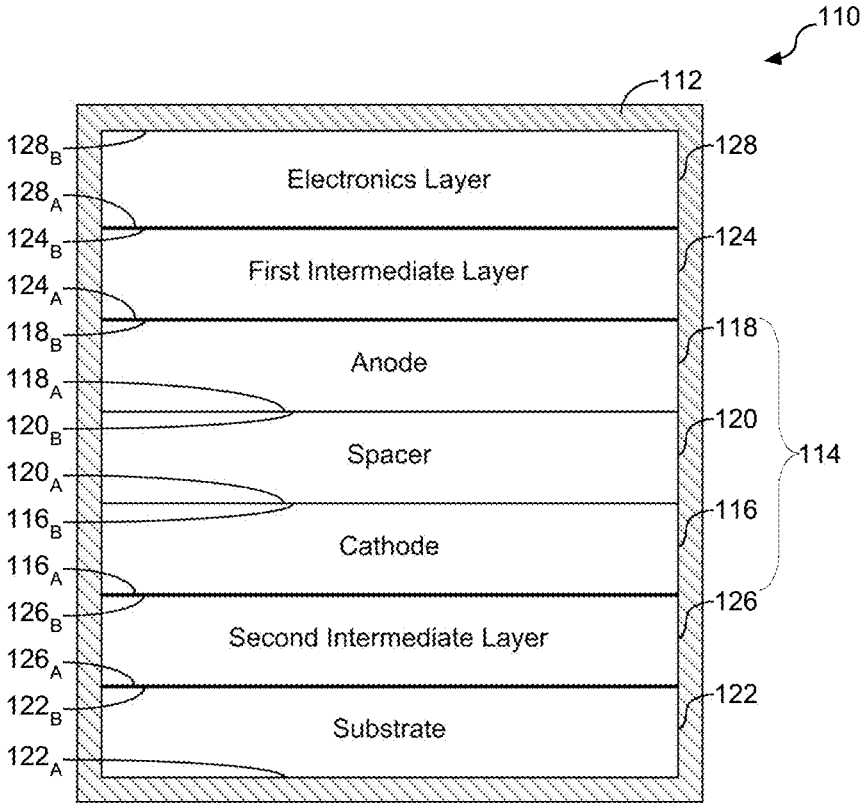
FIG. 1B depicts an enlarged view of the apparatus of FIG. 1A isolated from the remainder of the system.

Referring now more particularly to FIGS. 1A and 1B, a block diagram (100) of a system (102) including an apparatus (110) of an exemplary embodiment.

System (102)

The system (102) may be in the form of a physical device, apparatus, machine, or equipment configured for use in a commercial or domestic domain. In exemplary embodiments, the system (102) may be embodied as or in a mobile telephone, cordless telephone, a consumer electronics device, a portable electronic device, a computer such as a laptop computer and a tablet computer, a personal digital assistant (PDA), a portable radio, a power tool, a watch, a calculator, a game system or controller, a camera, a video recorder, a portable television, a global positioning system (GPS), a data transfer device, a home-consumer appliance, a light source or system, a home product, a toy, headphones, a DVD or CD player, a MP3 player, a voice recorder, a sensor, a controller, a grooming instrument, an alarm system, a weapon such as a stun gun, a backup power source, military equipment, emergency equipment, utility equipment, vehicle control system, a telecommunication device, etc.

The system (102) is shown with an external (or system) housing (104). The system housing (104) can be made of any suitable material, including, for example, metal, plastic, composite, or aerogel material, or any combination thereof. The system housing (104) defines one or more compartments or cavities (106). Although FIG. 1A shows a single compartment (106), it should be understood that the compartment (106) may be partitioned or otherwise divided into multiple sub-compartments or cavities.

Many systems are conveniently cooled by natural convection and radiation or through the use of fluid movers, e.g., fans, especially fans internal to a system housing, such as the housing (104). In an embodiment, natural convection cooling is desirable, since natural convection cooling does not involve fans that may break down or consume harvested energy. Natural convection is based on fluid motion caused by density differences driven by a temperature difference. To promote natural convection cooling, the system housing (104) is depicted in FIG. 1A with openings or fenestrations (108). The quantity, size, shape, spacing, proportions, and position of the opening(s) or fenestration(s) (108), hereinafter referred to as openings, may vary and should not be considered limiting. Further, the opening(s) (108) may be formed on any or all of the surfaces of the housing (104). The openings (108) may allow for passive heat exchange between the external (e.g., ambient) environment and the environment within the compartment (106) of the housing (104). Additionally or in the alternative, the openings (108) may allow for forced air flow, such as in connection with thermal communication passage (140), discussed below.

The compartment (106) contains several components, including an apparatus (110), an electrical conductive path (130), a heat-dissipation device (also referred to herein as a heat dissipation device (134)), a fluid-circulating device (136), a heat shield (150), an energy storage device (e.g., capacitor) (152), a controller (154), a temperature sensor (156), a switch (158), and a heat source (160). The system (102) may include fewer components than shown in FIG. 1A or additional components not shown in FIG. 1A. Although all of the components are shown within the compartment (106), it should be understood that one or more of the components may be positioned outside of the housing (104).

Each of the above-mentioned components will be described in greater detail below.

Apparatus (110)

The apparatus (110) includes a plurality of layers, including but not limited to, a substrate (122), a thermal energy harvesting thermionic device (114), a first intermediate layer (124), a second intermediate layer (126), and electronics layer (128) including at least one electronic component. As described herein, the first and second intermediate layers (124) and (126), respectively, are thermal expansion layers. It should be understood that the apparatus (110) may include additional or fewer layers than shown in FIGS. 1A and 1B (and 2 below), and that the layers may be re-arranged.

In an exemplary embodiment, the substrate (122), the first intermediate layer (124), second intermediate layer (126), the cathode (116), the anode (118) and the spacer (120) of the thermionic device (114), the and the electronics layer (128) are manufactured or made as a one-piece or unitary "printed" apparatus involving use of an electrospray apparatus, as discussed in further detail below, including with reference to FIGS. 8 and 9. In another exemplary embodiment, the substrate (122) is pre-formed, and the cathode (116), the anode (118) and the spacer (120) of the thermionic device (114), the first intermediate layers (124), the second intermediate layer (126), and the electronics layer (128) are manufactured or made as a unitary or one-piece "printed" apparatus on or operatively coupled to the substrate (122). In still another exemplary embodiment, the housing (112) forms the substrate (122), so that the housing (112) is in direct contact with the second intermediate layer (126).

The apparatus (110) also includes an apparatus housing (112). In an embodiment, the apparatus housing (112) encloses the substrate (122), the first and second intermediate layers (124) and (126), respectively, the electronics layer (128), and the thermionic device (114). In an alternative embodiment, the apparatus housing (112) may enclose one or more but fewer than all of the substrate (122), the first and second intermediate layers (124) and (126), respectively, the electronics layer (128), and the thermionic device (114).

According to an exemplary embodiment, the apparatus housing (112) is made of an aerogel material. However, the housing (112) may be made of other materials, whether conductive, semi-conductive, or insulating. Representative materials include metals, alloys, plastics, glass, etc.

Thermal Energy Harvesting Thermionic Device (114)

Figure 7:
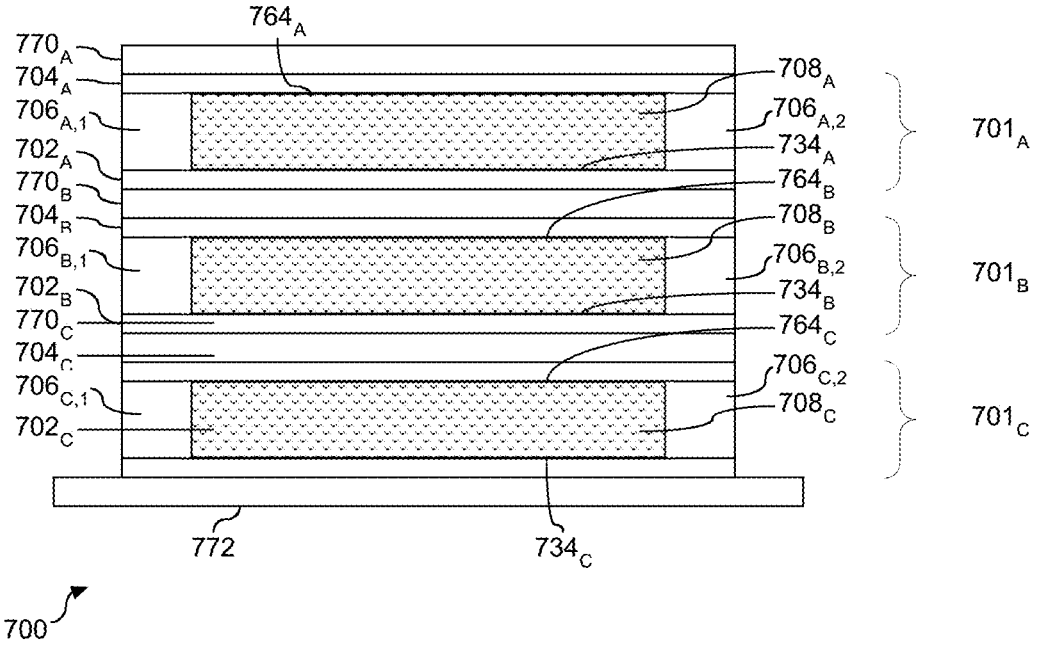
FIG. 7 depicts a cross-sectional view of a multi-layer thermal energy harvesting thermionic device according to an exemplary embodiment.

The thermal energy harvesting thermionic device (114), shown in greater detail in FIG. 1B, includes at least a cathode (116) having a first surface ($\mathbf{116}_A$) and an opposite second surface ($\mathbf{116}_B$), an anode (118) having a first surface ($\mathbf{118}_A$) and an opposite second surface ($\mathbf{118}_A$), and a spacer (120) having a first surface ($\mathbf{120}_A$) and an opposite second surface ($\mathbf{120}_B$) situated in an inter-electrode space (also referred to herein as a gap) between the cathode (116) and the anode (118). The first surface ($\mathbf{120}_A$) of the spacer (120) contacts or is otherwise operatively coupled to the second surface (116B) of the cathode (116), and the second surface ($\mathbf{120}_B$) of the spacer (120) contacts or is otherwise operatively coupled to the first surface ($\mathbf{118}_A$) of the anode (118). It should be understood that the thermionic device (114) may include additional or fewer layers than shown in FIGS. 1A and 1B (and FIG. 2 below), and that the layers may be re-arranged in any order. FIG. 7, discussed below, depicts a thermionic device having multiple anodes, cathodes, and spacers.

Exemplary embodiments of spacers are discussed below with reference to FIGS. 4, 5A, and 5B. In exemplary embodiments, the spacer (120) includes passages, such as apertures (408) discussed below in connection with FIG. 4, containing a fluid. In additional embodiments, the spacer (120) may be embodied as a permeable or semi-permeable material containing the fluid, as discussed further below, including in connection with FIG. 5B. In an exemplary embodiment, the fluid is a nano-fluid (e.g., (412) in FIG. 4 and (602) in FIG. 6) comprising a plurality of nanoparticles suspended in a fluid medium. The nanoparticles are situated to permit electron transfer between the cathode (116) and the anode (118). Exemplary embodiments of nano-fluids are discussed in greater detail below, including with reference to FIG. 6.

As best shown in FIG. 1A, the thermal energy harvesting thermionic device (114) is positioned proximal to, and in an embodiment adjacent to, the heat source (160) to receive heat or thermal energy (162) and generate an electrical output, in particular electricity.

The thermal energy harvesting thermionic device (114) operates on a thermionic power conversion principle to convert the thermal energy (162) supplied by the heat source (160) into electrical energy (electricity) by an emission of electrons from the cathode (116), which is also referred to herein as an emitter electrode. The production of electrons from the cathode (116) is controlled by barriers to the flow of electricity. The first barrier to be overcome involves establishing electron energy that is sufficiently large to exceed the work function of the cathode (116) to enable electron emission from a surface of the cathode (116), such as the second surface ($\mathbf{116}_B$) of the cathode (116). At lower temperatures, only a fraction of the electrons have sufficient energy to allow thermionic emission to proceed, thus limiting current flow. Intermediate and elevated temperatures provide higher energy than lower temperatures, with the intermediate temperatures giving rise to an increase in electron production at the second surface ($\mathbf{116}_B$) of the cathode (116) due to an increased or larger distribution of electrons with the required energy for emission. As kinetic energy of the electrons is dependent upon the temperature of the cathode (116), increasing the temperature of the cathode (116) (e.g., with a heat source such as (160)), results in an increase in electron emission, and hence electrical current.

The electrons emitted from the cathode (116) effectively cool the cathode (116) in a similar way that rain evaporating from roof carries away heat. The "hot" electrons emitted by the cathode (116) pass through the nano-fluid in the spacer (120) and heat the anode (118), which is also referred to herein as a collector electrode. This movement of electrons sets up a thermal gradient for a nanoscale heat engine.

Electrons flow from the cathode/emitter electrode (116), across the nano-fluid in the spacer (120), to the anode/collector electrode (118). As shown, the anode (118) is spaced from the cathode (116) by an inter-electrode gap containing the spacer (120). As mentioned above, a medium is contained in the spacer (120). The medium is in contact with facing surfaces ($\mathbf{116}_B$) and ($\mathbf{118}_A$) of the cathode (116) and the anode (118), respectively. According to an exemplary embodiment, the medium contains suspended nanoparticles to permit electron transfer between the cathode (116) and the anode (118). Thermal processes which involve the transport of the electrons across the nano-fluid in the electrode gap (without, or in an embodiment with minimal, resistively heating the nano-fluid) involve movement of nanoparticles within the medium in the spacer (120) to come close together or collide with each other and with the facing surfaces ($\mathbf{116}_B$) and ($\mathbf{118}_A$) of the electrodes (116) and (118), respectively. These collisions enable the hopping or transition of electrons in the direction of the electric field (i.e., current production). A reverse production of electrons from the anode (118) to the cathode (116) is suppressed by the electric field. In an embodiment, the electric field is supplied by the use of dissimilar electrode materials, e.g. metals, graphene, etc. The transmission of the electrons across the gap from the cathode (116) (emitter electrode) to the collector (118) (anode electrode) creates a flow of electrical energy, and when connected to a circuit, enables electrons to pass through an electrical load completing the circuit. Although not shown in the accompanying drawings, electrical current from the thermal energy harvesting thermionic device (114) to the load, e.g., the electronic component, via the electrical conductive path (130) may be smoothed via, for example, a trimming capacitor.

Recent improvements in thermionic power converters pertain to material selection based on work functions and corresponding work function values for the electrodes and using a fluid to fill the inter-electrode gap. Electron transfer density is limited by the materials of the electrodes and the materials of the fluid in the inter-electrode gap (i.e., the associated work functions). Representative and exemplary materials, features, conditions, etc. associated with thermal energy harvesting thermionic devices are described in further detail below, including in connection with FIGS. 4-7.

As noted, thermal energy causes electrons to flow from the cathode (116) to the anode (118). Accordingly, the heat source (160) is placed in closer proximity to the cathode (116) than the anode (118) of the thermal energy harvesting thermionic device (114) in an exemplary embodiment.

While in exemplary embodiments described above, the thermal energy harvesting thermionic device (114) harvests thermal energy from the heat source (160), in exemplary embodiments the thermionic device (114) also harvests ambient heat from air and uses the ambient heat to generate additional electricity. Additionally, excess electricity may be stored in a capacitor or other energy storage device (152) to meet varying demands for power for activating the heat source (160).

Substrate (122)

As best shown in FIG. 1A, the substrate (122) includes a first surface (122B) contacting or otherwise operatively coupled to the second intermediate layer (126), and an opposite second surface ($\mathbf{122}_A$). The substrate (122) may be made of various materials and is not particularly limited. In an exemplary embodiment, the substrate (122) is made of an inert, dielectric material. The substrate (122) may be made of a metal, plastic, composite, aerogel, or other materials. Representative, non-limiting materials that may be used for the substrate include, for example, epoxies, ceramic nanoparticle-filled resins (e.g., Grandio™), silica nanoparticle-reinforced epoxies (e.g., Futura Bond™), polydimethylsiloxane (PDMS), polymethylmethacrylate (PMMA), polymethacrylate (PMA), polyvinylalcohol (PVA), polyvinylchloride (PVC), polyacrylic acid (PAA), Mercon™, phenyl-C61-butyric acid methyl ester (PCBM), pentacene, carbazoles, phthalocyanine, and aerogels, such as silica, aluminum, chromia, graphene oxide, and tin oxide aerogels. In an exemplary embodiment, the substrate (122) is not made of (i.e., is free of) a semiconductor material, such as silicon, gallium, arsine, carbides, etc.

Electronics Layer (128)

As best shown in FIG. 1A, the electronics layer (128), also referred to herein as the nano-electronics layer, includes a first surface ($\mathbf{128}_A$) and an opposite second surface ($\mathbf{128}_B$). The electronics layer (128) includes at least one electronic component. Examples of electronic components include one or more resistors, capacitors, inductors, transformers, diodes, integrated circuits, etc., and any combination thereof. According to exemplary embodiments, at least one electronic component is a nano-electronic component. Nano-electronic components are discussed in greater detail below, including in connection with FIGS. 13-19.

Intermediate (Thermal Expansion) Layers (124) and (126)

The first intermediate layer (124), also referred to herein as a first thermal expansion layer, includes a first surface ($\mathbf{124}_A$) and an opposite second surface ($\mathbf{124}_B$). The first surface ($\mathbf{124}_A$) of the first intermediate layer (124) interfaces with a second surface ($\mathbf{118}_B$) of the anode (118). Surface ($\mathbf{118}_B$) is also referred to herein as a first surface of the thermal energy harvesting thermionic device (124). The second surface ($\mathbf{124}_B$) of the first intermediate layer (124) interfaces with the first surface ($\mathbf{128}_A$) of the electronics layer (128).

The first surface ($\mathbf{124}_A$) and the second surface ($\mathbf{124}_B$) of the first intermediate layer (124) have a first coefficient of thermal expansion (CTE) and a second CTE, respectively. In an embodiment, the first intermediate layer (124) is referred to as having a gradient CTE extending between the first and second surfaces ($\mathbf{124}_A$) and ($\mathbf{124}_B$), respectively. Measurement of the CTE of a surface shall be understood to mean the CTE of the material of which the surface is made. For example, the CTEs of the first surface ($\mathbf{124}_A$) and the second surface ($\mathbf{124}_B$) of the first intermediate layer (124) should be understood to mean the CTE of a first material of which the first surface ($\mathbf{124}_A$) is made and the CTE of a second material of which the second surface ($\mathbf{124}_B$) is made, respectively. Either linear coefficient of thermal expansion (LCTE) or volumetric coefficient of thermal expansion (VCTE) may be used for the various embodiments described herein. Further, the thermal expansion coefficient may be based on degrees Celsius, Kelvin, or Fahrenheit. Unless specified, the CTE is assumed to be the average linear coefficient of thermal expansion over the temperature range 20-300° C. and is expressed in terms of ppm/° C., and should be determined using a push-rod dilatometer in accordance with ASTM E228-11.

According to an exemplary embodiment, the first CTE of the first surface (124$_A$) is quantitatively closer than the second CTE to a CTE of the first surface (118$_B$) of the thermal energy harvesting thermionic device (114) positioned proximal to the first surface (124$_A$) of the first intermediate layer (124). Additionally, the second CTE of the second surface (124$_B$) is quantitatively closer than the first CTE to a CTE of the first surface (128$_A$) of the electronics layer (128) positioned proximal to the second surface (124$_B$) of the first intermediate layer (124). In an exemplary embodiment, the first CTE of the first surface (124$_A$) of the first intermediate layer (124) is within plus or minus 10 percent of the CTE of the proximal first surface (118$_B$) of the thermal energy harvesting thermionic device (114), and the second CTE of second surface (124$_B$) of the first intermediate layer (124) is within plus or minus 10 percent of the CTE of the proximal first surface (128$_A$) of the electronics layer (128). In another exemplary embodiment, the first CTE of the first surface (124$_A$) of the first intermediate layer (124) is within plus or minus 2 percent of the CTE of the first surface (118$_B$) of the thermal energy harvesting thermionic device (114), and the second CTE of the second surface (124$_B$) of the first intermediate layer (124) is within plus or minus 2 percent of the CTE of the proximal first surface (128$_A$) of the electronics layer (128).

Likewise, the second intermediate layer (126) includes a first surface (also referred to as a third surface) (126$_A$) and an opposite second surface (also referred to as a fourth surface) (126$_B$). The third surface (126$_A$) of the second intermediate layer (126) interfaces with a second surface (122$_B$) of the substrate (122). The fourth surface (126$_B$) of the second intermediate layer (126) interfaces with the first surface (116$_A$) of the cathode (116), also referred to herein as the second surface (116$_A$) of the thermal energy harvesting thermionic device (114).

The third surface (126$_A$) and the fourth surface (126$_B$) of the second intermediate layer (126) have a third coefficient of thermal expansion (CTE) and a fourth CTE, respectively. In an embodiment, the second intermediate layer (126) is referred to as having a gradient CTE extending between the third and fourth surfaces (126$_A$) and (126$_B$), respectively. According to an exemplary embodiment, the third CTE of the third surface (126$_A$) is quantitatively closer than the fourth CTE to a CTE of a surface (122$_B$), referred to herein as the first surface (122$_B$), of the substrate (122) positioned proximal to the third surface (126$_A$) of the second intermediate layer (126). Additionally, the fourth CTE of the fourth surface (126$_B$) is quantitatively closer than the third CTE to a CTE of the second surface (116$_A$) of the thermionic device (114) positioned proximal to the fourth surface (126$_B$). In an exemplary embodiment, the third CTE of the third surface (126$_A$) of the second intermediate layer (126) is within plus or minus 10 percent of the CTE of the proximal second surface (122$_B$) of the substrate (122), and the fourth CTE of the fourth surface (126$_B$) of the second intermediate layer (126) is within plus or minus 10 percent of the CTE of the proximal second surface (116$_A$) of the thermionic device (114). In another exemplary embodiment, the third CTE of the third surface (126$_A$) of the second intermediate layer (126) is within plus or minus 2 percent of the CTE of the proximal second surface (122$_B$) of the substrate (122), and the fourth CTE of the fourth surface (126$_B$) of the second intermediate layer (126) is within plus or minus 2 percent of the CTE of the proximal second surface (116$_A$) of the thermal energy harvesting thermionic device (114).

It should be noted that the terms "first," second," "third," and "fourth" are assigned for explanatory and simplification purposes in connection with embodiments, and may differ throughout the specification and claims for different embodiments.

An exemplary embodiment in which the first and second intermediate layers have non-linear gradient coefficients of thermal expansion will now be described with reference to FIG. 11. Parts (1110), (1112), (1114), (1116), (1116$_A$), (1116$_B$), (1118), (1118$_A$), (1118$_B$), (1120), (1120$_A$), (1120$_B$), (1122), (1122$_A$), (1122$_B$), (1124), (1124$_A$), (1124$_B$), (1126), (1126$_A$), (1126$_B$), (1128), (1128$_A$), and (1128$_B$) have the same or similar properties and features of corresponding parts (110), (112), (114), (116), (116$_A$), (116B), (118), (118$_A$), (118$_B$), (120), (120$_A$), (120$_B$), (122), (122$_A$), (122$_B$), (124), (124$_A$), (124$_B$), (126), (126$_A$), (126B), (128), (128$_A$), and (128B), respectively. In the interest of brevity, the description of components, properties, features, etc. associated with those parts of FIGS. 1A and 1B is incorporated herein by reference with respect to FIG. 11.

Figure 11:
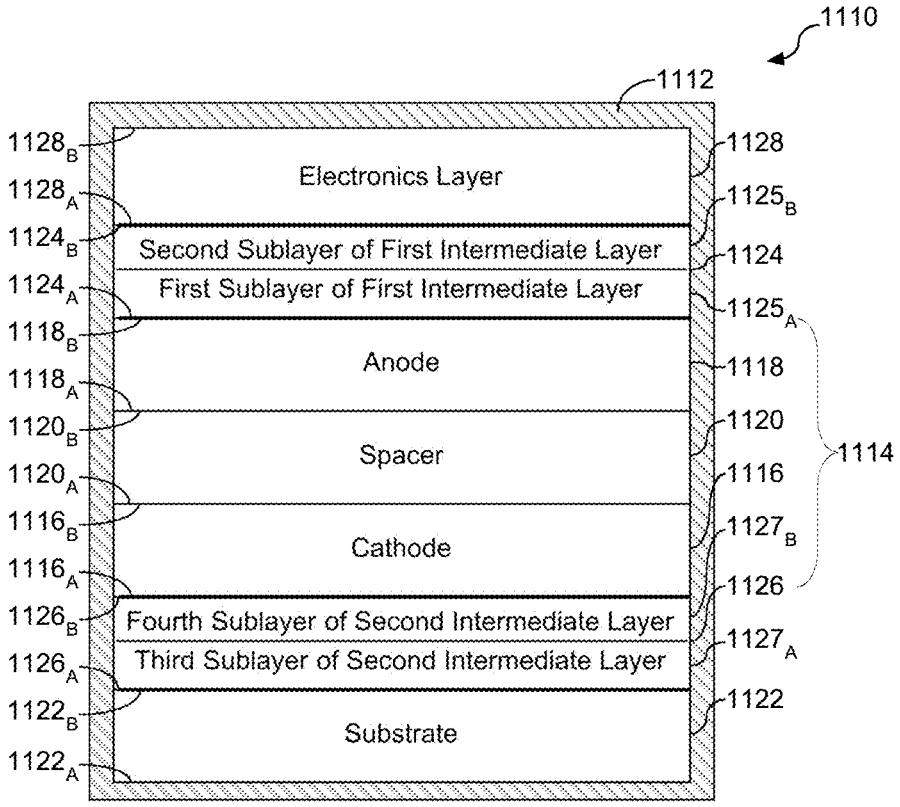
FIG. 11 depicts an embodiment of the apparatus having gradient intermediate layers.

In the exemplary embodiment of FIG. 11, the first intermediate layer (1124) comprises at least a first sublayer (1125$_A$) and a second sublayer (1125$_B$). The first sublayer (1125$_A$) and the second sublayer (1125$_B$) have a uniform or relatively uniform first CTE and a uniform or relatively uniform second CTE, respectively, wherein the first and second CTEs differ from one another in the first and second sublayers (1125$_A$) and (1125$_B$), respectively. The first CTE of the first sublayer (1125$_A$) is quantitatively closer to the CTE of the second surface (1118$_B$) of the anode (1118) than the second CTE of the second sublayer (1125$_B$) is to the CTE of the second surface (1118$_B$) of the anode (1118). Further, the second CTE of the second sublayer (1125$_B$) is quantitatively closer to the CTE of the surface (1128$_A$) of the electronics layer (1128) than the first CTE of the first sublayer (1125$_A$) is to the CTE of the surface (1128$_B$) of the electronics layer (1128). As a non-limiting example, the first sublayer (1125$_A$) and the second sublayer (1125$_B$) may be first and second alloys, respectively, of the compositions of the second surface (1118$_B$) of the anode (1118) and the surface (1128$_A$) of the electronics layer (1128), with the first sublayer (1125$_A$) having a first alloy composition including greater than 50% by weight of the composition of the anode (1118) and less than 50% of the composition of the electronics layer (1128). Conversely, the second sublayer (1125$_B$) has a second alloy composition including greater than 50% by weight of the composition of the surface (1128$_A$) of the electronics layer (1128) and less than 50% by weight of the composition of the second surface (1118$_B$) of the anode (1118). For example, the first sublayer (1125$_A$) can have a 75:25, 90:10, or other weight ratio of the composition of the surface (1118$_B$) of the anode (1118) to the composition of the surface (1128$_A$) of the electronics layer (1128). The second sublayer (1125$_B$) can have, for example, a 25:75, 10:90, or other weight ratio of the composition of the surface (1118$_B$) of the anode (1118) to the composition of the surface (1128$_A$) of the electronics layer (1128).

Additionally, in the exemplary embodiment of FIG. 11, the second intermediate layer (1126) comprises at least a first sublayer (also referred to herein as a third sublayer) (1127$_A$) and a second sublayer (also referred to herein as a fourth sublayer (1127$_B$). The third sublayer (1127$_A$) and the fourth sublayer (1127$_B$) have a third CTE and a fourth CTE, respectively. The third CTE is quantitatively closer to the CTE of the surface (1122$_B$) of the substrate (1122) than the fourth CTE is to the CTE of the surface (1122$_B$) of the substrate (1122). Further, the fourth CTE is quantitatively closer to the CTE of the first surface (1116$_A$) of the cathode (1116) than the third CTE is to the CTE of the first surface ($1116_A$) of the cathode (1116). As a non-limiting example, the third sublayer ($1127_A$) and the fourth sublayer ($1127_B$) may be third and fourth alloys, respectively, of the compositions of the substrate (1112) and the cathode (1116), with the third sublayer ($1127_A$) having a third alloy composition including greater than 50% by weight of the composition of the surface ($1122_B$) of the substrate (1122) and less than 50% of the composition of the first surface ($1116_A$) of the cathode (1116). Conversely, the fourth sublayer ($1127_B$) has a fourth alloy composition including greater than 50% by weight of the composition of the first surface ($1116_A$) of the cathode (1116) and less than 50% by weight of the composition of the surface ($1122_B$) of the substrate (1122). For example, the third sublayer ($1127_A$) can have a 75:25, 90:10, or other weight ratio of the composition of the surface ($1122_B$) of the substrate (1122) to the composition of the first surface ($1116_A$) of the cathode (1116). The fourth sublayer ($1127_B$) can have, for example, a 25:75, 10:90, or other weight ratio of the composition of the first surface ($1116_A$) of the cathode (1116) to the composition of the surface ($1122_B$) of the substrate (1122).

Another exemplary embodiment in which the first and second intermediate layers have linear gradient coefficients of thermal expansion will now be described with reference to FIG. 12. Parts (1210), (1212), (1214), (1216), ($1216_A$), ($1216_B$), (1218), ($1218_A$), ($1218_B$), (1220), ($1220_A$), ($1220_B$), (1222), ($1222_A$), ($1222_B$), (1224), ($1224_A$), ($1224_B$), (1226), ($1226_A$), ($1226_B$), (1228), ($1228_A$), and ($1228_B$) have the same or similar properties and features of corresponding parts (110), (112), (114), (116), ($116_A$), ($116_B$), (118), ($118_A$), ($118_B$), (120), ($120_A$), ($120_B$), (122), ($122_A$), ($122_B$), (124), ($124_A$), ($124_B$), (126), ($126_A$), ($126_B$), (128), ($128_A$), and ($128_B$), respectively. In the interest of brevity, the description of components, properties, features, etc. associated with those parts of FIGS. 1A and 1B is incorporated herein by reference with respect to FIG. 12.

Figure 12:
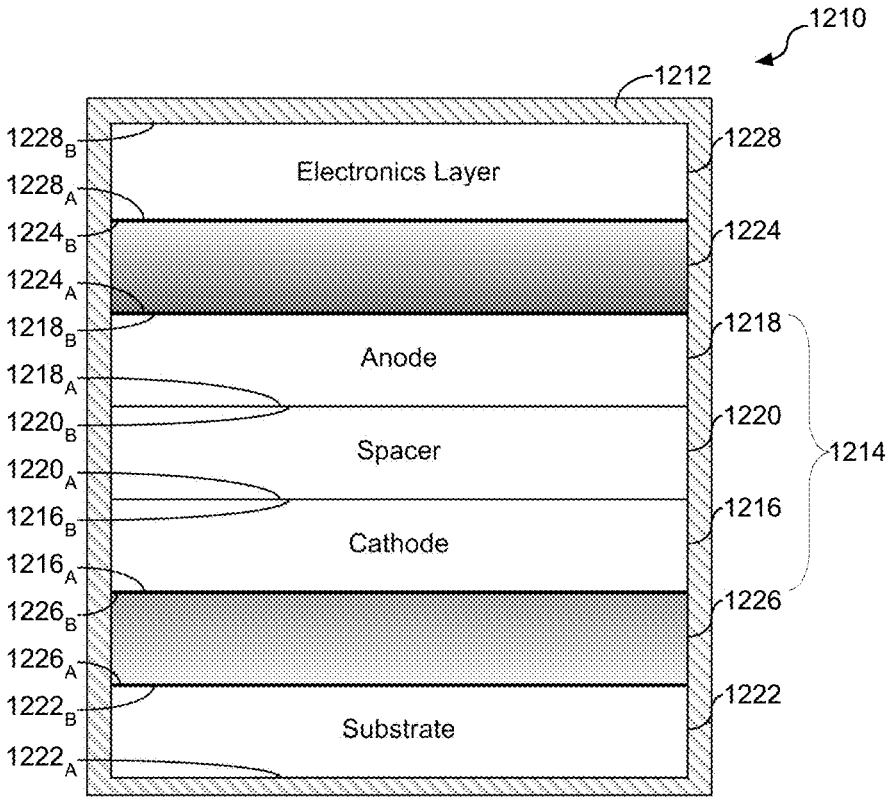
FIG. 12 depicts another embodiment of the apparatus having gradient intermediate layers.

In the exemplary embodiment of FIG. 12, the first intermediate layer (1224) has a composition that linearly (or non-linearly) changes across its thickness, from the first surface ($1224_A$) to the second surface ($1224_B$), thereby providing the intermediate layer (1224) with graduated properties. The composition of the first intermediate layer (1224) may be an alloy of the respective compositions of the second surface ($1218_B$) of the anode (1218) and the surface ($1228_B$) of the electronics layer (1228). Nearest to the anode (1218), the alloy composition of the first intermediate layer (1224) has its highest ratio of anode surface ($1218_B$) composition to electronics layer surface ($1228_A$) composition, e.g., 90:10 weight percent anode (1218) composition to electronics layer (1228) composition. Nearest to the electronics layer (1228), the alloy composition of the first intermediate layer (1224) has its highest ratio of electronics layer surface ($1228_A$) composition to anode surface ($1218_B$) composition, e.g., 90:10 weight percent electronics layer surface ($1228_A$) composition to anode surface ($1218_A$) composition. The ratio changes gradually, and in an exemplary embodiment continuously (e.g., linearly), from the first surface ($1224_A$) to the second surface ($1224_B$) of the first intermediate layer (1224). In an exemplary embodiment, the alloy composition of the first intermediate layer (1224) at the midpoint between the first and second surfaces ($1224_A$) and (1224B) will be 50:50 weight percent anode surface ($1218_B$) composition to the electronics layer surface ($1228_A$) composition.

Similarly the exemplary embodiment of FIG. 12, the second intermediate layer (1226) has a composition that linearly (or non-linearly) changes across its thickness, from the third surface (1226A) to the fourth surface ($1226_B$). The composition of the second intermediate layer (1226) may be an alloy of the respective compositions of the surface ($1222_B$) of the substrate (1222) and the first surface ($1216_A$) of the cathode (1216). Nearest to the substrate (1222), the alloy composition of the second intermediate layer (1226) has its highest ratio of substrate surface ($1222_B$) composition to cathode surface ($1216_A$) composition, e.g., 90:10 weight percent substrate surface ($1222_B$) composition to cathode surface ($1216_A$) composition. Nearest to the cathode (1216), the alloy composition of the second intermediate layer (1226) has its highest ratio of cathode surface (1216A) composition to substrate surface ($1222_A$) composition, e.g., 90:10 weight percent cathode surface ($1216_A$) composition to substrate surface ($1222_B$) composition. The ratio changes gradually, and in an exemplary embodiment continuously (e.g., linearly), from the third surface ($1226_A$) to the fourth surface ($1226_B$). In an exemplary embodiment, the alloy composition of the second intermediate layer (1226) at the midpoint between the third and fourth surfaces ($1226_A$) and ($1226_B$) will be 50:50 weight percent substrate surface ($_{1222B}$) composition to cathode surface ($1216_A$) composition.

Representative thermal expansion layers and methods of making the first and second intermediate layers, including with gradient coefficients of thermal expansion, are disclosed in U.S. patent application Ser. No. 16/416,849 filed May 20, 2019 entitled "Single-Nozzle Apparatus for Engineered Nano-Scale Electrospray Depositions," U.S. patent application Ser. No. 16/416,858 filed May 20, 2019 entitled "Multi-Nozzle Apparatus for Engineered Nano-Scale Electrospray Depositions," and in U.S. patent application Ser. No. 16/416,869 filed May 20, 2019 entitled "Method of Fabricating Nano-Structures with Engineered Nano-Scale Electrospray Depositions," the detailed descriptions and drawings of which are incorporated herein by reference.

Certain embodiments disclosed in those applications relate to, among other things, an electrospray apparatus for implementing electrospraying techniques to fabricate structures (e.g., composites), including nano-structures (e.g., nano-composites) with tailored properties. In one aspect, the electrospray apparatus is provided with at least one reservoir to hold at least a first composition and a second composition, wherein the first and second compositions differ from one another. The first composition includes a first nano-structural material and a plurality of first grain growth inhibitor nano-particles including one or more first grain growth inhibitors. The first composition also includes a first tailoring solute and/or a plurality of first tailoring nano-particles. The second composition includes a second nano-structural material and a plurality of second grain growth inhibitor nano-particles including one or more second grain growth inhibitors. The second composition also includes a second tailoring solute and/or a plurality of second tailoring nano-particles. The electrospray apparatus also includes at least one nozzle operatively coupled to the reservoir(s) and a stage positioned proximate to the nozzle(s). The stage is adapted to hold the substrate (1222) and move relative to the nozzle(s). The electrospray apparatus further includes a surface profile determination device positioned proximate to the stage to obtain profile data of the substrate (1222). A control unit is operatively coupled to the device and the stage and regulates manufacture of a pinned nano-structure. The control unit forms a first deposition layer positioned proximal to the substrate, e.g., (1222) of FIG. 12, with the first composition. The control unit also forms a second deposition layer positioned proximal to the substrate with the second composition. For example, a reservoir of the electrospray apparatus can include a first molten material having the first composition below a second material having the second composition. Alternatively, the first and second molten materials can be delivered from first and second reservoirs, respectively, and one or more control valves can regulate the flows of the first and second molten materials from their respective reservoirs to the electrospray nozzle(s).

The nano-structural materials include, for example: Cu, FeCu, FeCo, MoSi, MoC, NbC, NiCr, TiC, NiAl, $Mo_2Si$, $NiCr/Cr_3C_2$, Fe/TiC, Mo/TiC, WC/Co, or any of the forgoing alloys with one or more of Ti, TiC, Mn, W, B, Y, Cr, Mo, Ni, Zr, Ce, Fe, Al, Si, V, and mixtures of the foregoing metals. Grain-grown inhibitors include, for example: B, Si, Al, Cr, Ni, Mo, Hf, Ta, Fe, W, Zr, Ce, Ti, Mo, TiC, AlSi, TiSi, TiAl, and $TiB_2$, and a combination thereof. In addition, materials such as rare earth metals, silicon-based carbides, titanium-based carbides, aluminum-based nitrides, titanium-based nitrides, BN, metal silicides, and metal aluminides may be used.

Electrically Conductive Path (130)

The electrical conductive path (130) includes one or more electrical conductors. The one or more electrical conductors can be, for example, one or more electricity-conveying members such as wires, traces, electrical ink, electrical lines, etc. Portions of the electrical conductive path (130) connected to or passing through parts or components, such as the heat dissipation device (134), and walls of the heat shield (150), are sometimes shown as broken or dashed lines passing through the parts or components for convenience sake.

The electrical conductive path (130) is established between the thermionic device (114) and electronic components of the electronics layer (128) to transfer electrical output from the thermionic device (114) to the electronics layer (128). The flow direction of electrons is represented by arrows (132) in FIG. 1A. The electrical conductive path (130) between the thermionic device (114) and the electronics layer (128) is shown external to the housing (112), but in an embodiment may be internal to the housing (112) and may pass through layers of the apparatus (110), e.g., through first and second intermediate layers (124) and (126), respectively.

Heat Dissipation/Heat Dissipation Device (134)

In exemplary embodiments, the heat dissipating device (134) is positioned to reduce the temperature of the electrical conductive path (130). It should be understood that the use of the heat-dissipation device (134) and associated fluid-circulating device (136) and thermal reservoir (138) in the embodiment of FIG. 1A is optional, as are other components illustrated in FIGS. 1A, 1B, and 2 and described herein.

According to an exemplary embodiment, a design feature of an exemplary embodiment of the circuit is that the size, e.g., diameter, of the return wire or other electrical conductive path(s)/connector(s) (132) is small enough to transfer heat readily back to the cathode (116) without creating a large or excessive resistance. The temperature or average energy of electrons is reduced due to thermal exchange of heat leaving the anode (118) to the heat dissipation device (also referred to and embodied herein as a heat dissipating device) (134), such as a heat exchanger or a heat sink. The electron flow leaving the anode (118) and passing through the heat dissipation device (134) is thereby delivered to the electronics layer (128) via conductive path (132) with less thermal energy, thereby reducing likelihood that the electronics layer (128) will overheat. This reduced thermal energy is re-supplied to the cathode (116) via the conductive path (132) to maintain the thermionic device operating at a high efficiency. In an exemplary embodiment, the heat-dissipation device (134) is a microstructure array heat exchanger, and in an exemplary embodiment is the heat-dissipating device shown and described below in FIGS. 3A and 3B. Implementation of the heat dissipating device (134) functions to reduce an average energy of electrons leaving the anode (118). Returning electrons that are re-supplied to the cathode/emitter electrode (116) will therefore complete a heat engine cycle with a lower average energy leaving electronics layer (128) than emitted from the anode (118).

Figure 3A:
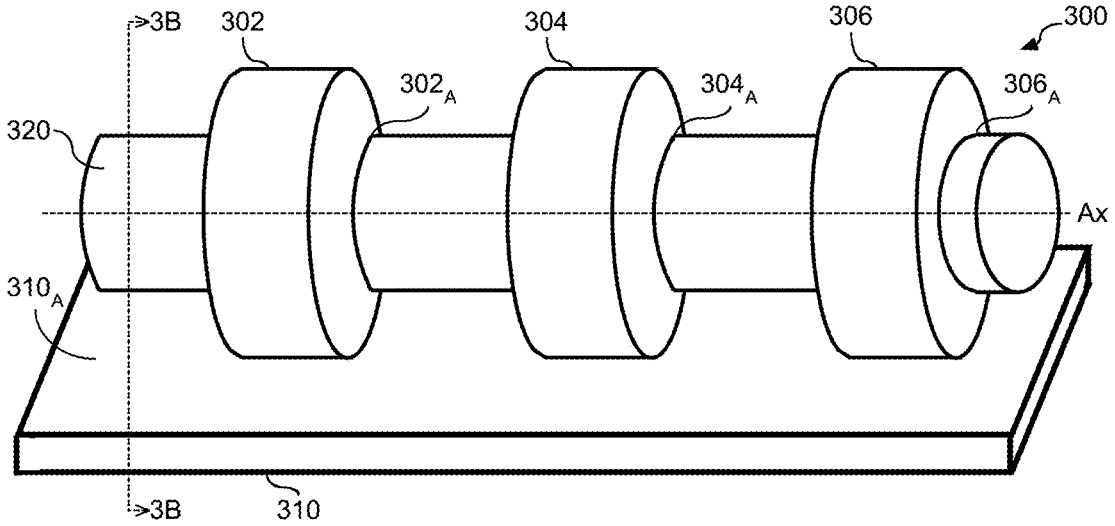
FIG. 3A depicts a fragmented side perspective view of a heat-dissipating device according to an exemplary embodiment.
Figure 3B:
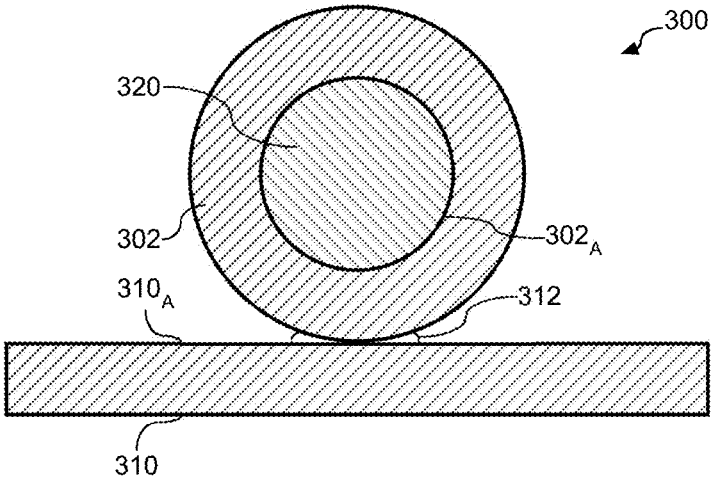
FIG. 3B depicts a cross-sectional view of the heat-dissipating device of FIG. 3A taken along sectional line 3B-3B of FIG. 3A

The heat-dissipation device (134) may be embodied as, for example, a heat sink or a heat exchanger. In an exemplary embodiment, the heat-dissipation device (134) comprises a micro-structure array heat exchanger. Referring to FIGS. 3A and 3B, an embodiment of a heat-dissipating device is generally designated by reference numeral (300) positioned with respect to the conductive path (130), embodied in FIGS. 3A and 3B as an electrical conductor (320), such as a wire, having a central longitudinal axis $A_x$. In FIG. 3A, the electrical conductor (320) is shown continuous in length and fragmented at opposite ends, such that the electrical conductor (320) may be proportionally longer than illustrated.

The heat-dissipation device (300) includes a plurality of rings, annular fins, or arcuate surfaces, hereinafter referred to as annular fins, and illustrated as first, second, and third annular fins (302), (304), and (306), respectively. Although three annular fins (302), (304), and (306) are shown in FIG. 3A, it should be understood that the heat-dissipation device (300) may include fewer or more annular fins, and the annular fins may possess configurations other than annular shapes. The first, second, and third annular fins (302), (304), and (306) dissipate heat from the conductor (320), and more specifically, fluid (e.g., air) circulating around the fin surfaces of the fin array acts as a heat transfer medium for cooling the conductor (320) to an operable temperature. The fins (302), (304), and (306) may be a heat-conductive material, such as copper, copper alloy, aluminum, etc. Accordingly, the fin array shown herein prevents the conductor from overheating by absorbing its heat and dissipating the heat into the air and/or through a base (310), discussed below.

In FIGS. 3A and 3B, the annular fins (302), (304), and (306) are shown mounted on or positioned proximal to a base (310). The base (310) is depicted as a plate with a planar or relatively planar upper surface ($\mathbf{310}_A$). It should be understood, however, that the base (310) may possess other shapes. For example, in an embodiment, the annular fins (302), (304), and (306) may be frictionally fitted between grommets (not shown), with the grommets incorporating the functionality of the base (310), which may be omitted. In an exemplary embodiment, the base (310) acts as a heat sink and is made of a heat-conductive material, such as copper, copper alloy, aluminum, etc. When mounted to the base, the annular fins (302), (304), and (306) are connected to the base (310) with solder (312), although adhesive, mechanical fasteners, or other connectors and thermal interface materials may be used.

The first, second, and third annular fins (302), (304), and (306), respectively, include corresponding openings, shown in FIG. 3A as first, second, and third central circular openings ($\mathbf{302}_A$), ($\mathbf{304}_A$), and ($\mathbf{306}_A$), respectively. The annular fins (302), (304), and (306) are concentrically or relatively concentrically positioned around an exterior surface of the electrical conductor (320), so that each of the annular fins (302), (304), and (306) is centered on or coaxial with the longitudinal axis $A_x$ of the electrical conductor (320). The first, second, and third annular fins (302), (304), and (306), respectively, are shown spaced apart from one another along the longitudinal axis $A_x$. The spacing is illustrated as uniform, although it should be understood that non-uniform or no spacing may be employed.

As shown in FIG. 3B, the diameter of the opening ($\mathbf{302}_A$) of the first fin (302) is approximately equal to, or slightly greater than, the outer diameter of the electrical conductor (320). The diameters of openings of the second and third fins ($\mathbf{304}_A$) and ($\mathbf{306}_A$) may be similarly sized with respect to the outer diameter and exterior surface of the electrical conductor (320). Any gap between the outer surface of the electrical conductor (320) and the inner edges of the annual structures (302), (304), and (306) defining the openings ($\mathbf{302}_A$), ($\mathbf{304}_A$), and ($\mathbf{306}_A$), respectively, is mitigated or eliminated following receipt of the conductor (320). In an exemplary embodiment, the fins (302), (304), and (306) are friction fitted on or with respect to the electrical conductor (320) so as to be not movable or to mitigate movement of the fins along the longitudinal axis $A_x$.

In an exemplary mode of operation, heat conveyed by the electrical conductor (320) is removed in part by the fins (302), (304), and (306) and transmitted to the base (310), which together function as a heat sink.

Fluid-Circulating Device (136) and Thermal Reservoir (138)

The system (102) also includes a fluid-circulating device (136) operatively coupled to a thermal reservoir (138). The fluid-circulating device (136) may be, for example, one or more fans, impellers, blowers, or any device configured to facilitate fluid flow. Although the fluid-circulating device (136) is depicted in FIG. 1A enclosed within the system housing (104), it should be understood that the fluid-circulating device (136) may be externally situated with respect to the system housing (104). The fluid-circulating device (136) communicates with the thermal reservoir (138) via a pathway for thermal communication (140). The fluid-circulating device (136) may provide cooling fluid (e.g., gas, such as air) to the heat dissipation device (134), and thereby remove heat from the heat-dissipation device (134), or exchange fluid (e.g., air) between the heat dissipation device (134) and the thermal reservoir (138). The pathway, also referred to herein as a passage, for thermal communication (140) may comprise, for example, one or more conduits, pipes, vents, ducts, other parts and passages, and/or combinations thereof. The thermal reservoir (138) may comprise, for example, one or more cooling fluid reservoirs.

Electrical Energy Storage Component (152)

The electrical energy storage device (152), also referred to herein as a storage device, is shown herein positioned internal to a housing (104) of the system (102), within the compartment (106). In an alternative embodiment, the electrical energy storage device (152) may be positioned external to the housing (104). In an exemplary embodiment, one or more capacitors are selected as the electrical energy storage device (152), although other devices capable of storing electrical energy, e.g., a charge, may be used, especially for meeting large electrical demand periods. Unless otherwise indicated, the term capacitor can include supercapacitor, micro-capacitor, micro-supercapacitor, and the like. Examples of electrical energy storage devices that may be used instead of or in combination with one or more capacitors include, without limitation, inductors, fuel cells, non-rechargeable batteries, rechargeable batteries, and other electrical energy storage elements.

Heat Source (160)

In an exemplary embodiment, heat is the by-product of resistance of a circuit component, including but not limited to resistors. In an exemplary embodiment, the heat source (160) comprises one or more resistors. Various types of resistors may be employed. In an exemplary embodiment, selection or employment of resistors is configurable. For example, resistors suitable for use as the heat source (160) may have a resistance in a range of, for example, about 0.01 ohms to about 10 k ohms (10,000 ohms) and/or a power dissipation rating of, for example, about 0.001 watts to about 1 or more megawatts. Other heating sources with low thermal resistance change may be used instead of or in addition to a resistor.

The heat source (160) is positioned proximal to the thermal energy harvesting thermionic device (114) so that the thermal energy generated by the heat source (160), when activated by the controller (154) closing the switch (158), thermally perturbs the thermal energy harvesting thermionic device (114).

Temperature Sensor (156)

The temperature sensor (156) may be embodied as one or more thermocouples. The temperature sensor (156) measures the temperature of the thermal energy harvesting thermionic device (114) or a component thereof, e.g., the cathode (116), the anode (118), the nano-fluid or spacer (120), or a temperature difference between two or more of the components.

Controller (154) and Switch (158)

The controller (154) monitors the temperature, as measured by the temperature sensor (156), for a temperature drop below a temperature threshold. In an embodiment, the temperature threshold is a temperature value. In another embodiment, the temperature threshold is a range of temperatures. The temperature threshold may be predetermined. For example, the temperature threshold may be any value between the freezing point and the boiling point of the nano-fluid (discussed below) of the thermal energy harvesting thermionic device (114). In another embodiment, the temperature threshold is a temperature difference (temperature gradient) between the cathode and anode.

In response to detection that the temperature (as monitored by the temperature sensor (156)) of the thermal energy harvesting thermionic device (114) has fallen below the temperature threshold, the controller (154) closes the switch (158). Electricity is supplied from the electrical energy storage device (152) to the heat source (160). As current (typically direct current (DC)) flows from the electrical energy storage device (152) to the heat source (160), the electrical energy is converted by the heat source (160) into heat (or thermal energy) (162).

In an exemplary embodiment, the controller (154) activates the heat source (160) to generate a temperature in a range of about −200° C. to about 2,000° C. In an exemplary embodiment, the temperature range is correlated with the composition of the nano-fluid. For example, at −200° C. the nano-fluid composition may include an alkali metal, and at the highest temperature range the nano-fluid composition may include molten salts. Similarly, in another embodiment, at room temperature, such as 25° C. to 200° C., the nano-fluid composition may include organics, such as toluene, alkanes, alkane thiols, and/or water, with each composition having respective operational temperatures or temperature ranges.

In an exemplary embodiment, the controller (154) closes the switch (158) for a period of about 4-10 seconds to about 100 seconds, which is sufficient time for the electrical energy storage device (152) to supply electricity to the heat source (160) to generate heat for harvesting by the thermal energy harvesting thermionic device (114). The amount of time selected for activating the heat source (160) may be based on various factors, including but not limited to the ambient temperature of the environment in which the system (102) is located, the temperature of the nano-fluid prior to activation, etc. The magnitude of the resulting current produced by the thermal energy harvesting thermionic device (114) will depend upon many factors, including the heat energy emitted by the heat source (160). In an exemplary embodiment, activating the heat source (160) for a limited duration, e.g. seconds, can increase the electrical output of the thermal energy harvesting thermionic device (114) for an extended duration, e.g. hours.

As explained above, the thermal energy (162) generated by the heat source (160), when activated by the controller (154) closing the switch (158), thermally perturbs the thermal energy harvesting thermionic device (114). The device (114) generates electricity for recharging of the electrical energy storage component (152). Eventually, the cycle will decrease to the point at which an outside electrical source, e.g., a battery or AC power source, should supply electricity to charge the electrical energy storage component (152).

The controller (154), which may be embodied as a control circuit, may include at least one processor (e.g., a microprocessor), at least one microcontroller, at least one programmable logic device (e.g., field programmable gate arrays, programmable array logic, programmable logic devices), at least one application specific integrated circuit, or the like, or combinations including one or more thereof. The controller (154) may include or operatively communicate with a memory or memory module. Memory or memory modules may be in the form of nonvolatile data stores, such as hard drives and/or nonvolatile memory. A non-exhaustive list of more specific examples of memory includes the following: a portable computer diskette, a hard disk, a dynamic or static random access memory (RAM), a read-only memory (ROM), an erasable programmable read-only memory (EPROM or Flash memory), a magnetic storage device, a portable compact disc read-only memory (CD-ROM), a digital versatile disk (DVD), a memory stick, and any suitable combination of the foregoing. The memory may store one or more software-based control applications that include instructions that the control circuit executes to perform the functions described herein.

Heat Shield (150)

As shown in FIG. 1A, the system (102) further includes the heat shield (150). The heat shield (150) houses the apparatus (110), the temperature sensor (156), the switch (158), and the heat source (160). In an exemplary embodiment, the heat shield (150) is a thermal barrier that allows heat generated by the heat source (160) to be exposed to the temperature sensor (156) and the thermionic device (114), but that shields, insulates, or otherwise protects other components of the system (102) (such as the electrical energy storage device (152) and the controller (154)) from the heat generated by the heat source (160). In an exemplary embodiment, the heat shield (150) is made of a thermally non-conductive material. In another exemplary embodiment, the heat shield (150) is comprised of an aerogel material. Notably, other embodiments disclosed herein, including that of FIG. 2, may include a heat shield comprised of an aerogel or other material, e.g., for providing heat shielding. Alternatively, the system (102) of FIG. 1A may omit the heat shield (150).

Figure 2:
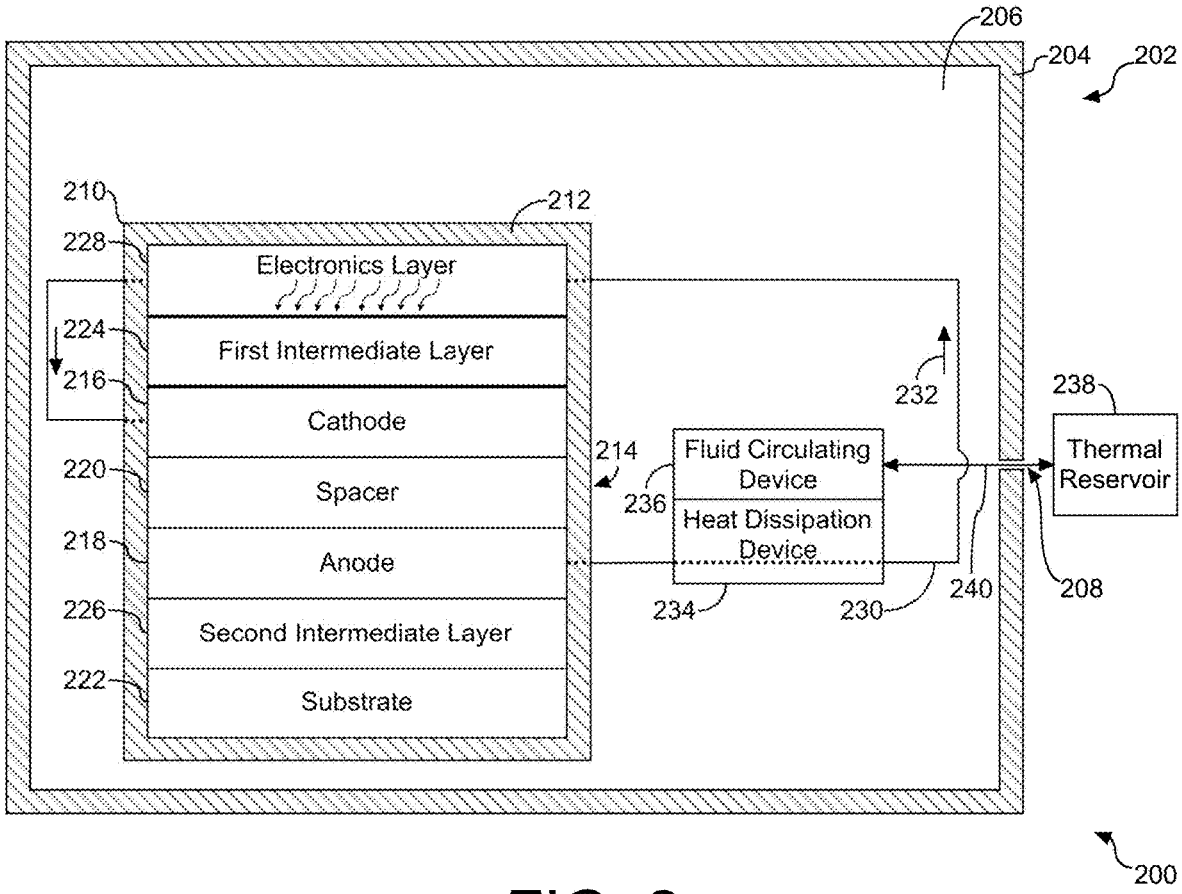
FIG. 2 depicts a block diagram of a system including an apparatus containing a thermal energy harvesting thermionic device and an electronics layer according to another exemplary embodiment.

Alternative Embodiment (FIG. 2)

FIG. 2 illustrates a modification to the embodiment of FIGS. 1A and 1B. FIG. 2 depicts a block diagram (200) of a system (202) having an external housing (204) defining a compartment (206). Situated within the compartment (206) are an apparatus (210) with a housing (212) containing a thermal energy harvesting thermionic device (214), a heat dissipation device (234), a fluid-circulating device (236), a thermal communication pathway (240), and an electrical conductive path (230) with electron flow (232). Arrow (232) represents the flow direction of electrons leaving an anode (218). Parts (202), (204), (206), (208), (210), (212), (214), (216), (218), (220), (222), (224), (226), (228), (230), (232), (234), (236), (238), and (240) have the same or similar properties and features of corresponding parts (102), (104), (106), (108), (110), (112), (114), (116), (118), (120), (122), (124), (126), (128), (130), (132), (134), (136), (138), and (140), respectively. In the interest of brevity, the description of components, properties, features, etc. associated with those parts of FIGS. 1A and 1B is incorporated herein by reference with respect to FIG. 2.

Electronics, particularly resistors, generate thermal energy in one or more of a number of ways, including through the use of resistors. In the apparatus (210) of the system (202) of FIG. 2, rather than providing a discrete heat source that is not part of the apparatus (210), such as heat source (160) of FIG. 1A, the electronics of the electronics layer (228), also referred to herein as the nano-electronics layer, of the apparatus (210) generates the heat for thermally perturbing the thermionic device (214). In FIG. 2, the cathode (216) is placed in closer proximity to the electronics layer (228) than the anode (218), whereas in FIG. 1A the cathode (116) is placed in closer proximity to the heat source (160) and the anode (118) is placed in closer proximity to the electronics layer (128).

Thermal Energy Harvesting Thermionic Devices (114) and (214)

Embodiments of the thermal energy harvesting thermionic devices (114) and (214) are described in greater detail with reference to FIGS. 4-7.

Figure 4:
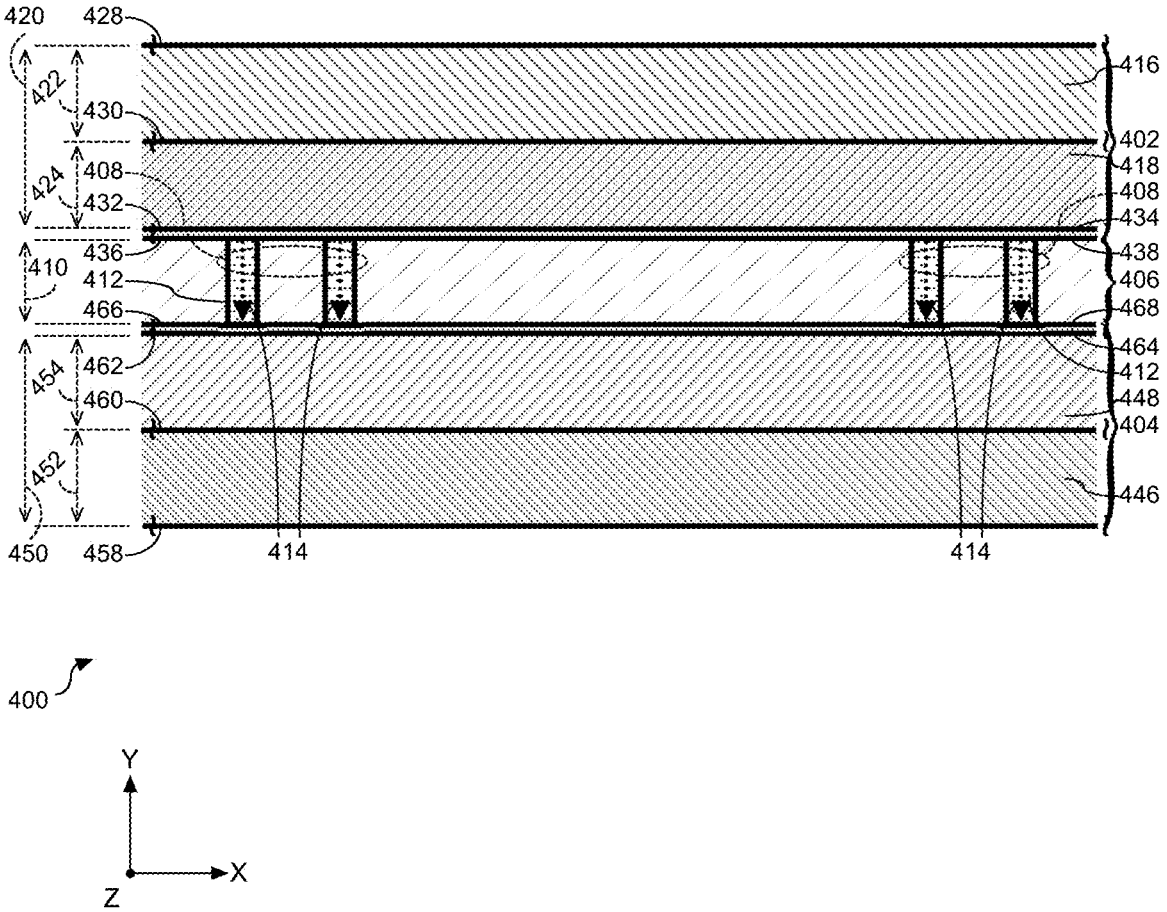
FIG. 4 depicts a sectional view of a thermal energy harvesting thermionic device according to an exemplary embodiment.

Referring to FIG. 4, a diagram is provided to illustrate a sectional view of an embodiment of a thermal energy harvesting thermionic device (400) that is configured to convert thermal energy (or heat) into electrical power, i.e., electricity, which is supplied via the electrical conductive path (130), (230), to the electronics layer (128), (228). In exemplary embodiments, the device (400) may be nano-scale and/or contain one or more nano-scale components. Each of the dimensions, including a thickness dimension defined parallel to a first-axis, also referred to herein as a vertical axis, i.e., Y-axis in FIG. 4, a longitudinal dimension parallel to a second-axis, i.e., X-axis in FIG. 4, also referred to herein as a horizontal axis, and a lateral dimension parallel to a third axis-axis, i.e. Z-axis in FIG. 4, orthogonal to the X-axis and Y-axis, are shown for reference. The X-axis, Y-axis, and Z-axis are orthogonal to each other in physical space.

The thermal energy harvesting thermionic device (400) is sometimes referred to herein as a cell. In exemplary embodiments, the thermal energy harvesting thermionic device (400) is illustrated as a sheet or a plurality of adjacently positioned sheets or layers, e.g., that may be stacked or wound. A plurality of devices (400) may be organized as a plurality of cells, or a plurality of layers, with the cells or layers arranged in series or parallel, or a combination of both to generate electrical output at the desired voltage, current, and power.

The thermal energy harvesting thermionic device (400) includes an emitter electrode (also referred to herein as the cathode) (402) and a collector electrode (also referred to herein as the anode) (404) positioned to define an inter-electrode gap (or interstitial space) therebetween. In an embodiment, a spacer (406) of separation material, sometimes referred to herein as a standoff or spacer, maintains separation between the electrodes (402) and (404). While the spacer (406) is referred to herein in the singular, it should be understood that the spacer (406) may comprise a plurality of elements. The spacer (406) may be a dielectric or insulator, or comprise one or more materials that collectively exhibit electrically non-conductive properties. The spacer (406) is illustrated in direct contact with the electrodes (402) and (404). The electrodes (402) and (404) and the spacer (406) define a plurality of closed apertures (408), also referred to herein as cavities, in the inter-electrode gap. The apertures (408) extend in the Y direction between the electrodes (402) and (404) for a distance (410) in a range, for example, of about 1 nanometer (nm) to about 100 nm, or in a range, for example, of about 1 nm to about 20 nm. A fluid (412), also referred to as a nano-fluid (discussed further herein with reference to FIG. 6), is received and maintained within one or more, and preferably each, of the apertures (408).

In alternative embodiments, no spacer (406) is used and only the nano-fluid (412) is positioned between the electrodes (402) and (404). Accordingly, the thermal energy harvesting thermionic device (400) includes two opposing electrodes (402) and (404), optionally separated by the spacer (406) with a plurality of apertures (408) extending between the electrodes (402) and (404) and configured to receive the nano-fluid (412).

The emitter electrode (402) and the collector electrode (404) each may be fabricated from different materials, with the different materials having separate and different work function values. The work function of a material or a combination of materials is the minimum thermodynamic work, i.e., minimum energy, needed to remove an electron from a solid to a point in a vacuum immediately outside a solid surface of the material. The work function is a material-dependent characteristic. Work function values are typically expressed in units of electron volts (eV). Accordingly, the work function of a material determines the minimum energy required for electrons to escape the surface, with lower work functions generally facilitating electron emission.

The difference in work function values between the electrodes (402) and (404) due to the different electrode materials influences the voltage that can be achieved. Thus, to generate high power, the difference in work function values between the electrodes (402) and (404) is large in an exemplary embodiment. In an embodiment, the work function value of the collector electrode (404) is smaller than the work function value of the emitter electrode (402). The different work function values induces a contact potential difference between the electrodes (402) and (404) that has to be overcome, e.g., by the application of heat to the emitter electrode (402), to transmit electrons through the nano-fluid (412) within the apertures (408) from the emitter electrode (402) to the collector electrode (404). In an exemplary embodiment, the total of the work function value of the collector electrode (404) and the contact potential difference is less than or equal to the work function of the emitter electrode (402). Maximum flow occurs when the total of the work function value of the collector electrode (404) and the contact potential equals the work function value of the emitter electrode (402).

Both electrodes (402) and (404) emit electrons; however, once the contact potential difference is overcome, the emitter electrode (402) will emit significantly more electrons than the collector electrode (404), which is influenced by an electric field that suppresses electron production from the collector electrode (404). A net flow of electrons is transferred from the emitter electrode (402) to the collector electrode (404), and a net electron current (414) flows from the emitter electrode (402) to the collector electrode (404) through the apertures (408). This net electron current (414) causes the emitter electrode (402) to become positively charged and the collector electrode (404) to become negatively charged. Accordingly, the thermal energy harvesting thermionic device (400) generates an electron flow (414) that is transmitted from the emitter electrode (402) to the collector electrode (404).

The emitter electrode (402) may be manufactured with a first backing (416), which may comprise, for example, a polyester film, e.g., Mylar®, and a first layer (418) extending beneath the first backing (416). The first layer (418) may be comprised, for example, graphene, platinum (Pt), or other suitable materials. In an embodiment, the emitter electrode (402) has an emitter electrode thickness measurement (420) extending in the Y direction that is, for example, approximately 0.25 millimeters (mm), such measurement being non-limiting, or in a range of, for example, about 2 nm to about 0.25 mm, such measurements being non-limiting. The first backing (416) is shown in FIG. 4 with a first backing thickness measurement (422), and the first layer (418) is shown herein with a first layer thickness measurement (424), each extending in the Y direction. In an embodiment, the first backing thickness measurement (422) and the first layer thickness measurement (424) are in a range of, for example, about 0.01 mm to about 0.125 mm, or, for example, 0.125 mm, such values being non-limiting. The first backing measurement (422) and the first layer measurement (424) may have the same or different measurement values.

In an exemplary embodiment, prior to assembly, the first layer (418) is sprayed onto the first backing (416) so as to embody the first layer (418) as a nanoparticle layer that is approximately 2 nm (i.e., the approximate diameter of a nanoparticle), where the 2 nm value should be considered non-limiting. In an embodiment, the thickness (424) of the first layer (418) may be in a range of, for example, about 1 nm to about 20 nm, or about 2 nm to about 20 nm. In another embodiment, the thickness (424) of the first layer (418) may be in a range of, for example, 0.01 mm to 0.125 mm. Generally, smaller thicknesses have higher energy densities and less wasted energy. The first backing (416) has a first outer surface (428). The first backing (416) and the first layer (or the nanoparticle layer) (418) define a first interface (430) therebetween. The first layer (or the nanoparticle layer) (418) defines a first surface (432) facing the inter-electrode gap. Alternative to spraying, the first layer (418) may be pre-formed and applied to the first backing layer (416), or vice versa, i.e., the first backing layer (416) applied to the first layer (418).

A first coating (434), such as cesium oxide ($Cs_2O$), at least partially covers the first surface (432) to form an emitter surface (436) of the first electrode (402) that directly interfaces with a first spacer surface (438). Accordingly, the emitter electrode (402) of the embodiment illustrated in FIG. 4 includes a first layer (or nanoparticle layer) (418) interposed between the first backing (416) and the first coating (434).

In FIG. 4, the collector electrode (404) includes a second backing (446), which may comprise, for example, a polyester film, and at least one second layer (448), which may comprise, for example, graphene or aluminum (Al), extending over the second backing (446). The collector electrode (404) has a collector electrode thickness measurement (450) extending in the Y direction that is, for example, approximately 0.25 millimeters (mm), such measurement being non-limiting, or in a range of, for example, about 2 nm to about 0.25 mm, such values being non-limiting. For example, in an embodiment, a second backing measurement (452) of the second backing (446) and a second layer measurement (454) of the second layer (448) are each approximately 0.125 mm, such values being non-limiting. In an embodiment, the second backing measurement (452) and the second layer measurement (454) may range from, for example, about 0.01 mm to about 0.125 mm, or each approximately 0.125 mm, such values being non-limiting. The second backing measurement (452) and the second layer measurement (454) may have the same or different measurement values.

In an embodiment, the second layer (448) is sprayed on to the second backing (446) to embody the second layer (448) as a second nanoparticle layer that is approximately 2 nm thick, where the 2 nm value should be considered non-limiting. The second layer measurement (454) of the second layer (448) may range from, for example, about 1 nm to about 20 nm, or about 2 nm to about 20 nm. In another embodiment, the second layer measurement (454) of the second layer (448) may be in a range of, for example, 0.01 mm to 0.125 mm. As discussed above in connection with the first layer (418), generally, smaller thicknesses have higher energy densities and less wasted energy. The second backing (446) has a second outer surface (458). The second backing (446) and the second layer/nanoparticle layer (448) define a second interface (460). The second layer (or the second nanoparticle layer) (448) defines a second surface (462) facing the inter-electrode gap. Alternatively to spraying, the second layer (448) may be pre-formed and applied to the second backing (446) or vice versa, i.e., the second backing (446) applied to the second layer (448).

A second coating (464), which may be comprised of cesium oxide ($Cs_2O$), at least partially covers the second surface (462) to form a collector surface (466) of the collector electrode (404) that directly interfaces with a second surface (468) of the spacer (406). Accordingly, the collector electrode (404) of FIG. 4 includes the second layer/nanoparticle layer (448) on the second backing (446) and the $Cs_2O$ coating (464) on the second surface (462).

In an exemplary embodiment, the first coating (434) and the second coating (464) are formed on the first and second surfaces (432) and (462), respectively. In an embodiment, an electrospray or a nano-fabrication technique is employed to form or apply the first and second coatings (434) and (464), respectively. The first and second coatings (434) and (464) can be applied in one or more predetermined patterns that may be the same as or different from one another.

In one or more exemplary embodiments, a percentage of surface area coverage of each of the first surface (432) and second surface (462) with the respective coating layers (434) and (464) (e.g., $Cs_2O$) is within a range of at least 50%, and up to 70%, and in at least one embodiment is about 60%. The $Cs_2O$ coatings (434) and (464) reduce the work function values of the electrodes (402) and (404) from the work function values of, for example, platinum (Pt), which is an embodiment is 5.65 electron volts (eV), and aluminum (Al), which in an embodiment is 4.28 eV. The emitter electrode (402) with the coating layer (434) of $Cs_2O$ has a work function value ranging from about 0.5 to about 2.0 eV, and in an embodiment is approximately 1.5 eV, and the collector electrode (404) with the coating layer (464) of $Cs_2O$ has a work function value of about 0.5 to about 2.0 eV, and in an embodiment is approximately 1.5 eV.

Various modifications may be made to the thermal energy harvesting thermionic device (400) discussed herein. For example, either or both of the first backing (416) and the second backing (446) may be eliminated, particularly where the first layer (418) and/or the second layer (448) have relatively large thicknesses.

In an embodiment, the electrodes (402) and (404) are comprised of graphene, and are referred to herein as graphene electrodes (402) and (404). The graphene electrodes (402) and (404) can exhibit work function values below 1.0 eV when coated with cesium oxide, gold, tungsten, and other elements and compounds. Sulfur may be incorporated into the coatings (434) and (464) to improve the bonding of the coatings (434) and (464) to the graphene electrodes (402) and (404), respectively, particularly where the first and second layers (418) and (448) of the electrodes (402) and (404) comprise graphene and the sulfur creates covalent bonding between the electrodes (402) and (404) and their respective coatings (434) and (464). The respective work function values of the electrodes (402) and (404) can be made to differ, even when both are comprised of graphene, for example by incorporating different coatings (434) and (464) into the electrodes (402) and (404). Suitable graphene electrodes are available through ACS (Advanced Chemical Suppliers) Materials, and include Trivial Transfer Graphene™ (TTG 10055).

In an embodiment, the surface area coverage on the emitter electrode (402) or the collector electrode (404) with $Cs_2O$ is spatially resolved, e.g., applied in a pattern or non-uniform across the length of the corresponding surface, and provides a reduction in a corresponding work function to a minimum value. In an exemplary embodiment, the work function value, from a maximum of about 2.0 eV is reduced approximately 60-80% corresponding to the surface coverage of the $Cs_2O$, e.g. cesium oxide. The lower work function values of the electrodes (402) and (404) improve operation of the thermal energy harvesting thermionic device (400) as described herein.

Platinum (Pt) coated on copper foil and aluminum (Al) materials optionally are selected for the first and second electrodes (402) and (404), respectively, due to at least some of their metallic properties, e.g., strength and resistance to corrosion, and the measured change in work function values when the thermionic emissive material of $Cs_2O$ or other materials disclosed herein is layered thereon. Alternative materials may be used, such as graphene, noble metals including, and without limitation, rhenium (Re), osmium (Os), ruthenium (Ru), iridium (Ir), rhodium (Rh), and palladium (Pd), or any combination of these metals. In addition, and without limitation, non-noble metals such as gold (Au), tungsten (W), tantalum (Ta), and molybdenum (Mo), and combinations thereof, may also be used. For example, and without limitation, tungsten (W) nanoparticles may be used rather than platinum (Pt) nanoparticles to form the first surface (432), and gold (Au) nanoparticles may be used rather than aluminum (Al) nanoparticles to form the second surface (462). Accordingly, the selection of the materials used to form the nanoparticle surfaces (432) and (462) can be principally based on the work functions of the electrodes (402) and (404), and more specifically, the difference in the work functions once the electrodes (402) and (404) are fully fabricated.

The selection of the first and second coatings (434) and (464), e.g., thermionic electron emissive material, on the first surface (432) and second surface (462), respectively, may be partially based on the desired work function value of the electrodes (402) and (404), respectively, and chemical compatibility between the deposited materials, and the deposited thermionic electron emissive materials of the first and second coatings (434) and (464), respectively. Deposition materials include, but are not limited to, thorium, aluminum, cerium, and scandium, as well as oxides of alkali or alkaline earth metals, such as cesium, barium, calcium, and strontium, as well as combinations thereof and combinations with other materials. In at least one embodiment, the thickness of the layer of patterned thermionic electron emissive material of the first and second coatings (434) and (464) is approximately 2 nm, where the 2 nm value should be considered non-limiting. Accordingly, the electrodes (402) and (404) have highly desirable work functions.

Figure 5A:
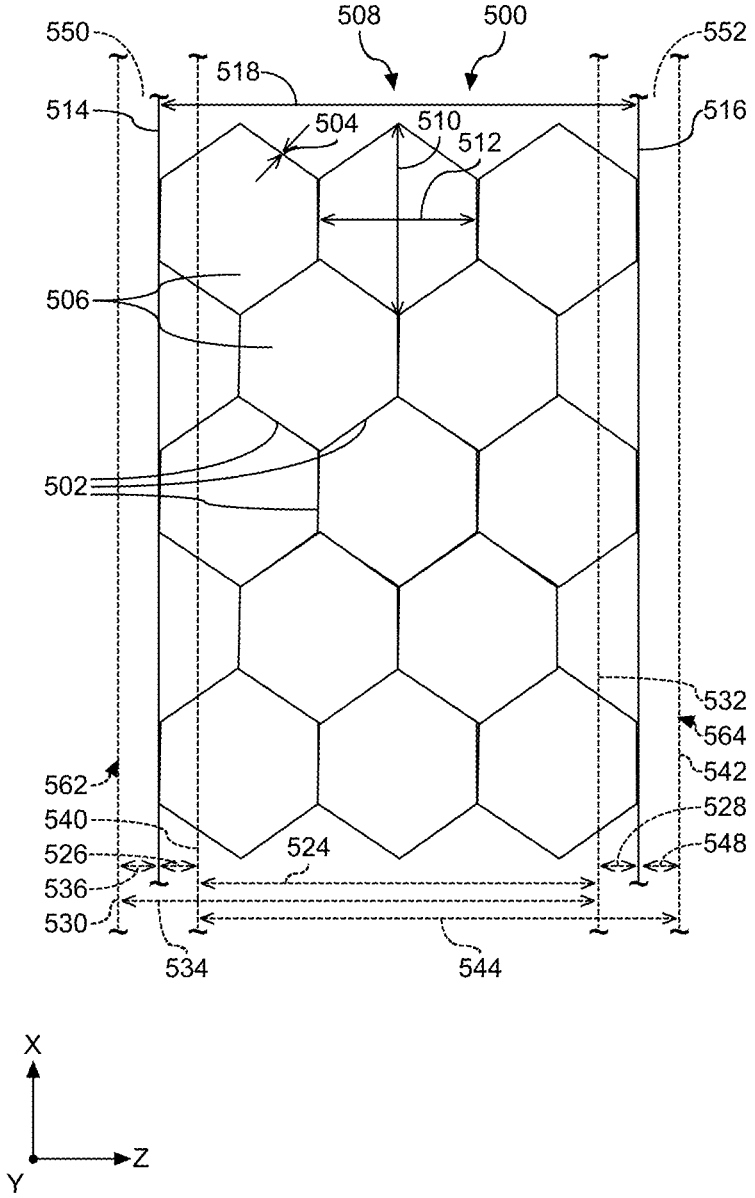
FIG. 5A depicts a partially transparent top view of an embodiment of a spacer and adjacent electrodes for use in a thermal energy harvesting thermionic device.

FIG. 5A depicts a top view of an embodiment of a spacer (500) in relationship to (between) the adjacent electrodes (562) and (564), for use in a thermal energy harvesting thermionic device, such as the device (400) having electrodes (402) and (404) as shown and described in reference to FIG. 4. The spacer (500) and the electrodes (562) and (564) are not shown to scale.

The spacer (500) includes a plurality of interconnected edges or walls (502). The edges (502) have a thickness or edge measurement (504) in the range of, for example, about 2.0 nm to about 0.25 mm. In the illustrated embodiment, the interconnected edges (502) collectively define a plurality of hexagonal apertures, also referred to herein as cavities (506), in a honeycomb array (508). The cavities (506) extend in a direction parallel to the Y-axis. The spacer (500) may be configured as a uniform or relatively uniform layer, e.g., contiguous and with or without limited apertures. The apertures or cavities, either uniformly or non-uniformly provided across the width and/or length of the spacer material, may be in a range of, for example, greater than 0 mm (e.g., 2 nm) to about 0.25 mm in the Y-axis direction, similar to an embodiment of the spacer (406) of FIG. 4.

Figure 5B:
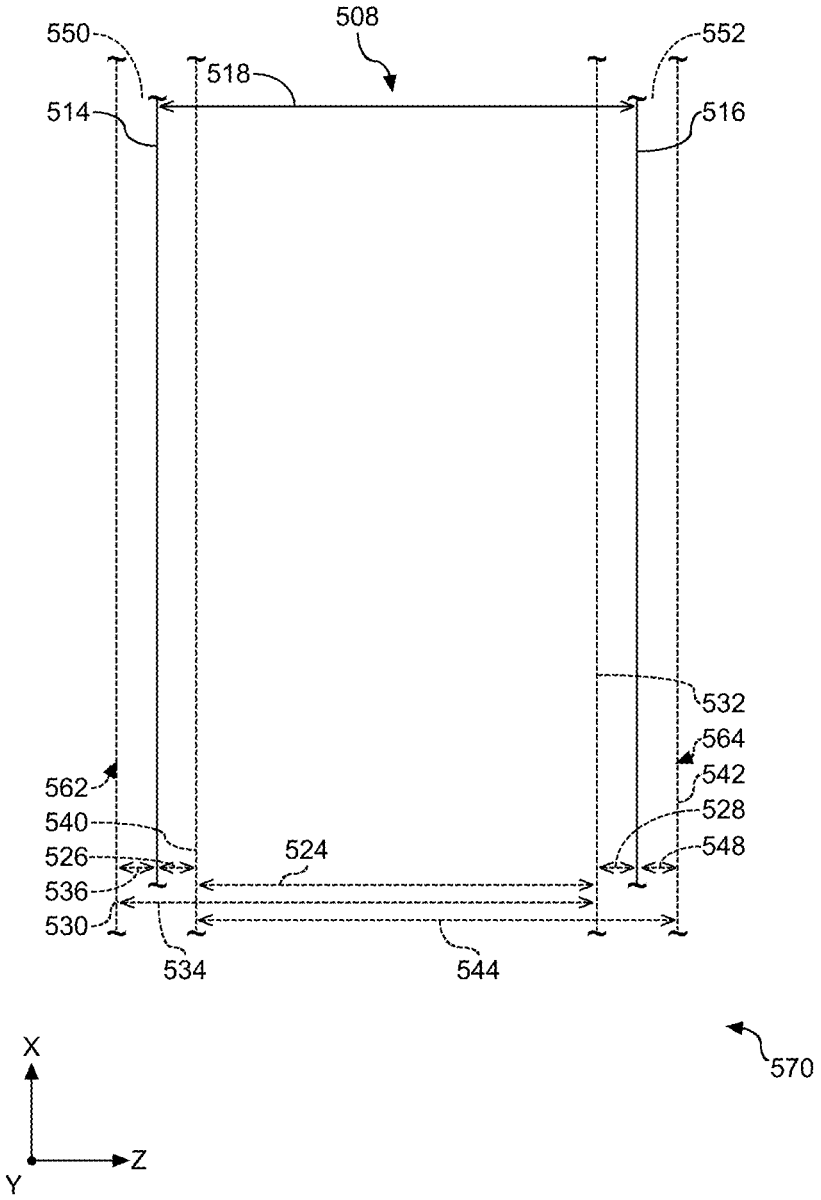
FIG. 5B depicts a partially transparent top view of another embodiment of a spacer and adjacent electrodes for use in a thermal energy harvesting thermionic device.

Referring to FIG. 5B, a top view of another embodiment of a spacer (570) between the adjacent electrodes (562) and (564), is shown for use in a thermal energy harvesting thermionic device, such as the device (400) with electrodes (402) and (404) as shown and described in FIG. 4. The embodiments shown and described in FIGS. 5A and 5B are provided with the same reference numerals, where appropriate, to designate identical or like parts. The spacer (570) may be comprised of a permeable or semi-permeable material, which in an embodiment may be adapted to receive or be coated or impregnated with the nano-fluid.

Referring to FIG. 5A, in an embodiment the apertures (506) have a first dimension (510) and a second dimension (512) each having a value in a range between, for example, 2.0 nm and 100 microns. In an embodiment, the edges (502), the apertures (506), and the array (508) form various shapes, configurations, and sizes, including the dimensions and sizing of the apertures (506), that enable operation of spacer (500) as described herein, including, without limitation, circular, rectangular, and elliptical apertures (506).

The spacers (500) and (570), shown in FIGS. 5A and 5B, respectively, include a first outer edge (514) and a second outer edge (516) that define the Z-dimensions of the spacer (500), (570). The spacer (500), (570) has a distance measurement (518) in the lateral dimension (Z) between the lateral side edges (514) and (516) in a range of, for example, about 1 nm to about 10 microns.

As shown in FIGS. 5A and 5B, the electrodes (562) and (564) are offset in the lateral dimension Z with respect to one another and with respect to the spacer (500), (570). Specifically, the emitter electrode (562) includes opposite first and second lateral side edges (530) and (532) separated by a first distance (534). The collector electrode (564) includes opposite third and fourth lateral side edges (540) and (542) separated by a second distance (544). The values of the first and second distances (534) and (544) may be the same or different from one another, and may be within a range of, for example, approximately 10 mm to approximately 2.0 m.

With respect to the first electrode (562), the first lateral side edge (530) extends in the lateral direction Z beyond the first lateral support side edge (514) of the spacer (500), (570) by a third distance (536), and the second lateral support side edge (516) of the spacer (500), (570) extends in the lateral direction Z beyond the second lateral side edge (532) by a fourth distance (528).

With respect to the second electrode (564), the first lateral support side edge (514) of the spacer (500), (570) extends in the lateral direction Z beyond the third lateral side edge (540) by a fifth distance (526), and the fourth lateral side edge (542) extends in the lateral direction Z beyond the second lateral support side edge (516) of the spacer (500), (570) by a sixth distance (548).

In embodiments, the third distance (536), the fourth distance (528), the fifth distance (526), and the sixth distance (548) may be the same or different from one another and within a range of, for example, approximately 1.1 nm to approximately 10 microns. The spacer (500), (570) may have a lateral measurement (518) with respect to the Z-axis greater than lateral measurements (534) and (544) of the electrodes (562) and (564), respectively. The spacer design and measurements shown and described herein reduce a potential for electrodes, such as the electrodes (402) and (404), to contact one another when the spacer (500), (570) is incorporated into the device (400) of FIG. 4. The direct contacting of the electrodes (402) and (404) would create a short circuit.

Each of the lateral support side edges (514) and (516) may receive at least one layer of an electrically insulating sealant that electrically isolates the portions (550) and (552) of the electrodes (562) and (564), respectively, that extend beyond the lateral support side edges (514) and (516), respectively. Further, as described above, each of the electrodes (562) and (564) may be offset from the spacer (500), (570) to reduce the potential for the electrodes (562) and (564) contacting each other and creating a short circuit.

In exemplary embodiments, the at least one spacer (500) and/or (570), which in exemplary embodiments are dielectric spacers, as shown and described in FIGS. 5A and 5B, respectively, are fabricated with a dielectric material, such as, and without limitation, silica (silicon dioxide), alumina (aluminum dioxide), titania (titanium dioxide), and boron-nitride. The apertures (506) extend between the electrodes (562) and (564) for the distance (410) (with reference to FIG. 4), e.g., in the Y-dimension, in a range of, for example, about 1 nanometer (nm) to about 10 microns. A fluid, e.g., the nano-fluid (412) of FIG. 4, is received and maintained within each of the apertures (506). The dielectric spacer (500), (570) is positioned between, and in direct contact with, the electrodes (562) and (564).

Figure 6:
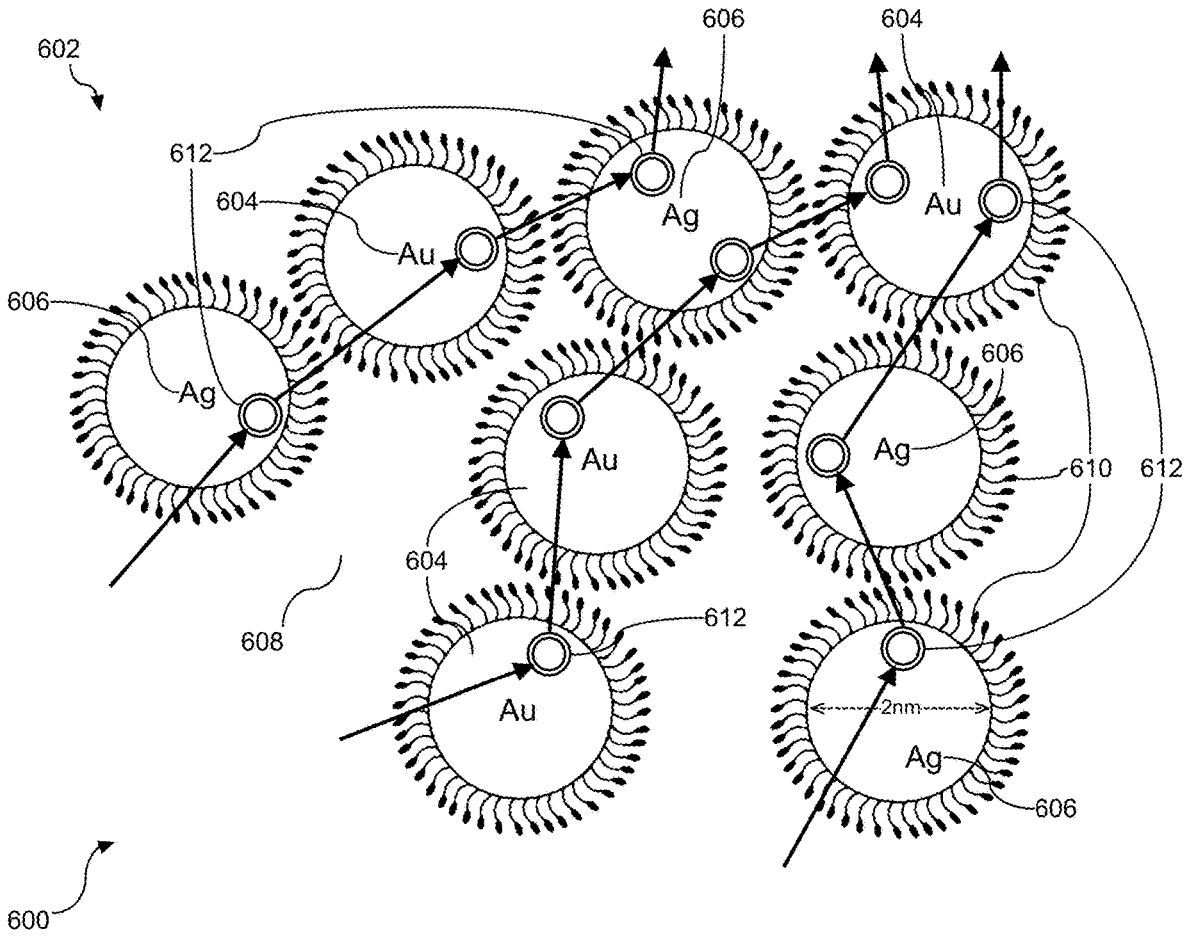
FIG. 6 depicts a schematic view of an embodiment of a nano-fluid of a thermal energy harvesting thermionic device, the nano-fluid including a plurality of nanoparticle clusters suspended in a dielectric medium.

Referring to FIG. 6, a diagram (600) is provided to illustrate a schematic view of an embodiment of a fluid or medium (602), also referred to herein as a nano-fluid. As shown, the nano-fluid (602) includes a plurality of gold (Au) nanoparticle clusters (604) and a plurality of silver (Ag) nanoparticle clusters (606) suspended in a dielectric medium (608). In FIG. 6, each cluster (606) and (608) is embodied as a single nanoparticle, in particular a single Au nanoparticle or a single Ag nanoparticle, with a dielectric coating (discussed below). In some embodiments, and without limitation, the dielectric medium (608) is an alcohol, a ketone (e.g., acetone), an ether, a glycol, an olefin, and/or an alkane (e.g., those alkanes with greater than three carbon atoms, e.g., tetradecane). In an embodiment, the dielectric medium (608) is water or silicone oil. Alternatively, the dielectric medium (608) is a sol-gel with aerogel-like properties and low thermal conductivity values that reduce heat transfer therethrough, e.g., thermal conductivity values as low as 0.013 watts per meter-degrees Kelvin (W/m·K) as compared to the thermal conductivity of water at 20 degrees Celsius (° C.) of 0.6 W/m·K. Appropriate materials are selected to fabricate the nanoparticle clusters (604) and (606). The materials selected for the nanoparticle clusters (604) and (606) may have work function values that are greater than the work function values for associated electrodes, such as the electrodes (402) and (404) of FIG. 4. For example, the work function values of the Au nanoparticle clusters (604) and the Ag nanoparticle clusters (606) are about 4.1 eV and 3.8 eV, respectively.

At least one layer of a dielectric coating (610), such as a monolayer of alkanethiol material, is deposited on the Au nanoparticle clusters (604) and the Ag nanoparticle clusters (606) to form a dielectric barrier thereon. In an exemplary embodiment, the deposit of the dielectric coating (610) is performed via electrospray. The alkanethiol material of the dielectric coating (610) includes, but is not limited to, dodecanethiol and/or decanethiol. Additionally or alternatively, the dielectric coating (610) may be a halogenoalkane or alkyl halide, in which one or more of the hydrogen atoms of the alkane are replaced by halogen atom(s), i.e., fluorine, chlorine, bromine, or iodine. The deposit of the dielectric coating (610), such as alkanethiol, reduces coalescence of the nanoparticle clusters (604) and (606). In at least one embodiment, the nanoparticle clusters (604) and (606) have a diameter in the range of about 1 nm to about 3 nm. In an exemplary embodiment, the nanoparticle clusters (604) and (606) have a diameter of about 2 nm. In an exemplary embodiment, the Au nanoparticle clusters (604) and the Ag nanoparticle clusters (606) are tailored to be electrically conductive with charge storage features (i.e., capacitive features), minimize heat transfer through associate spacer apertures, such as the spacer apertures (506) of FIG. 5A, with low thermal conductivity values, minimize ohmic heating, eliminate space charges in the spacer apertures (506), and prevent arcing. The plurality of Au nanoparticle clusters (604) and the Ag nanoparticle clusters (606) are suspended in the dielectric medium (608). Accordingly, the nano-fluid (602), including the suspended nanoparticle clusters (604) and (606), provides a conductive pathway for electrons to travel across the spacer apertures (408) of FIG. 4 and/or (506) of FIGS. 5A and 5B from, for example with reference to FIG. 4, the emitter electrode (402) to the collector electrode (404) through charge transfer. Accordingly, in at least one embodiment, a plurality of the Au nanoparticle clusters (604) and the Ag nanoparticle clusters (606) are mixed together in the dielectric medium (608) to form the nano-fluid (602), the nano-fluid (602) residing in the apertures (408) of FIG. 4 and/or the apertures (506) of FIG. 5A or the inter-electrode gap of FIG. 5B.

The Au nanoparticle clusters (604) according to exemplary embodiments are dodecanethiol functionalized gold nanoparticles. In exemplary embodiments, the AU nanoparticle clusters (604) have an average particle size of about 1 nm to about 3 nm, at about 2% (weight/volume (grams/ml)). According to exemplary embodiments, the Ag nanoparticle clusters (606) are dodecanethiol functionalized silver nanoparticles. In certain embodiments, the Ag nanoparticle clusters (606) have an average particle size of about 1 nm to about 3 nm, at about 0.25% (weight/volume percent). In an embodiment, the average particle size of both the Au and Ag nanoparticle clusters (604) and (606) is at or about 2 nm. The Au and Ag cores of the nanoparticle clusters (604) and (606) are selected for their abilities to store and transfer electrons. In an embodiment, a 50%-50% mixture of Au and Ag nanoparticle clusters (604) and (606) are used. However, a mixture in the range of 1-99% Au-to-Ag could be used as well. Electron transfers are more likely to occur between nanoparticle clusters (604) and (606) with different work functions. In an exemplary embodiment, a mixture of nearly equal (molar) numbers of two different nanoparticle clusters (604) and (606), e.g., Au and Ag, provides good electron transfer. Accordingly, nanoparticle clusters are selected based on particle size, particle material (with the associated work function values), mixture ratio, and electron affinity.

Conductivity of the nano-fluid (602) can be increased by increasing concentration of the nanoparticle clusters (604) and (606). The nanoparticle clusters (604) and (606) may have a concentration within the nano-fluid (602) of, for example, about 0.1 mole/liter to about 2 moles/liter. In at least one embodiment, the Au and Ag nanoparticle clusters (604) and (606) each have a concentration of at least 1 mole/liter. In at least one embodiment, a plurality of Au and Ag nanoparticle clusters (604) and (606) are mixed together in a dielectric medium (608) to form a nano-fluid (602), the nano-fluid (602) residing in, for example, the apertures (408) of FIG. 4, the apertures (506) of FIG. 5A, and/or the inter-electrode gap of FIG. 5B.

The stability and reactivity of colloidal particles, such as Au and Ag nanoparticle clusters (604) and (606), are determined largely by a ligand shell formed by the alkanethiol coating (610) adsorbed or covalently bound to the surface of the nanoparticle clusters (604) and (606). The nanoparticle clusters (604) and (606) tend to aggregate and precipitate, which can be prevented by the presence of a ligand shell of the non-aggregating polymer alkanethiol coating (610) enabling these nanoparticle clusters (604) and (606) to remain suspended. Adsorbed or covalently attached ligands can act as stabilizers against agglomeration and can be used to impart chemical functionality to the nanoparticle clusters (604) and (606). Over time, the surfactant nature of the ligand coatings is overcome and the lower energy state of agglomerated nanoparticle clusters is formed. Over time, agglomeration may occur due to the lower energy condition of nanoparticle cluster accumulation and occasional addition of a surfactant may be used. Examples of surfactants include, without limitation, Tween® 20 and Tween® 21.

In the case of the nano-fluid (602) of FIG. 6 substituted for the nano-fluid (412) of FIG. 4, electron transfer through collisions of the plurality of nanoparticle clusters (604) and (606) is illustrated. The work function values of the nanoparticle clusters (604) and (606) are much greater than the work function values of the emitter electrode (402) (e.g., about 0.5 eV to about 2.0 eV) and the collector electrode (404) (e.g., about 0.5 eV to about 2.0 eV). The nanoparticle clusters (604) and (606) are tailored to be electrically conductive with capacitive (i.e., charge storage) features while minimizing heat transfer therethrough. Accordingly, the suspended nanoparticle clusters (604) and (606) provide a conductive pathway for electrons to travel across the apertures (408) from the emitter electrode (402) to the collector electrode (404) through charge transfer.

Thermally-induced Brownian motion causes the nanoparticle clusters (604) and (606) to move within the dielectric medium (608), and during this movement the nanoparticle clusters (604) and (606) occasionally collide with each other and with the electrodes (402) and (404). As the nanoparticle clusters (604) and (606) move and collide within the dielectric medium (608), the nanoparticle clusters (604) and (606) chemically and physically transfers charge. The nanoparticle clusters (604) and (606) transfer charge chemically when electrons (612) hop between electrodes, e.g., from and to the electrodes (402) and (404) of FIG. 4, to the nanoparticle clusters (604) and (606) and from one nanoparticle cluster (604) and (606) to another nanoparticle cluster. The hops primarily occur during collisions. Due to the electric field affecting the collector electrode (404), electrons (612) are more likely to move from the emitter electrode (402) to the collector electrode (404) via the nanoparticle clusters (604) and (606) rather than in the reverse direction. Accordingly, a net electron current from the emitter electrode (402) to the collector electrode (404) via the nanoparticle clusters (604) and (606) is the primary and dominant current of the thermal energy harvesting thermionic device (400).

The nanoparticle clusters (604) and (606) transfer charge physically (i.e., undergo transient charging) due to the ionization of the nanoparticle clusters (604) and (606) upon receipt of an electron, and the electric field generated by the differently charged electrodes (402) and (404). The nanoparticle clusters (604) and (606) become ionized in collisions when they gain or lose an electron (612). Positive and negative charged nanoparticle clusters (604) and (606) in the nano-fluid (602) migrate to the negatively charged collector electrode (404) and the positively charged emitter electrode (402), respectively, providing an electrical current flow. This ion current flow is in the opposite direction from the electron current flow, but less in magnitude than the electron flow.

Some ion recombination in the nano-fluid (602) may occur, which diminishes both the electron and ion current flow. Electrode separation may be selected at an optimum width (or thickness in the Y direction in FIG. 4) to maximize ion formation and minimize ion recombination. In an exemplary embodiment, the electrode separation (410) is less than about 10 nm to support maximization of ion formation and minimization of ion recombination. In an embodiment, the nanoparticle clusters (604) and (606) have a maximum dimension of, for example, about 2 nm. The electrode separation distance (410) as defined by the spacer (406) (or the spacer (500) or (570) of FIGS. 5A and 5B, respectively) has an upper limit of, for example, about 1000 nm, preferably about 100 nm, and more preferably about 20 nm, and the electrode separation distance (410) of 20 nm is equivalent to approximately 10 nanoparticle clusters (604) and (606). Therefore, the electrode separation distance (410) of about 20 nm provides sufficient space within the apertures (408) for nanoparticle clusters (604) and (606) to move around and collide, while minimizing ion recombination. For example, in an embodiment, an electron can hop from the emitter electrode (402) to a first set of nanoparticle clusters (604) and (606) and then to a second, third, fourth, or fifth set of nanoparticle clusters (604) and (606) before hopping to the collector electrode (404). A reduced quantity of hops mitigates ion recombination opportunities. Accordingly, ion recombination in the nano-fluid (602) is minimized through an electrode separation distance (410) selected at an optimum width to maximize ion formation and minimize ion recombination.

In an exemplary embodiment, when the emitter electrode (402) and the collector electrode (404) are initially brought into close proximity, the electrons of the collector electrode (404) have a higher Fermi level than the electrons of the emitter electrode (402) due to the lower work function of the collector electrode (404). The difference in Fermi levels drives a net electron current that transfers electrons from the collector electrode (404) to the emitter electrode (402) until the Fermi levels are equal, i.e., the electrochemical potentials are balanced and thermodynamic equilibrium is achieved. The transfer of electrons between the emitter electrode (402) and the collector electrode (404) results in a difference in charge between the emitter electrode (402) and the collector electrode (404). This charge difference sets up the voltage of the contact potential difference and an electric field between the emitter electrode (402) and the collector electrode (404), where the polarity of the contact potential difference is determined by the material having the greatest work function. With the Fermi levels equalized, no net current will flow between the emitter electrode (402) and the collector electrode (404). Accordingly, electrically coupling the emitter electrode (402) and the collector electrode (404) with no external load results in attaining the contact potential difference between the electrodes (402) and (404) and no net current flow between the electrodes (402) and (404) due to attainment of thermodynamic equilibrium between the two electrodes (402) and (404).

The thermal energy harvesting thermionic device (400) can generate electric power (e.g., at room temperature) with or without additional heat input. Heat added to the emitter electrode (402) will raise the temperature of the emitter electrode (402) and the Fermi level of the emitter electrode (402) electrons. With the Fermi level of the emitter electrode (402) higher than the Fermi level of the collector electrode (404), a net electron current will flow from the emitter electrode (402) to the collector electrode (404) through the nano-fluid (412), (602). If the device (400) is placed into an external circuit, such that the external circuit is connected to the electrodes (402) and (404), the same amount of electron current will flow through the external circuit from the collector electrode (404) to the emitter electrode (402). Heat energy added to the emitter electrode (402) is carried by the electrons (612) to the collector electrode (402). The bulk of the added energy is transferred to the external circuit for conversion to useful work, some of the added energy is transferred through collisions of the nanoparticle clusters (604) and (606) with the collector electrode (404), and some of the added energy is lost to ambient as waste energy. As the energy input to the emitter electrode (402) increases, the temperature of the emitter electrode (402) increases, and the electron transmission from the emitter electrode (402) increases, thereby generating more electron current. As the emitter electrode (402) releases electrons onto the nanoparticle clusters (604) and (606), energy is stored in the thermal energy harvesting thermionic device (400). Accordingly, the thermal energy harvesting thermionic device (400) generates, stores, and transfers charge and moves heat energy associated with a temperature difference, where added thermal energy causes the production of electrons to increase from the emitter electrode (402) into the nano-fluid (412), (602).

The nano-fluid (602) can be substituted into the device (400) of FIG. 4 and used to transfer charges from the emitter electrode (402) to one of the mobile nanoparticle clusters (604) and (606) via intermediate contact potential differences from the collisions of the nanoparticle cluster (604) and (606) with the emitter electrode (402) induced by Brownian motion of the nanoparticle clusters (604) and (606). Selection of dissimilar nanoparticle clusters (604) and (606) that include Au nanoparticle clusters (604) and Ag nanoparticle clusters (606), which have greater work functions of about 4.1 eV and about 3.8 eV, respectively, than the work functions of the electrodes (402) and (404), improves transfer of electrons to the nanoparticle clusters (604) and (606) from the emitter electrode (402) to the collector electrode (404). This relationship of the work function values of the Au and Ag nanoparticle clusters (604) and (606) improves the transfer of electrons to the nanoparticle clusters (604) and (606) through Brownian motion and electron hopping. Accordingly, the selection of materials within the thermal energy harvesting thermionic device (400) improves electric current generation and transfer therein through enhancing the release of electrons from the emitter electrode (402) and the conduction of the released electrons across the nano-fluid (412), (602) to the collector electrode (404).

As the electrons (612) hop from nanoparticle cluster (604) and (606) to nanoparticle cluster (604) and (606), single electron charging effects that include the additional work required to hop an electron (612) onto a nanoparticle cluster (604) and (606) if an electron (612) is already present on the nanoparticle cluster (604) and (606), determine if hopping additional electrons (612) onto that particular nanoparticle cluster (604) and (606) is possible. Specifically, the nanoparticle clusters (604) and (606) include a voltage feedback mechanism that prevents the hopping of more than a predetermined number of electrons to the nanoparticle cluster (604) and (606). This prevents more than the allowed number of electrons (612) from residing on the nanoparticle cluster (604) and (606) simultaneously. In an embodiment, only one electron (612) is permitted on any nanoparticle cluster (604) and (606) at any one time. Therefore, during conduction of current through the nano-fluid (602), a single electron (612) hops onto the nanoparticle cluster (604) and (606). The electron (612) does not remain on the nanoparticle cluster (604) and (606) indefinitely, but hops off to either the next nanoparticle cluster (604) and (606) or the collector electrode (404) through collisions resulting from the Brownian motion of the nanoparticle clusters (604) and (606). However, the electron (612) does remain on the nanoparticle cluster (604) and (606) long enough to provide the voltage feedback required to prevent additional electrons (612) from hopping simultaneously onto the nanoparticle clusters (604) and (606). The hopping of electrons (612) across the nanoparticle clusters (604) and (606) avoids resistive heating associated with current flow in a media. Notably, the thermal energy harvesting thermionic device (400) containing the nano-fluid (602) does not require pre-charging by an external power source in order to introduce electrostatic forces. This is due to the device (400) being self-charged with triboelectric charges generated upon contact between the nanoparticle clusters (604) and (606) due to Brownian motion. Accordingly, the electron hopping across the nano-fluid (602) is limited to one electron (612) at a time residing on a nanoparticle cluster (604) and (606).

As the electron current starts to flow through the nano-fluid (602), a substantial energy flux away from the emitter electrode (402) is made possible by the net energy exchange between emitted and replacement electrons (612). The replacement electrons from an electrical conductor connected to the emitter electrode (402) do not arrive with a value of energy equivalent to an average value of the Fermi energy associated with the material of emitter electrode (402), but with an energy that is lower than the average value of the Fermi energy. Therefore, rather than the replacement energy of the replacement electrons being equal to the chemical potential of the emitter electrode (402), the electron replacement process takes place in the available energy states below the Fermi energy in the emitter electrode (402). The process through which electrons are emitted above the Fermi level and are replaced with electrons below the Fermi energy is sometimes referred to as an inverse Nottingham effect. Accordingly, a low work function value of, for example, about 0.5 eV for the emitter electrode (402) allows for the replacement of the emitted electrons with electrons with a lower energy level to induce a cooling effect on the emitter electrode (402).

As described this far, the principal electron transfer mechanism for operation of the device (400) is thermionic energy conversion or harvesting. In some embodiments, thermoelectric energy conversion is conducted in parallel with the thermionic energy conversion. For example and referring to FIG. 6, an electron (612) colliding with a nanoparticle cluster (604) and (606) with a first energy may induce the emission of two electrons at second and third energy levels, respectively, where the first energy level is greater than the sum of the second and third energy levels. In such circumstances, the energy levels of the emitted electrons are not as important as the number of electrons.

A plurality of thermal energy harvesting thermionic devices (400) is distinguished by at least one embodiment having the thermoelectric energy conversion features described herein. The nano-fluid (412), (602) is selected for operation of the thermal energy harvesting thermionic devices (400) within one or more temperature ranges. In an embodiment, the temperature range of the associated thermal energy harvesting thermionic device (400) is controlled to modulate a power output of the device (400). In general, as the temperature of the emitter electrode (402) increases, the rate of thermionic emission therefrom increases. The operational temperature ranges for the nano-fluid (602) are based on the desired output of the thermal energy harvesting thermionic device (400), the temperature ranges that optimize thermionic conversion, the temperature ranges that optimize thermoelectric conversion, and fluid characteristics. Therefore, different embodiments of the nano-fluid (602) are designed for different energy outputs of the device (400).

For example, in an embodiment, the temperature of the nano-fluid (412), (602) is maintained at less than 250° C. to avoid deleterious changes in energy conversion due to the viscosity changes of the dielectric medium (608) above 250° C. In an embodiment, the temperature range of the nano-fluid (602) for substantially thermionic emission is only approximately room temperature (i.e., about 20° C. to about 25° C.) up to about 70-80° C., and the temperature range of the nano-fluid (602) for thermionic and thermo-electric conversion is above 70-80° C., with the principal limitations being the temperature limitations of the materials. In an exemplary embodiment, the nano-fluid (602) for operation including thermoelectric conversion includes a temperature range that optimizes the thermoelectric conversion through optimizing the power density within the thermal energy harvesting thermionic device (400), thereby optimizing the power output of the device (400). In at least one embodiment, a mechanism for regulating the temperature of the nano-fluid (602) includes diverting some of the energy output, e.g., heat, of the device (400) into the nano-fluid (602). Accordingly, the apertures (408) of specific embodiments of the thermal energy harvesting thermionic device (400) may be filled with the nano-fluid (602) to employ thermoelectric energy conversion with thermionic energy conversion above a particular temperature range, or thermionic energy conversion by itself below that temperature range.

As described herein, in at least one embodiment, the dielectric medium (608) has thermal conductivity values less than about 1.0 watt per meter-Kelvin (W/m·K). In at least one embodiment, the thermal conductivity of the dielectric medium (608) is about 0.013 watt per meter-Kelvin (W/m·K), as compared to the thermal conductivity of water at about 20 degrees Celsius (° C.) of about 0.6 W/m·K. Accordingly, the nano-fluid (602) minimizes heat transfer, such as through the apertures (408) of FIG. 4, with low thermal conductivity values. Since the heat transport in a low thermal conductivity nano-fluid (602) can be small, a high temperature difference between the two electrodes, e.g., the electrodes (402) and (404), can be maintained during operation. These embodiments are designed for thermal energy harvesting thermionic devices that employ thermionic emission where minimal heat transfer through the nano-fluid (412), (602) is desired.

As shown in FIG. 4, the thermal energy harvesting thermionic device (400) has an aperture (408) with a distance (410) between electrodes (402) and (404) that is within a range of, for example, about 1 nm to about 20 nm. In a portion of range of the electrode separation distance (410) of about 1 nm to about less than 10 nm, thermal conductivity values and electrical conductivity values of the nano-fluid (412), (602) are enhanced beyond those conductivity values attained when the predetermined distance of the cavity (408) is greater than about 100 nm. This enhancement of thermal and electrical conductivity values of the nano-fluid (412), (602) associated with the distance (410) of about 1 nm to 10 nm as compared to a distance (410) greater than 100 nm is due to a plurality of factors.

Examples of a first factor include, but are not limited to, enhanced phonon and electron transfer between the plurality of nanoparticle clusters (604) and (606) within the nano-fluid (602), enhanced phonon and electron transfer between the plurality of nanoparticle clusters (604) and (606) and the first electrode (402), and enhanced phonon and electron transfer between the plurality of nanoparticle clusters (604) and (606) and the second electrode (404).

A second factor is an enhanced influence of Brownian motion of the nanoparticle clusters (604) and (606) in a confining environment between the electrodes (402) and (404) to, e.g., less than about 10 nm inter-electrode distance (410). As the distance (410) between the electrodes (402) and (404) decreases below about 10 nm, fluid continuum characteristics of the nano-fluid (412), (602) with the suspended nanoparticle clusters (604) and (606) is altered. For example, as the ratio of particle size to volume of the apertures (408) increases, random and convection-like effects of Brownian motion in a dilute solution dominate. Therefore, collisions of the nanoparticle clusters (604) and (606) with the surfaces of other nanoparticle clusters (604) and (606) and the electrodes (402) and (404) increase thermal and electrical conductivity values due to the enhanced phonon and electron transfer.

A third factor is the at least partial formation of matrices of the nanoparticle clusters (604) and (606) within the nano-fluid (602). Under certain conditions, the nanoparticle clusters (604) and (606) will form matrices within the nano-fluid (602) as a function of close proximity to each other with some of the nanoparticle clusters (608) remaining independent from the matrices. In an embodiment, the formation of the matrices is based on the factors of time and/or concentration of the nanoparticle clusters (604) and (606) in the nano-fluid (602).

A fourth factor is the predetermined nanoparticle clusters (604) and (606) density, which in an embodiment is about one mole per liter. Accordingly, apertures (408) containing the nano-fluid (602) with a distance (410) of about 1 nm to less than about 10 nm causes an increase in the thermal and electrical conductivity values of the nano-fluid (602) therein.

In addition, the nanoparticle clusters (604) and (606) have a small characteristic length, e.g., about 2 nm, and the clusters (604) and (606) are often considered to have only one dimension. This characteristic length restricts electrons in a process called quantum confinement, which increases electrical conductivity. The collision of particles with different quantum confinement facilitates transfer of charge to the electrodes (402) and (404). The thermal energy harvesting thermionic device (400) has an enhanced electrical conductivity value greater than about 1 Siemens per meter (S/m) as compared to the electrical conductivity of drinking water of about 0.005 S/m to about 0.05 S/m. Also, the embodiments of the device (400) with the enhanced thermal conductivity have a thermal conductivity value greater than about 1 W/m·K as compared to the thermal conductivity of water at 20 degrees Celsius (° C.) of about 0.6 W/m·K.

Thermionic emission of electrons (612) from the emitter electrode (402) and the transfer of the electrons (612) across the nano-fluid (602) from one nanoparticle cluster (604) and (606) to another nanoparticle cluster (604) and (606) through hopping are both quantum mechanical effects.

Release of electrons from the emitter electrode (402) through thermionic emission as described herein is an energy selective mechanism. A thermionic barrier in the apertures (408) between the emitter electrode (402) and the collector electrode (404) is induced through the interaction of the nanoparticles (604) and (606) inside the apertures (408) with the electrodes (402) and (404). The thermionic barrier is at least partially induced through the number and material composition of the plurality of nanoparticle clusters (604) and (606). The thermionic barrier induced through the nano-fluid (602) provides an energy selective barrier on the order of magnitude of about 1 eV. Accordingly, the nano-fluid (602) provides an energy selective barrier to electron emission and transmission.

To overcome the thermionic barrier and allow electrons (612) to be emitted from the emitter electrode (402) above the energy level needed to overcome the barrier, materials for the emitter electrode (402) and the collector electrode (404) are selected for their work function values and Fermi level values. The Fermi levels of the two electrodes (402) and (404) and the nanoparticle clusters (604) and (606) will try to align by tunneling electrons (612) from the electrodes (402) and (404) to the nanoparticle clusters (604) and (606). The difference in potential between the two electrodes (402) and (404) (described elsewhere herein) overcomes the thermionic barrier, and the thermionic emission of electrons (612) from the emitter electrode (402) occurs with sufficient energy to overcome the thermionic block. Notably, and in general, for cooling purposes, removing higher energy electrons from the emitter electrode (402) causes the emission of electrons (612) to carry away more heat energy from the emitter electrode (402) than is realized with lower energy electrons. Accordingly, the energy selective barrier is overcome through the thermionic emission of electrons at a higher energy level than would be otherwise occurring without the thermionic barrier.

Once the electrons (612) have been emitted from the emitter electrode (402) through thermionic emission, the thermionic barrier continues to present an obstacle to further transmission of the electrons (612) through the nano-fluid (602). Smaller inter-electrode gaps on the order of about 1 nm to about 10 nm, as compared to those gaps in excess of 100 nm, facilitate electron hopping, i.e., field emission, of short distances across the apertures (408). Energy requirements for electron hopping are much lower than the energy requirements for thermionic emission; therefore, the electron hopping has a significant effect on the energy generation characteristics of the device (400). The design of the nano-fluid (602) enables energy selective tunneling, e.g., electron hopping, that is a result of the barrier (which has wider gap for low energy electrons) which results in electrons above the Fermi level being a principal hopping component. In an exemplary embodiment, direction of the electron hopping is determined through the selection of the different materials for the electrodes (402) and (404) and their associated work function and Fermi level values. The electron hopping across the nano-fluid (602) transfers heat energy with electrons (612) across the apertures (408) while maintaining a predetermined temperature gradient such that the temperature of the nano-fluid (602) is relatively unchanged during the electron transfer. Accordingly, the emitted electrons transport heat energy from the emitter electrode (402) across the apertures (408) to the collector electrode (404) without increasing the temperature of the nano-fluid (602).

In an embodiment, the thermal energy harvesting thermionic device (400) is configurable with respect to the physical dimensions therein. In an exemplary embodiment, the device (400) has a length measurement, in a direction along the X-axis in FIG. 4, of approximately 6 inches, although other lengths are contemplated, and a width measurement, in a direction along the Z axis in FIG. 4, of approximately 6 inches, although other widths are contemplated. A thickness of the thermal energy harvesting thermionic device is approximately 0.005 mm to about 2.0 mm, for example about 1.0 mm. In an exemplary embodiment such measurements should not be considered limiting. For example, in an exemplary embodiment, the physical dimensions may be expanded or reduced to accommodate operational aspects of the device.

FIG. 7 is a cross-sectional view of a thermal energy harvesting thermionic device, generally designated by reference numeral (700), according to an exemplary embodiment. The thermal energy harvesting thermionic device (700) of FIG. 7 comprises a plurality of thermionic harvester units ($\mathbf{701}_A$), ($\mathbf{701}_B$), and ($\mathbf{701}_C$) layered/stacked on one another. The harvester units ($\mathbf{701}_A$), ($\mathbf{701}_B$), and ($\mathbf{701}_C$) are serially connected to one another and separated from one another by insulating layers.

The first (top) harvester unit ($\mathbf{701}_A$) includes an emitter electrode (cathode) ($\mathbf{702}_A$) having a coating ($\mathbf{734}_A$), a collector electrode (anode) ($\mathbf{704}_A$) having a coating ($\mathbf{764}_A$), and a chamber (or aperture) interposed between the electrodes ($\mathbf{702}_A$) and ($\mathbf{704}_A$) filled with nano-fluid ($\mathbf{708}_A$) and surrounded on opposite sides by insulating spacers ($\mathbf{706}_{A,1}$) and ($\mathbf{706}_{A,2}$). The second (middle) harvester unit ($\mathbf{701}_B$) includes an emitter electrode (cathode) ($\mathbf{702}_B$) having a coating ($\mathbf{734}_B$), a collector electrode (anode) ($\mathbf{704}_B$) having a coating ($\mathbf{764}_B$), and a chamber (or aperture) between the electrodes ($\mathbf{702}_B$) and ($\mathbf{704}_B$) filled with nano-fluid ($\mathbf{708}_B$) and surrounded on opposite sides by insulating spacers ($\mathbf{706}_{B,1}$) and ($\mathbf{706}_{B,2}$). The third (bottom) harvester unit ($\mathbf{701}_C$) includes an emitter electrode (cathode) ($\mathbf{702}_C$) having a coating ($\mathbf{734}_C$), a collector electrode (anode) ($\mathbf{704}_C$) having a coating (764C), and a chamber (or aperture) between the electrodes (702C) and ($\mathbf{704}_C$) filled with nano-fluid ($\mathbf{708}_C$) and surrounded on opposite sides by insulating spacers ($\mathbf{706}_{C,1}$) and ($\mathbf{706}_{C,2}$).

A first insulating layer ($\mathbf{770}_A$) is positioned above the first harvester unit ($\mathbf{701}_A$). A second insulating layer ($\mathbf{770}_B$) is interposed between the first harvester unit ($\mathbf{701}_A$) and the second harvester unit ($\mathbf{701}_B$). A third insulating layer ($\mathbf{770}_C$) is interposed between the second harvester unit ($\mathbf{701}_B$) and the third harvester unit ($\mathbf{701}_C$). A conductive plate (772) is positioned below the third harvester unit ($\mathbf{701}_C$) as a thermal conductor for transmitting heat from a heat source to the thermal energy harvesting thermionic device (700). In another embodiment, reference numeral (772) may be the heat generating source.

The emitter electrodes (cathodes) ($\mathbf{702}_A$), ($\mathbf{702}_B$), and ($\mathbf{702}_C$) may be made of any of the materials described herein. In an exemplary embodiment, the emitter electrodes ($\mathbf{702}_A$), ($\mathbf{702}_B$), and ($\mathbf{702}_C$) are made of a copper foil coated with platinum (Pt). The emitter electrode coatings ($\mathbf{734}_A$), ($\mathbf{734}_B$), and ($\mathbf{734}_C$) may be comprised of cesium oxide. The emitter electrode coatings ($\mathbf{734}_A$), ($\mathbf{734}_B$), and ($\mathbf{734}_C$) may cover, for example, about 60 to 80 percent of the surface area of their respective emitter electrodes. The collector electrodes (anodes) ($\mathbf{704}_A$), ($\mathbf{704}_B$), and ($\mathbf{704}_C$) likewise may be made of any of the materials described herein. In an exemplary embodiment, the collector electrodes ($\mathbf{704}_A$), ($\mathbf{704}_B$), and ($\mathbf{704}_C$) are made of tungsten foil. The collector electrode coatings ($\mathbf{764}_A$), ($\mathbf{764}_B$), and ($\mathbf{764}_C$) may be comprised of cesium oxide. The collector electrode coatings ($\mathbf{764}_A$), ($\mathbf{764}_B$), and ($\mathbf{764}_C$) may cover, for example, about 60 to about 80 percent of the surface area of their respective collector electrodes.

The nano-fluids ($\mathbf{708}_A$), ($\mathbf{708}_B$), and ($\mathbf{708}_C$) may be, for example, any of the materials described above in connection with FIG. 6. In an exemplary embodiment, the nano-fluids ($\mathbf{708}_A$), ($\mathbf{708}_B$), and ($\mathbf{708}_C$) include polymer-coated gold and silver nanoparticles. In an exemplary embodiment, the polymer coating of the nanoparticles is a halogenoalkane or alkyl halide, particularly those having boiling points above 220° C.

The insulating spacers ($\mathbf{706}_{A,1}$), ($\mathbf{706}_{A,2}$), ($\mathbf{706}_{B,1}$), ($\mathbf{706}_{B,2}$), ($\mathbf{706}_{C,1}$), and ($\mathbf{706}_{C,2}$) and the insulating layers ($\mathbf{770}_A$), ($\mathbf{770}_B$), and ($\mathbf{770}_C$) may be comprised of, for example, an alkanethiol. The spacers may have a multi-layer (e.g., five-layer) structure, with each layer at least one micron in thickness.

For the purposes of illustration, the thermal energy harvesting thermionic device (700) has been shown with three thermionic units ($\mathbf{701}_A$), ($\mathbf{701}_B$), and ($\mathbf{701}_C$) stacked on one another. It should be understood that the device (700) may include fewer (two) or more thermionic units than shown. Although FIG. 7 has been discussed in connection with a serial (or daisy-chained) connection of the thermal energy harvesting thermionic units ($\mathbf{701}_A$), ($\mathbf{701}_B$), and ($\mathbf{701}_C$), it should be understand that the units may be connected in parallel or serial-parallel. Further, the thermionic units ($\mathbf{701}_A$), ($\mathbf{701}_B$), and ($\mathbf{701}_C$) may be positioned relative to one another in configurations other than the stacked configuration of FIG. 7. For example, the thermionic units ($\mathbf{701}_A$), ($\mathbf{701}_B$), and ($\mathbf{701}_C$) may be positioned adjacent one another.

The thermal energy harvesting thermionic device (700) may be substitute into the apparatus (110) or (210) for the thermionic device (114) or (214), respectively.

Embodiment for Manufacturing the Apparatus (110) and (210)

Figure 8:
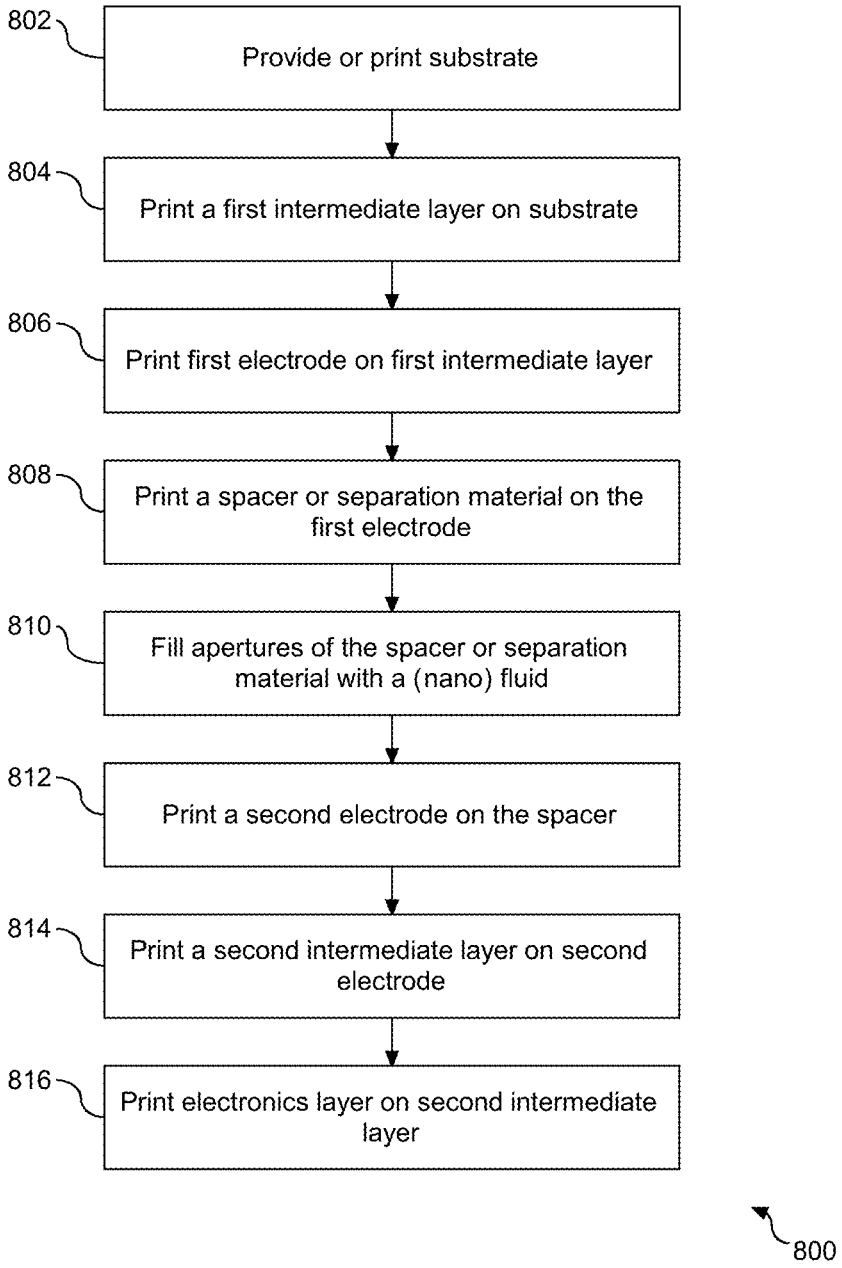
FIG. 8 is a flowchart illustrating a process for manufacturing a one-piece apparatus including a thermal energy harvesting thermionic device according to an exemplary embodiment.

Referring to FIG. 8, a flowchart (800) is provided illustrating an embodiment of a method for manufacturing a one-piece apparatus, such as apparatus (110) or (210), including a thermal energy harvesting thermionic device. A substrate is provided, e.g., pre-fabricated, or is printed (802). Printing operations referred to with reference to the steps of FIG. 8 may be performed with apparatus (900) of FIG. 9 or any of the apparatus of FIGS. 16A, 16B, and/or 17, discussed in greater detail below. An intermediate layer, also referred to herein as a first intermediate layer, is printed on the substrate (804). A first electrode (e.g., a cathode), having a first work function value is printed on the first intermediate layer (806). A spacer or other separation material is printed on the first electrode (808) so that a first surface of the spacer or other separation material is positioned in at least partial physical contact with the first electrode. Apertures or passageways in the spacer or other separation material are filled with a medium or media (810), which in an exemplary embodiment comprises a nano-fluid including a plurality of nanoparticles. A second electrode (e.g., an anode) having a second work function value is printed on the spacer or other separation material (812) so that a second surface of the spacer or other separation material is positioned in at least partial physical contact with the second electrode. A second intermediate layer is printed on the second electrode (814). An electronics layer including at least one electronics component is printed on the second intermediate layer (816). The electronics layer (816) is in electrical communication with the electron flow of the formed thermionic device.

Exemplary electrospray and nano-fabrication technique(s) and associated equipment, including three-dimensional printing and four-dimensional printing (in which the fourth dimension is varying the nanoscale composition during printing to tailor properties) for forming the substrate (122), the thermionic device (114) (including the cathode (116), the anode (118), and the spacer (120) with nano-fluid), the first intermediate layer (124) and the second intermediate layer (126), and the electronics layer (128) with one or more electronic components, as well as other components (e.g., housing (112)), layers and coatings discussed herein, including those of the device (400) and the apparatus (110) and (210), are set forth in U.S. Application Publication No. 2015/0251213 published Sep. 10, 2015 entitled "Electrospray Pinning of NanoGrained Depositions," U.S. patent application Ser. No. 16/416,849 filed May 20, 2019 entitled "Single-Nozzle Apparatus for Engineered Nano-Scale Electrospray Depositions," U.S. patent application Ser. No. 16/416,858 filed May 20, 2019 entitled "Multi-Nozzle Apparatus for Engineered Nano-Scale Electrospray Depositions," and in U.S. patent application Ser. No. 16/416,869 filed May 20, 2019 entitled "Method of Fabricating Nano-Structures with Engineered Nano-Scale Electrospray Depositions," the detailed descriptions and drawings of which are incorporated herein by reference. The apparatus and methods of those applications may be practiced alone or in combination with one another for making the various layers and components of the apparatus, e.g., (110) and (210), disclosed herein. Generally, those applications include disclosures of embodiments regarding, among other things, a composition including a nano-structural material, grain growth inhibitor nanoparticles, and/or at least one of a tailoring solute or tailoring nanoparticles. Any one of more of those compositional components (e.g., grain growth inhibitors) may be excluded from the embodiments described herein.

Figure 9:
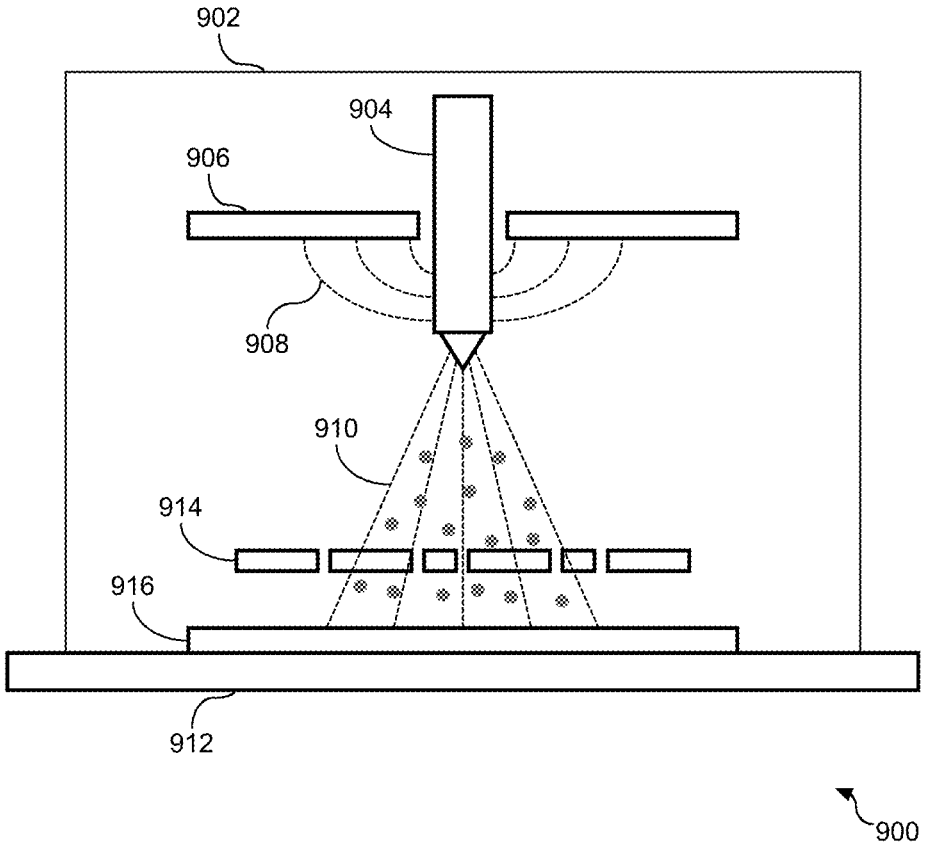
FIG. 9 depicts an embodiment of an electrospray system and technique suitable for making an apparatus including a thermal harvesting thermionic device, including but not limited to carrying out the process of FIG. 8.

A simplified diagram of an electrospray apparatus or system is generally designated by reference numeral (900) in FIG. 9. The electrospray system (900) includes an outer housing (902) that may be embodied as a vented heat shield containing a Faraday cage (not shown). Within the outer housing (902), an emitter tube (also referred to as an electrospray nozzle) (904) coupled to the bottom of a material reservoir (not shown) receives molten material from the material reservoir through a capillary tube (not shown). An extractor electrode (906) is configured for generating an electric field (908) to extract the molten material from the electrospray nozzle (904) to form a stream or spray (910) of droplets of nanoparticle size. The electric field (908) also drives the spray of droplets (910) towards a moving stage (912) that is movable relative to the extractor electrode (906). The extractor electrode (906) can also generate a magnetic field for limiting dispersion of the stream (910) of droplets. In an exemplary embodiment, the extractor electrode (906) has a toroidal shape, with the electrospray nozzle (904) extending through the center of the toroid.

FIG. 9 shows the use of a template (914) for forming a predetermined pattern on substrate (916). The template (914) may be particularly useful in preparing certain layers, components, and subcomponents of the apparatus (110) or (210). For example, according to an embodiment, the substrate (916) is the first layer (418) of the emitter electrode (402) or the second layer (448) of the collector electrode (406) of FIG. 4, and the template (914) is used to control the patterned deposition of the coating (434) or (464), e.g., a cesium oxide coating. In accordance with another embodiment, the template (914) is used to assist in the formation of apertures, e.g., apertures (408) in the spacer (406) of FIG. 4 or the walls (502) of spacer (500) of FIG. 5.

Embodiment for Operating the Systems (102) and (202)

Figure 10:
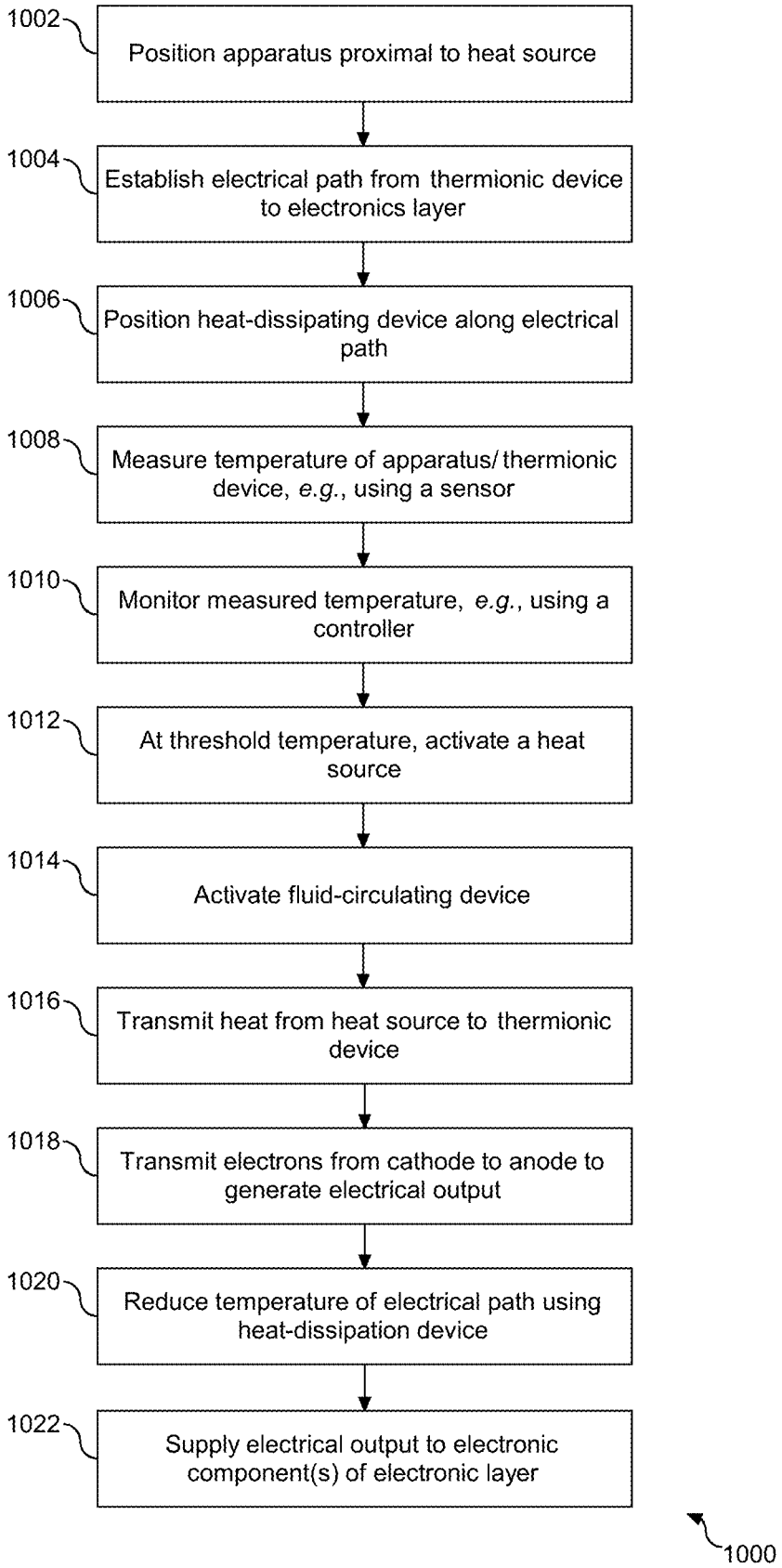
FIG. 10 depicts an embodiment for generating electricity using a thermal harvesting thermionic device to power at least one electronic component.

Referring to FIG. 10, a flowchart (1000) is provided illustrating a process according to an embodiment for generating electric power with a thermal energy harvesting thermionic device to operate one or more electronic components of the electronics layer of the apparatus (110). The apparatus (110) is positioned proximal to a heat source (1002), such as heat source (160) in FIG. 1A. An electrical path is established from the thermionic device of the apparatus to an electronics layer of the apparatus (1004). A heat-dissipating device (e.g., device (134) of FIG. 1A) is positioned along the electrical path. The temperature of the apparatus, and in exemplary embodiments the thermal energy harvesting thermionic device of the apparatus, is measured (1008), e.g., using a temperature sensor such as the sensor (156) of FIG. 1A. The measured temperature is monitored (1010), such as using the controller (154) of FIG. 1A. When a threshold temperature, as discussed above, is met or satisfied, a heat source is activated (1012). According to an exemplary embodiment, activating the heat source (160) is performed by the controller (154) closing the switch (158) to allow the flow of electricity from the electrical energy storage device (152) to the heat source (160), which generates the thermal energy or heat (162). A fluid-circulating device, such as device (136) of FIG. 1A, is activated. In an exemplary embodiment, the controller (154) activates the fluid-circulating device (136). Heat (162) is transmitted from the heat source to the thermionic device (1016), thermally perturbing the thermionic device (1016) so that electrons are transmitted from the cathode, across the medium or media (e.g., nano-fluid), to the anode to generate electrical output (1018). The temperature of the electrical path carrying the electrical output is reduced using the heat-dissipating device (1020). The electrical output is supplied to the electronics layer to provide or deliver power to one or more electronic components of the electronics layer (1022).

In an exemplary embodiment, system (202) uses environmental heat or heat from an outside heat source for generating electricity from the thermal energy harvesting thermionic device (214) and powering the electronics of the electronics layer (228).

Another embodiment for generating electric power with a thermal energy harvesting thermionic device to operate one or more electronic components of the electronics layer (228) of the apparatus (210) will now be described. The apparatus (210) is positioned so that the cathode (216) is proximal to the electronics layer (228). An electrical path is established from the thermionic device (214) of the apparatus (210) to the electronics layer (228) of the apparatus (210). A heat-dissipating device (e.g., device (234) of FIG. 2) is positioned along the electrical path. Environmental heat is transmitted to the thermionic device (214), thermally perturbing the thermionic device (214) so that electrons are transmitted from the cathode, across the medium or media (e.g., nanofluid), to the anode to generate electrical output. The temperature of the electrical path carrying the electrical output is reduced using the heat-dissipating device (234). The electrical output is supplied to the electronics layer (228) to power one or more electronic components of the electronics layer (228). Heat generated by the electronics layer is supplied to the cathode (216) to further drive the thermionic device (214). Eventually, the cycle will decrease to the point at which an outside heat source should provide thermal energy to the thermionic device (214). In one or more embodiments, the same heat-cycling and heat-supply concepts may apply to the thermionic device (114) described above.

Nano-Electronic Component Embodiments

As described above, the electronics layers (128) and (228) each include at least one electronic component. In certain exemplary embodiments described below with reference to FIGS. 13 to 19, one or more of those electronic components is a nano-electronic component. It should be understood, however, that the electronics layers (128) and (228) are not limited to having nano-electronics, or for that matter the nano-electronics described hereinbelow.

Figure 13:
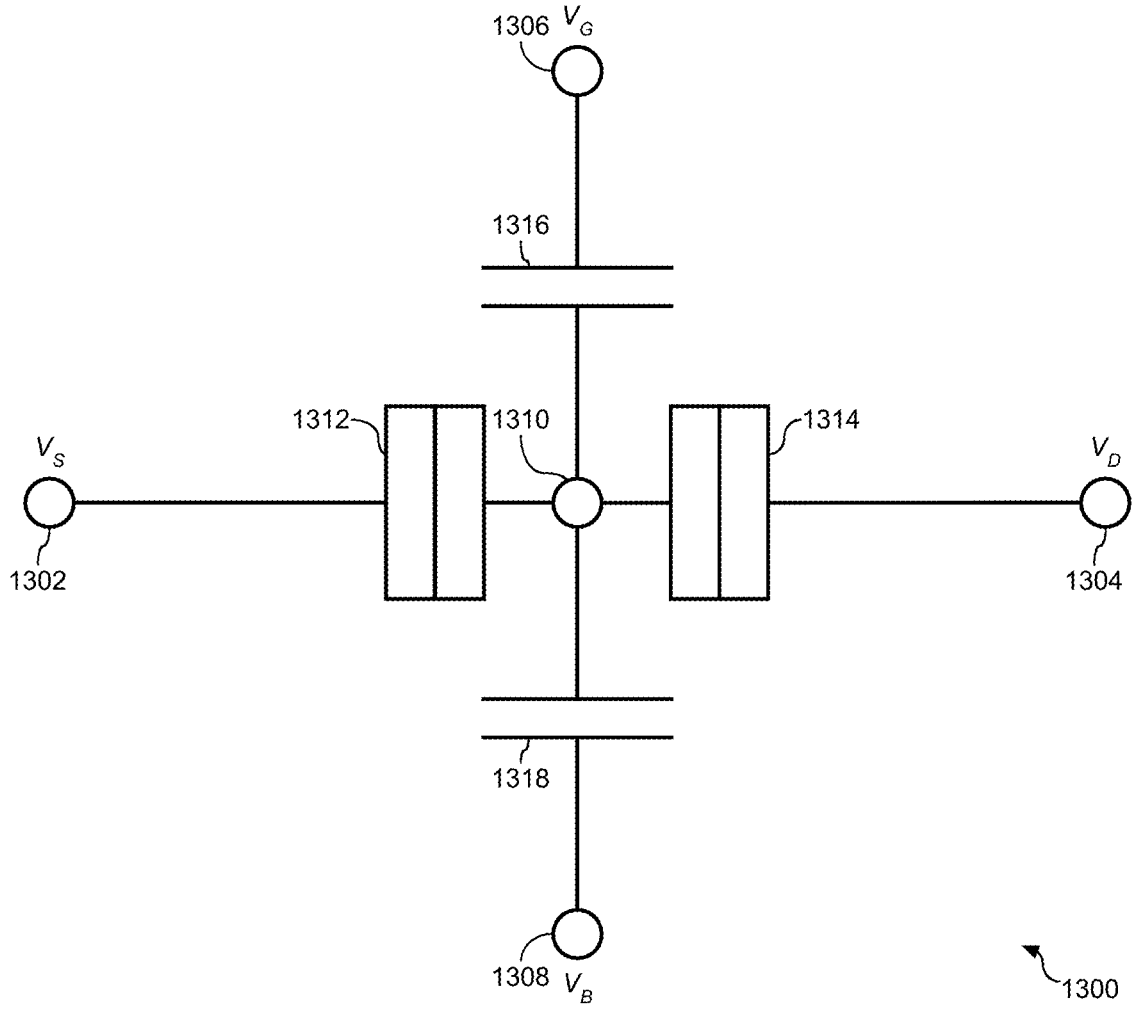
FIG. 13 is a schematic of a circuit including a single electron transistor according to an exemplary embodiment.

FIG. 13 is a schematic fragmented view of circuit diagram including a single electron transistor ("SET"). The circuit diagram, generally designated by reference numeral (1300) in FIG. 13, includes a source electrode (1302) having a voltage $V_S$, a drain electrode (1304) having a voltage $V_D$, a gate electrode (1306) having a voltage $V_G$, and a backgate electrode (1308) having a voltage $V_B$.

A quantum island (also referred to in embodiments as a quantum dot) (1310) is shown in the center of the circuit diagram (1300). Positioned between the source electrode (1302) and the quantum island (1310) is a first junction (1312), and positioned between the drain electrode (1304) and the quantum island (1310) is a second junction (1314). The gate electrode (1306) is capacitively coupled to the quantum island (1310), as represented in FIG. 13 by capacitor (1316). The backgate (1308) is also capacitively coupled to the quantum island (1310), as represented by capacitor (1318).

Figure 14:
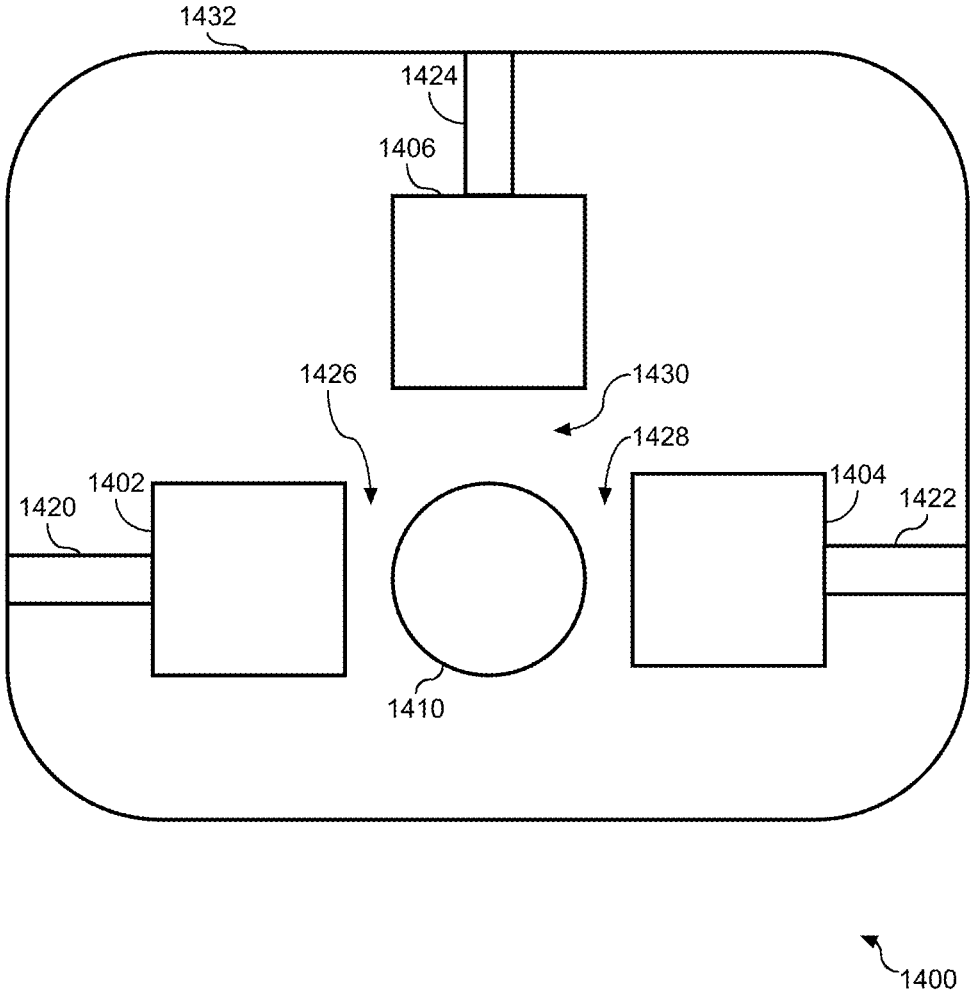
FIG. 14 is an enlarged, fragmented plan view of another single electron transistor of an exemplary embodiment.

FIG. 14 is an enlarged, fragmented schematic diagram of a single electron transistor (SET) (1400) similar to the single electron transistor of the circuit (1300) of FIG. 13, but omitting the backgate electrode (1308) of FIG. 13. The single electron transistor (1400) includes a source electrode (1402) and a drain electrode (1404) spaced apart from one another by a gap, with a quantum island (1410) positioned within the gap between and spaced from the source electrode (1402) and the drain electrode (1404). The SET (1400) is located on a surface of a substrate (also referred to as a wafer) (1432).

Conductive traces (or lines) (1420), (1422), and (1424) are electrically connected to the source electrode (1402), the drain electrode (1404), and the gate electrode (1406), respectively. Although not shown, if a backgate electrode was present, as in FIG. 13, a corresponding trace would be provided for the backgate electrode in FIG. 14. The conductive traces (1420), (1422), and (1424) serve to transport electrons to and from the electrodes (1402), (1404), and (1406), respectively, in exemplary embodiments without requiring sintering of the conductive traces.

In FIG. 14, the source electrode (1402) is separated from the quantum island (1410) by a first space (1426) of a first distance, and the drain electrode (1404) is separated from the quantum island (1410) by a second space (1428) of a second distance. The first and second spaces (1426) and (1428), respectively, are positioned diametrically opposite to one another. The first distance of the first space (1426) may be equal to or different than the second distance of the second space (1428). The first and second distances may be in a range of, for example, about 1 nanometer to about 4 nanometers. The gate electrode (1406) is likewise separated by a third space (1430) from the quantum island (1410). The third distance representing the third space (1430) between the gate electrode (1406) and the quantum island (1410) may be in a range of, for example, about 1 nanometer to about 4 nanometers.

In an exemplary embodiment, the gate electrode (1406) is positioned approximately ninety degrees from the source electrode (1402) and the drain electrode (1404). In an exemplary embodiment, the gate electrode (1406) is coplanar with the source electrode (1402) and the drain electrode (1404).

Operation of SETs is based on the Coulomb blockade effect. Electrons pass between the source electrode (1302), (1402) and the drain electrode (1304), (1404) one-by-one onto and off of the quantum island (1310), (1410). Electrons lack sufficient energy to transfer between the either the source electrode (1302), (1402) or the drain electrode (1304), (1404) and the quantum island (1310), (1410) when the gate voltage and the bias voltage (between the source and the drain electrodes) are zero. When the energy of the system reaches the Coulomb energy, e.g., by increasing the bias voltage, an electron transfers between the source electrode (1302), (1402) and the quantum island (1310), (1410), then the quantum island (1310), (1410) and the drain electrode (1304), (1404). The Coulomb blockage is lifted by the increased voltage to allow electron travel through the island (1310), (1410). The Coulomb energy, $E_C$, is given by Equation (1) below:

$$E_C = e^2/2C \text{ Equation} \quad (1)$$

wherein e is the charge on an electron, and C is the total capacitance of the source and drain junctions and the gate electrode, which the quantum island (1310), (1410) is capacitively coupled to.

The Coulomb gap voltage, e/C, is the voltage necessary to lift the blockade and transfer an electron across the spaces (1426) and (1428) to and from the quantum island (1310), (1410). When the bias voltage between the source electrode (1302), (1402) and the drain electrode (1304), (1404) is greater than the Coulomb gap voltage, electrons actively travel across the spaces (1426) and (1428) one-by-one resulting in a current through the transistor independent of the gate bias. In operation according to an embodiment, the bias voltage between the source and drain electrode is maintained below the Coulomb gap voltage, and the Coulomb blockage effect, and hence the electron transfer across the spaces (1426) and (1428), is controlled by altering the gate voltage.

In order to see the quantization of the electron flow (known as the Coulomb staircase), the thermal energy is less than the Coulomb gap voltage. For a SET to operate at room temperature, $kT \ll e^2/2C$, which translates into the capacitance $C \ll e^2/2kT \sim 3.09\times10^{-18}$ F. The capacitance (CNP) of a sphere is $C=q/V$ where q is total charge and $V=q/47\pi\varepsilon_o r$, where $\varepsilon_o$ is the permittivity of free space, and r is the radius of the nanoparticle. Substituting for the voltage, V, and solving for the capacitance, results in $C=4\pi\varepsilon_o r$ that is less than $3\times10^{-18}$F. Accounting for the uniform monolayer (of dielectric constant ε) on a spherical nanoparticle, the capacitance can be expressed as $CNP=ANP\varepsilon_o\varepsilon\ (r+d)/rd$ where ANP is the surface area if a sphere ($4\pi r^2$), and d is the thickness of conductive coating (0.5 nm). Substituting for the surface area of the sphere results in the equation $CNP=4\pi\varepsilon\varepsilon or(r+d)/d$. The coated nanoparticles have a capacitance of less than $0.6\times10^{-18}$F which enables operating temperatures substantially above room temperature. Thus, in an embodiment a 1 nm SET (wherein the 1 nm is the characteristic dimension of the smallest working features, e.g., the island) avoids thermally-induced random tunneling events and operates at elevated temperatures.

Figure 15:
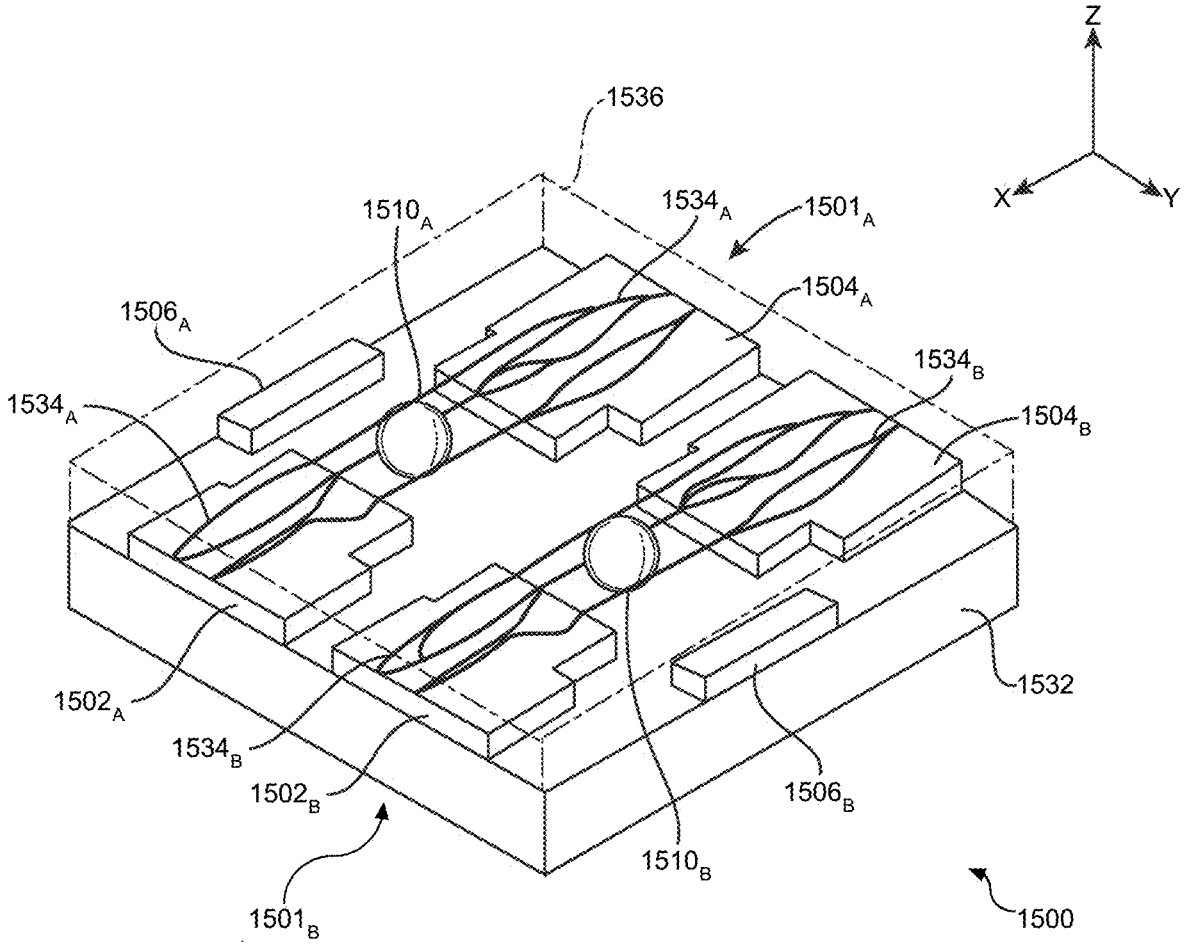
FIG. 15 is a fragmented, perspective view of a plurality of single electron transistors on a common substrate according to another embodiment.

FIG. 15 is an enlarged, fragmented perspective view of a chip (1500) representing the electronics layer (128) of FIG. 1 or (228) of FIG. 2. The chip (1500) includes a pair of single electron transistors (SETs) ($\mathbf{1501}_A$) and ($\mathbf{1501}_B$) on a substantially planar surface of a substrate (also known as a wafer) (1532). While only a pair of SETS ($\mathbf{1501}_A$) and ($\mathbf{1501}_B$) are illustrated on the substantially planar surface of the substrate (1532) in FIG. 15, it should be understood that in embodiments the substrate (1532) accommodates one or more SETs, including tens of SETs, hundreds of SETs, or thousands of SETs.

The first SET ($\mathbf{1501}_A$) includes a first source electrode ($\mathbf{1502}_A$), a first drain electrode ($\mathbf{1504}_A$), and a first quantum island ($\mathbf{1510}_A$) positioned between and spaced from the first source electrode ($\mathbf{1502}_A$) and the first drain electrode ($\mathbf{1504}_A$). The first SET ($\mathbf{1501}_A$) further includes a first gate electrode ($\mathbf{1506}_A$) positioned perpendicular or relatively perpendicular from the first source and drain electrodes ($\mathbf{1502}_A$) and ($\mathbf{1504}_A$). The first SET ($\mathbf{1501}_A$) includes one or more first nanoscale connections ($\mathbf{1534}_A$) between the first source electrode ($\mathbf{1502}_A$) and the first quantum island ($\mathbf{1510}_A$) and between the first quantum island ($\mathbf{1510}_A$) and the first drain electrode ($\mathbf{1504}_A$).

Similarly, the second SET ($\mathbf{1501}_B$) includes a second source electrode ($\mathbf{1502}_B$), a second drain electrode ($\mathbf{1504}_B$), and a second quantum island ($\mathbf{1510}_B$) positioned between and spaced from the second source electrode ($\mathbf{1502}_B$) and the second drain electrode ($\mathbf{1504}_B$). The second SET ($\mathbf{1501}_B$) further includes a second gate electrode ($\mathbf{1506}_B$) positioned perpendicular or relatively perpendicular from the second source and drain electrodes ($\mathbf{1502}_B$) and ($\mathbf{1504}_B$), respectively. The second SET ($\mathbf{1501}_B$) includes second nanoscale connections ($\mathbf{1534}_B$) between the second source electrode ($\mathbf{1502}_B$) and the second quantum island ($\mathbf{1510}_B$) and between the second quantum island ($\mathbf{1510}_B$) and the second drain electrode ($\mathbf{1504}_B$).

The one or more nanoscale connectors ($\mathbf{1534}_A$) establish a first connection or junction between the first source electrode ($\mathbf{1502}_A$) and the first quantum island ($\mathbf{1510}_A$) embodied as a single nanometer-scale conductive particle and a second connection or junction between the first drain electrode ($\mathbf{1504}_A$) and the second quantum island ($\mathbf{1510}_A$) embodied as a single nanometer-scale conductive particle. In an embodiment, one or more of the nanoscale connectors ($\mathbf{1534}_A$) extend lengthwise continuously between the first source electrode ($\mathbf{1502}_A$) and the first drain electrode ($\mathbf{1504}_A$), coming within 1 nanometer of, and in a particularly exemplary embodiment coming into contact with, the first quantum island ($\mathbf{1510}_A$). In another exemplary embodiment, one or more first nanoscale connectors extend from the first source electrode ($\mathbf{1502}_A$) to the quantum island ($\mathbf{1510}_A$), and one or more different second nanoscale connectors extend from the first drain electrode ($\mathbf{1504}_A$) to the first quantum island ($\mathbf{1510}_A$).

Likewise, one or more nanoscale connectors ($\mathbf{1534}_B$) establish a third connection or junction between the second source electrode ($\mathbf{1502}_B$) and the second quantum island ($\mathbf{1510}_B$) embodied as a single nanometer-scale conductive particle and a fourth connection or junction between the second drain electrode ($\mathbf{1504}_B$) and the second quantum island ($\mathbf{1510}_B$) embodied as a single nanometer-scale conductive particle. In an embodiment, one or more of the nanoscale connectors ($\mathbf{1534}_B$) extend lengthwise continuously between the second source electrode ($\mathbf{1502}_B$) and the second drain electrode ($\mathbf{1504}_B$), coming within 1 nanometer of, and in a particularly exemplary embodiment coming into contact with, the second quantum island ($\mathbf{1510}_B$). In another exemplary embodiment, one or more third nanoscale connectors extend from the second source electrode ($\mathbf{1502}_B$) to the second quantum island ($\mathbf{1510}_B$), and one or more different fourth nanoscale connectors extend from the second drain electrode (1504B) to the second quantum island ($\mathbf{1510}_\$$).

Although nanoscale connectors (e.g., ($\mathbf{1534}_A$, $\mathbf{1534}_B$)) are not illustrated in the embodiments of FIGS. 13 and 14, it should be understood that those embodiments may include such nanoscale connectors, such as one or more carbon nanotubes, single wall carbon nanotubes, etc.

The chip (1500) includes an encapsulate (1536), shown in phantom in FIG. 15 so as not to block viewing of the underlying structures and components. The encapsulate (1536) encloses the nanoelectronic components, including the electrodes, traces, conductive particles, nanoscale connectors, etc.

Representative materials for the chip (1500) and its various components are discussed below. The same materials may be used for the embodiments illustrated in FIGS. 13 and 14.

In an exemplary embodiment, the substrate (or wafer) (1532) is made of an inert, dielectric material, especially but not limited to glossy polymers. Representative, non-limiting materials that may be used for the substrate include, for example, epoxies, ceramic nano-particle-filled resins (e.g., Grandio™), silica nanoparticle-reinforced epoxies (e.g., Futura Bond™) polydimethylsiloxane (PDMS), polymethylmethacrylate (PMMA), polymethacrylate (PMA), polyvinylalcohol (PVA), polyvinylchloride (PVC), polyacrylic acid (PAA), Mercon™, phenyl-C61-butyric acid methyl ester (PCBM), pentacene, carbazoles, phthalocyanine, and aerogels, such as silica, aluminum, chromia, graphene oxide, and tin oxide aerogels. In an exemplary embodiment, the substrate (1532) is not made of (i.e., is free of) a semiconductor material, such as silicon, gallium, arsine, carbides, etc.

In an exemplary embodiment, the surface of the substrate (1532) is hydrophobic. For example, inherently hydrophobic materials such as PDMS may be selected as the substrate (1532) to provide the hydrophobic surface. In another embodiment, the surface of a non-hydrophobic (hydrophilic) substrate (1532) may be treated, such as with plasma, to render the surface hydrophobic.

The source electrodes (1502$_A$), (1502$_B$), the drain electrodes (1504$_A$), (1504$_B$), the gate electrodes (1506$_A$), (1506$_B$), the backgate electrode (not shown in FIG. 15 but represented in FIG. 13 by reference numeral (1308)), and the traces (not shown in FIG. 15, but represented in FIG. 14 by reference numerals (1420), (1422), and (1424)) may be made of the same material as one another or may be made of different materials. According to an exemplary embodiment, the electrodes (1502$_A$), (1502$_B$), (1504$_A$), (1504$_B$), (1506$_A$), and (1506$_B$) and the traces are comprised of a conductive material, and in particularly exemplary embodiments, a metal, a combination of metals, and/or graphene. Representative metals include, by way of example, gold, silver, copper, and combinations including one or more of the same. The electrodes (1502$_A$), (1502$_B$), (1504$_A$), (1504$_B$), (1506$_A$), and (1506$_B$) and/or traces may be deposited by using conductive inks, as described in further detail below in connection with FIG. 18.

In an exemplary embodiment, the quantum islands (1510$_A$), (1510$_B$) are comprised of a conductive material, such as a metal, including, for example, gold, silver, and/or copper, or a conductive non-metal, such as graphene or an alkanethiol. In another exemplary embodiment, the quantum islands (1510$_A$), (1510$_B$) each comprise a substantially non-conductive core with a conductive coating. The core shape may be that of a sphere, for example. An exemplary core material is polystyrene latex (PSL). Suitable conductive coatings include, for example, gold, silver, copper, and/or graphene.

In an exemplary embodiment, any one or more of the electrodes (1502$_A$), (1502$_B$), (1504$_A$), (1504$_B$), (1506$_A$), and (1506$_B$) (as well as backgate electrode if present (see (1308) in FIG. 13), the traces (see (1420), (1422), and (1424) in FIG. 14), and the first and second nanometer-scale conductive particles (1510$_A$) and (1510$_B$) are covalently bonded to the substrate (1532) without the need for sintering. One benefit of the covalent bond of an exemplary embodiment is that as the substrate (1532) lengthens or stretches in use, the nanocomponents covalently bonded thereto lengthen or stretch with the substrate. Such expansion or stretch can result from physical manipulation of the substrate (332) or environmentally induced (e.g., temperature) changes.

In an exemplary embodiment the nanoscale connectors (1534$_A$) and (1534$_B$) each comprise one or more conductive carbon nanotubes (CNT), and in an exemplary embodiment the connectors (1534$_A$) and (1534$_B$) are conductive Single Wall Carbon Nanotubes (SWCNTs). Commercial suppliers of SWCNTs include U.S. Research Nanomaterials, although the SWCNTs that may be used in connection with the embodiments described herein are not limited to SWCNTs supplied by that commercial supplier.

Representative encapsulates (1536) include aerogels, such as silica, alumina, chromia, graphene oxide, and tin oxide aerogels.

Representative dimensions for the chip (1500) and its various components are discussed below. The same dimensions may be used for the embodiments illustrated in FIGS. 13 and 14.

The size of the substrate (or wafer) (1532) is not particularly limited. According to an exemplary embodiment, the substrate (1532) has a thickness (in the z-direction in FIG. 15) in a range of, for example, 1 nanometer to 10 microns. According to exemplary embodiments, the surface of the substrate (1532) is substantially planar. In exemplary embodiments, the surface of the substrate (1532) has a variability of not greater than 5 nanometers, or not greater than 1 nanometer, as measured by a profilometer.

The electrodes (1502$_A$), (1502$_B$), (1504$_A$), (1504$_B$), (1506$_A$), and (1506$_B$) (as well as backgate electrodes if present (see (1308) in FIG. 13) and the traces (see (1420), (1422), and (1424) in FIG. 14) generally have a thickness (in the z-direction) of 1 nm to 10 nm.

In an exemplary embodiment, the quantum islands (1510$_A$), (1510$_B$) are each a single nanometer-scale conductive particle (or nanoparticle). According to an exemplary embodiment, the single nanometer-scale conductive particle has an effective size of not greater than 10 nanometers, such as in a range of about 1 nanometer to about 10 nanometers, or in a range of about 1 nanometer to about 5 nanometers. In another embodiment, the single nanometer-scale conductive particle is less than 1 nanometer. The effective size is the largest dimension of the nanoparticle. In the event that the single nanometer-scale conductive particle is a sphere, for example, the effective size will be the diameter of the spherical particle.

In exemplary embodiments, the nanoscale connectors (e.g., SWCNTs) have lengths in a range of 10 to 100 nanometers. In an additional exemplary embodiment, the nanoscale connectors (e.g., SWCNTs) have a diameter of about 1 nanometer.

In an exemplary embodiment, the encapsulate (1536) has a thickness in a range of 10 nanometers (nm) to 100 nanometers.

Figure 16A:
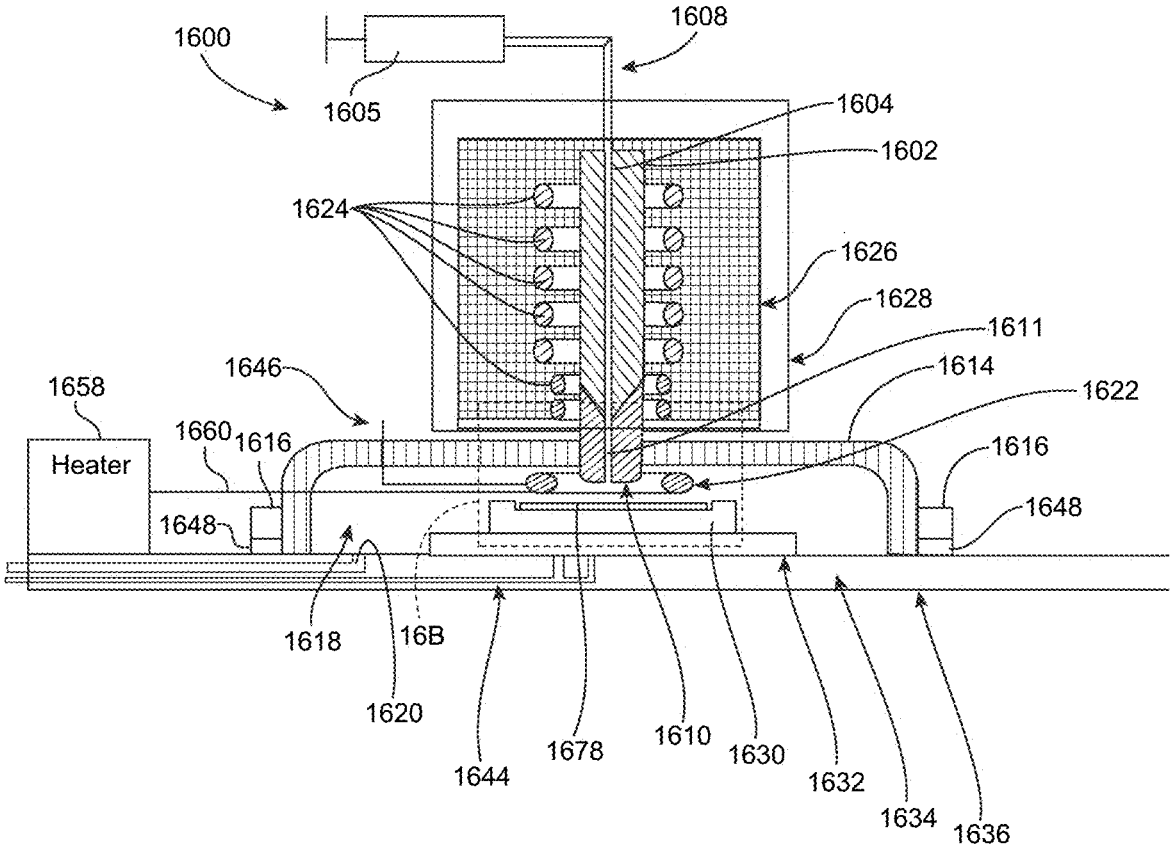
FIG. 16A is a side sectional view of an electrospray apparatus suitable for making a single-electron transistor and other structures, including an energy harvesting device and intermediate layers, described herein in accordance with an embodiment.

FIG. 16A shows the major components of an electrospray apparatus (1600) in accordance with an exemplary embodiment for making SETs and assemblies, devices, and circuits containing SETs. Examples of nanoelectronic structures that may be made using the electrospray apparatus (400) include resistors, capacitors, inductors, transformers, diodes, integrated circuits, etc. The electrospray apparatus (1600) (or (1700) below) described herein may be used to carry out an Electrical Mobility Aerosol Focusing (EMAF) technique, as described in greater detail below.

The electrospray apparatus (1600) has capillary needle (1602) with a central passage (1604) through which liquid material is received from a syringe pump (1605) via a conduit (1608) that communicates with the top of the capillary needle (1602). In an embodiment, induction heating coils (1624) wrap around the capillary needle (1602), serving to heat the liquid material (1604). Fewer or more induction heating coils (1624) than shown may be used, or the induction heating coils may be eliminated. A Faraday cage (1626) around the capillary needle (1602) and the induction heating coils (1624) shield the environment from electromagnetic radiation generated by the induction heating coils (1624). A vented heat shield (1628) positioned outside the Faraday cage (1626) performs a similar shielding function with respect to heat generated by the induction heating coils (1624).

An electrospray nozzle or print head (referred to hereinafter as a print head in the interest of brevity) (1610) is coupled to the bottom of the capillary needle (1602) to receive the liquid material (not shown) from the capillary needle (1602) with a capillary tube (1611). While the capillary needle (1602) and the capillary tube (1611) are shown as separate but communicating structures, alternatively, the capillary tube (1611) may form part of the capillary needle (1602). The capillary tube (1611) is configured for transporting the liquid material out of the capillary needle (1602) to the print head (1610).

In an exemplary embodiment, the print head (1610) comprises an ultrafine conductive hollow needle to concentrate electric fields around its outlet orifice. The orifice opening can be selected from several hundred nanometers to a few microns, such as 100 nm to 10,000 nm, depending upon the material to be deposited.

An extractor electrode (1622) is coupled to the print head (1610). As shown in FIG. 16A, the extractor electrode (1622) is positioned near or at the bottom of the print head (1610) where the capillary tube (1611) exits. The extractor electrode (1622) is configured for generating an electrical field that extracts the liquid material from the print head (1610) to form a stream of nanoparticle-size droplets. The electric field also drives the droplets toward a moving stage (1636).

Additionally, the extractor electrode (1622) also generates a magnetic field in an exemplary embodiment. The generated magnetic field can serve to limit dispersion of the stream of droplets. When discharged from the print head (1610), the electrosprayed droplets are charged. The charge tends to disperse the droplets from one another. More specifically, the charge imparts a force on the particles that is orthogonal to both the magnetic field lines and the motion of the charged particles. If the magnetic field is strong relative to the velocity of the charged particle, however, the charge particles will tend to orbit magnetic field lines while moving along the lines. Thus, the dispersive tendencies of the stream of charged droplets are countered by the magnetic field.

The extractor electrode (1622) is shaped to provide both the electric field and magnetic field with characteristics useful for extracting liquid material from the electrospray nozzle (1610), driving the stream of droplets (1656) toward to the moving stage (1636), and focusing the stream of droplets (1656) on a deposition area (1652) (see FIG. 16B) on the moving stage (1636). In an exemplary embodiment, the extractor electrode (1622) has a toroidal shape with the center of the toroid penetrated by the print head (1610). In an embodiment, the extractor electrode (1622) comprises one or more turns of wire. The more turns, the greater the magnetic field generated for a given current. Extractor electrode wiring (1646) provides electrical current to the extractor electrode (1622). In an exemplary embodiment, a high voltage direct current power supply is used. In another exemplary embodiment, an alternating current power supply is used at, for example, a frequency of up to 1 GHz, or a frequency up to 1 MHz.

As previously mentioned, the deposition area (1652) of the moving stage (1636) serves as the target for the stream of droplets (1656). In an embodiment, the moving stage (1636) is configured for moving relative to the print head (1610) in three orthogonal dimensions. In an embodiment, the moving stage (1636) is a piezo-flexure guided stage providing bidirectional repeatability on a nanometer scale. The moving stage (1636) is typically electrically grounded so that the moving stage (1636) forms a planar endpoint for the electrical field. In an exemplary embodiment, the moving stage (1636) comprises a utility base plate (1634), a cooling chuck (1632) and an object holder (1630) having the previously mentioned deposition area (1652) on an upward facing surface of the object holder (1630). The object holder (1630) is configured for providing a surface for the fabrication of an object (1678) that results from the electrospray process, and more particularly the EMAF technique. The cooling chuck (1632) is positioned underneath the object holder (1630) and coupled thereto. The cooling chuck (1632) is configured for cooling the object holder (1630), typically with one or more thermoelectric cooling chips that use, for example, DC current to pump heat from the object holder (1630) to the utility base plate (1634). The utility base plate (1634) is exposed to ambient air and may be cooled with natural convection or forced air flow. The utility base plate (1634) has wiring (1644) for powering the cooling chuck (1632) and for any sensors that may be embedded in the object holder (1630). The utility base plate (1634) has an enclosure gas inlet (1620) to inject gases into the enclosure cavity (1618). Example gases include inert gases such as nitrogen, argon, and the like.

The exemplary electrospray apparatus (1600) has an enclosure (1614) coupled to the print head (1610) and the capillary needle (1602). In the exemplary embodiment, the enclosure (1614) is made of quartz, but other suitable materials may be used. The enclosure (1614) is shaped such that when placed in contact with the moving stage (1636), the enclosure (1614) and moving stage (1636) collectively define an enclosure cavity (1618) that serves as a controlled environment for the electrospray process. The enclosure (1614) has an enclosure floating frame (1616) that is slidingly coupled to the outer edges of the central part of the enclosure (1614). The enclosure floating frame (1616) maintains contact with the moving stage (1636) as the moving stage (1636) moves vertically over short distances and horizontally with respect to the enclosure (1614) and floating frame (1616). Maintaining contact between the enclosure floating frame (1616) and the moving stage (1636) keeps the enclosure cavity (1618) fully enclosed during electrospray object fabrication. An enclosure gasket (1648) on the bottom of the enclosure floating frame (1616) improves the seal of the enclosure cavity (1618) and allows the moving stage (1636) to move laterally without breaking the seal. In the exemplary embodiment, the enclosure gasket (1648) is made of felt, but in other embodiments may be made of other suitable materials, including but not limited to those typically used for gaskets.

Figure 16B:
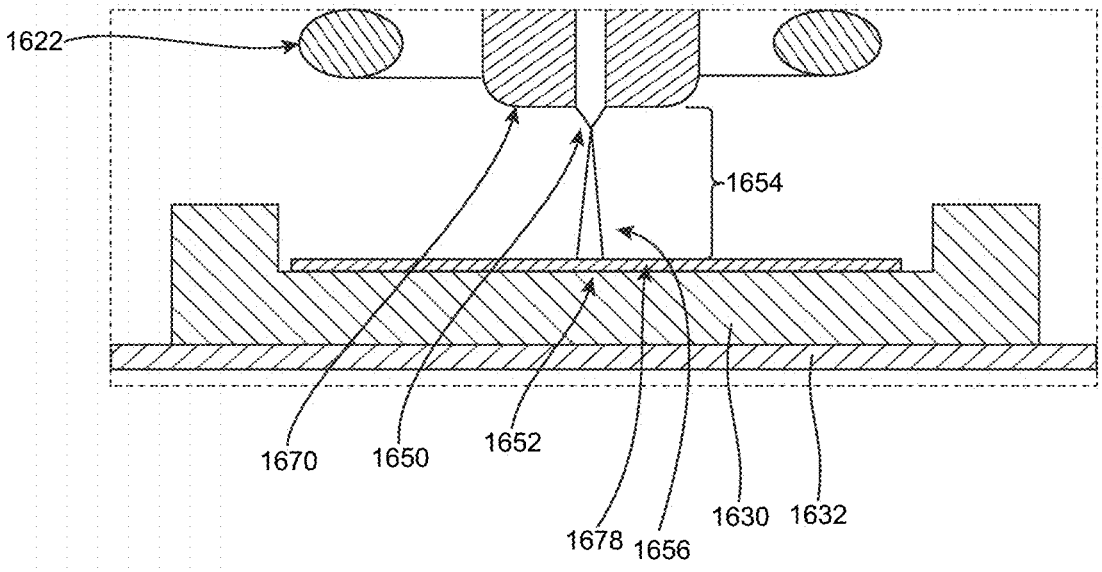
FIG. 16B is an expanded view of the area delineated by broken-line box 16B of FIG. 16A.

FIG. 16B shows an enlarged view of the area delineated by broken-line box 416 of FIG. 16A around the print head (1610) and object holder (1630) in an exemplary embodiment of the electrospray apparatus (1600). Some details are not shown in FIG. 16B to more clearly present other details. In the exemplary embodiment, the flow rate of the liquid material from the capillary needle (1602) is controlled, at least in part, by the syringe pump (1605). Other factors affecting flow rate include electrical conditions (e.g., voltage, current frequency, waveform), fluid properties such as conductivity, and surface tension.

In exemplary embodiments, an Electrical Mobility Aerosol Focusing (EMAF) technique is employed for electrospraying. According to this EMAF technique, charged nanoparticles in aerosolized droplets discharged from the print head (1610) are guided by a precise position by a concentrated electromagnetic field generated by the extractor electrode (1622).

In an embodiment for carrying out the EMAF technique, a stream of droplets (1656) emerges from a Taylor cone (1650) that forms on the tip of the print head (1610) when the electric field draws the liquid material in the aerosol from the print head (1610). Dispersion of the stream of droplets (1656) is limited by the magnetic field. A region on the fabricated object (1678) where the stream of droplets (1656) impacts is referred to as the deposition area (1652). In an embodiment, the fabricated object (1678) comprises successive deposition layers. In another embodiment, the fabricated object (1678) comprises a single deposition layer. In yet another embodiment, the fabricated object (1678) comprises single-layer structures and multi-layer structures. In another embodiment, a pre-formed substrate or wafer (such as (332)) is positioned on the object holder (1630) prior to electrospraying. In still another embodiment, the substrate or wafer (such as (332)) is fabricated on the object holder (1630), and constitutes the deposition area (1652) for deposition of electrodes, traces, quantum islands, and any other features of the SETs and related circuits.

The moving stage (1636) moves laterally while the stream of droplets (1656) impacts on the fabricated object (1678) (or object holder (1630)), forming the current deposition layer over all or part of the deposition area (1652), be it previous deposition layers or the object holder (1630). The distance between the print head (1610) and the deposition area (1652) is referred to as the stand-off distance (1654) or distance-to-deposition. In exemplary embodiments, the stand-off distance is in a range of 0.5 mm to 5 mm. If no other actions are taken, that is, if the moving stage 436) is not moved downwardly, e.g., vertically, the stand-off distance (1654) will change as the stream of droplets (1656) impacts on the fabricated object (1678) and adds layer(s) of deposited material. On the next pass, creating the next deposition layer, the stand-off distance (1654) would be reduced, if no other action is taken. In an exemplary embodiment, the stand-off distance (1654) is maintained at or near a target stand-off distance. The maintenance of a constant stand-off distance can be achieved by adjusting the moving stage (1636) vertically as necessary.

In an exemplary embodiment, the syringe pump (1605) controls the flow rate of the liquid materials to affect the distribution of the spray so as to obtain a monodispersed droplet production. In an exemplary embodiment, the monodispersed droplets each contain a statistical average of a single nanoparticle per monodispersed droplet. The number of nanoparticles per droplet can be controlled by selection of an appropriate concentration of nanoparticles for a given droplet size.

In an exemplary embodiment, the flow rate is controlled in combination with the moving stage (1636) to produce print velocities in a range of, for example, 0.0001 mm (0.1 micron) to 100 mm per second. In an exemplary embodiment, the volumetric flow rate is, by way of example and not limitation, about 0.1 picoliters ($0.1\times10^{-12}$ liters) per second. An example of a suitable moving stage is an XYZ piezo stage (LP300) from MadCityLabs, although this example is not intended to be limiting as there are other acceptable commercial moving stages.

Electrospray, also known as electrostatic atomization, typically involves the atomization of a liquid through the Coulombic interaction of charges and the applied electric field. Electrostatic atomization offers several advantages over alternative atomization techniques. Electrospray droplet streams are mainly due to the net charge on the surface of the droplets and the Coulombic repulsion of the droplets. This net charge causes the droplets to disperse, preventing their coalescence.

The trajectory of a charged droplet can be guided by the electrostatic field. According to an embodiment, the electrical power supplied to the extractor electrode (1622) for generating the electrostatic field is a 10 microamp square wave signal at a frequency of 22 kHz driven at 10 kilovolts peak-to-peak. In addition, the electrical mobility aerosol focusing is characterized in embodiments by previously deposited structures or layers acting as an intense electric field concentrator to attract subsequent droplets in-flight to the nanostructure. Another advantage of this type of atomization is the ability to control the size distribution of the spray and under specific electrodynamic operating conditions, obtain a monodispersed spray.

The electrical mobility of the in-flight droplets depends on, at least, the particle size and the electrical charge. The smaller the particle and/or the higher the electrical charge, the higher the electrical mobility. The electrical mobility, $Z_p$, is in general dependent on the particle diameter $d_p$, as shown by Equation (2):

$$Z_p = neC(dp)/3\pi\eta d_p \qquad \text{Equation (2)}$$

wherein $d_p$ is the aerosol particle diameter, n is the number of electrical charges on the particle, e is the elementary charge, C is the Cunningham slip correction factor, which is a function of the aerosol diameter, and $\eta$ is the gas viscosity.

Without wishing to be bound by theory, electrospray can be described as being characterized by the formation of the liquid meniscus at a capillary tip (Smith, 1986) which results from a number of forces acting on the interface, including surface tension, gravitational, electrostatics, inertial, and viscous forces. Sir Geoffrey Taylor was the first to calculate analytically a conical shape for the meniscus through the balance of surface tension and electrical normal stress forces which we now know is called the "Taylor cone" in electrospray and appears in the cone-jet mode (Taylor, 1964). Monodispersed ink droplets are ejected from the cone due to the accumulation of charge.

In the cone-jet mode, liquid leaves the capillary in the form of an axisymmetric cone with a thin jet emitted from its apex. The small jet of liquid issuing out of the print head is electrostatically charged when subjected to an intense electric field at the tip of the print head (Birmingham, et al., 2001). The charged droplets are propelled away from the print head by the Coulomb force and are dispersed out as a result of charge on the droplets. In conventional practice, the droplets are approximately 10 microns in diameter. In exemplary embodiments described herein, the droplets in connection deposition of all layers and structures are nanodroplets having diameters of, for example, 20 nanometers to 100 nanometers.

In exemplary embodiments, the droplets are comprised of a suspension (e.g., colloidal suspension) or ink containing the nanoparticles. During flight and/or after impact, the droplets containing the nanoparticles rapidly evaporate in microseconds, leaving only the nanoparticle.

Referring back to FIG. 16A, the electrospray apparatus (1600) is shown with a heater (1658) for adding thermal energy to the stream of droplets (1656). In some embodiments, the heater (1658) is used to add thermal energy to the stream of droplet (1656) before impact with the deposition area (1652). In the exemplary embodiment, the heater (1658) is a radiation source that supplies thermal energy to the stream of droplets (1656) with a radiation beam (1660). More specifically, the heater (1658) is an infrared laser, but in other embodiments may emit radiation at other parts of the spectrum than infrared and may be a heat source other than a laser. In an exemplary embodiment, the heater (1658) is mounted outside the enclosure (1614) and the radiation beam (1660) passes through the enclosure (1614), which in an exemplary embodiment is made of quartz. In an embodiment, the heater (1658) is coupled to the utility base plate (1634) of the moving stage (1636). This mounting may require aiming control for the radiation beam (1660), as the moving stage (1636) moves relative to the print head (1610) and hence the stream of droplets (1656). Alternatively, the heater (1658) may be coupled to the enclosure (1614) or to the print head (1610).

In order to achieve higher production rates, such as by practicing parallel device fabrication or serial device fabrication, multiple print heads (1610) can be used. According to an embodiment, the electrospray apparatus (1600) has more than one capillary needle (1602) and more than one print head (1610), e.g., with each print head (1610) associated with a respective capillary needle (1602). In another embodiment, the electrospray apparatus (1600) has a capillary needle (1602) associated with a plurality of capillary tubes (1611) and a plurality of print heads (1610), e.g., with each of the print heads (1610) associated with a respective capillary tube (1611). According to the above-described and other multiple print head embodiments, each print head (1610) may be associated with a respective extractor electrode (1622). An example of a multi-head electrospray apparatus is illustrated in FIG. 8 of U.S. Application Publication No. 2015/0251213.

The utility of a multi-nozzle electrospray apparatus is apparent from the following example. According to an embodiment, electrospraying a droplet with a diameter of 100 nm at 10 kHz (10,000 per second) ejections, the printing flow rate from a single electrospray capillary is 5 to 100 femtoliters ($5\times10^{-15}$ L) per second. To achieve drop overlap to ensure good conductivity of metal nanoparticle traces, a print speed of 100 microns per second would result in a printing time of 10 seconds for a 10 micron-size square. Extrapolating to a standard Very Large Scale Integrated (VLSI) chip with an area of 1 $cm^2$ at a dense patterning at 10 nm resolution, 100 nozzles would take about a day to complete the VLSI chip, which represents an excellent production rate compared to current industrial processes.

Figure 17:
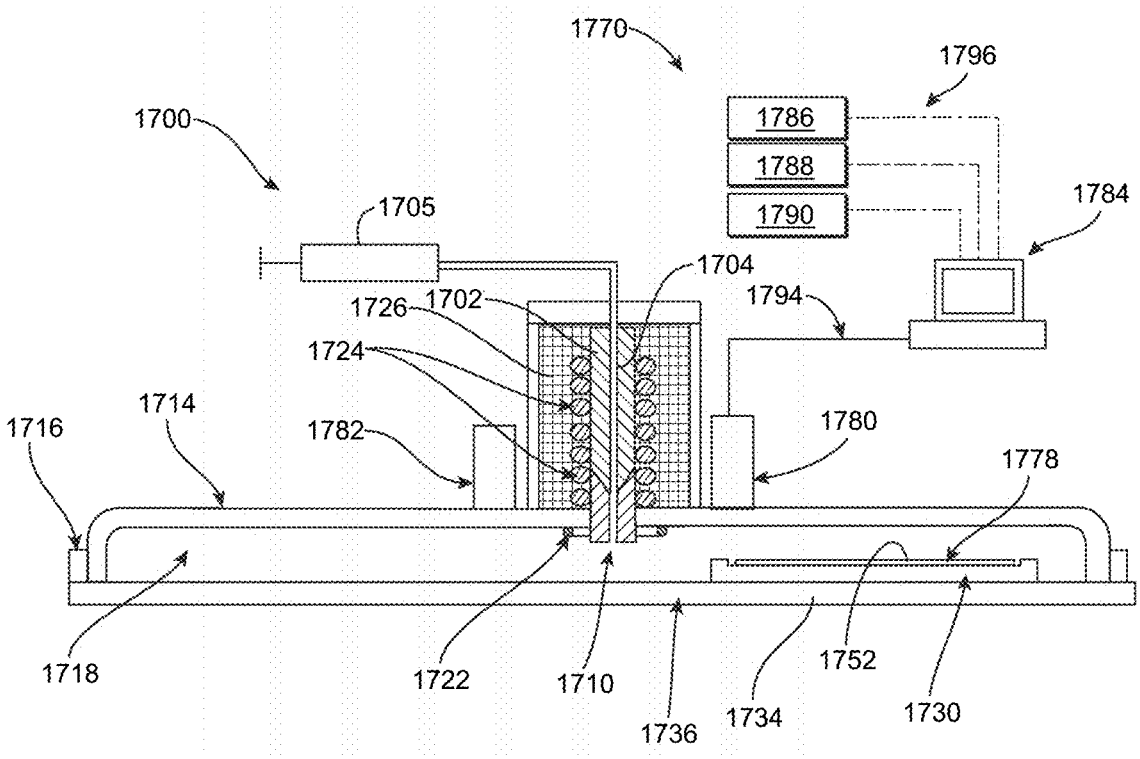
FIG. 17 is a side sectional view of an electrospray apparatus modified to include one or more profilometers and a control system.

FIG. 17 shows the exemplary electrospray apparatus (1700) with many of the same components of the apparatus (1600) of FIGS. 16A and 16B, including capillary needle (1702), central conduit (1704), syringe pump (1705), print head (1710), enclosure (1714), enclosure floating frame (1716), enclosure cavity (1718), extractor electrode (1722), induction heating coils (1724), Faraday cage (1726), object holder (1730), unitary base plate (1734), moving stage (1736), and fabricated object (1778). Additional components and features of FIGS. 16A and 16B are illustrated, but not identified by a reference numeral, in FIG. 17. Other components of FIGS. 16A and 16B may be missing from FIG. 17 for the sake of simplicity. The above discussion of corresponding components and features from FIGS. 16A and 16B are incorporated herein with respect to the description of FIG. 17.

The exemplary electrospray apparatus (1700) of FIG. 17 includes first and second optical profilometers (1780) and (1782), respectively, and a control system (1770). The first optical profilometer (1780) is configured for measuring the distance to a deposition area (1752) of the fabricated object (1778). As the moving stage (1736) moves the fabricated object (1778) under the first optical profilometer (1780), the first optical profilometer (1780) measures the distance to the deposition area (1752) of the fabricated object (1778) at specific time intervals, creating profile data about the fabricated object (1778), or more specifically, about the current deposited layer of the fabricated object (1778). This profile data is sent to a main control unit (1784) via a profilometer communication link (1794), which may be wired or wireless. The exemplary embodiment also includes the second optical profilometer (1782), but other embodiments may have more or fewer profilometers.

The main control unit (1784) uses the profile data to control the electrospray apparatus (1700) during deposition of the next deposition layer. For deposition of the next deposition layer, the main control unit (1784) has the moving stage (1736) move vertically as necessary to maintain the stand-off distance (1754) at the target stand-off distance, based on the profile data of the proceeding deposition layer. It should be understood, however, that the structures fabricated with the exemplary electrospray apparatus (1700) may be comprised of a single deposition layer.

The main control unit (1784) also uses the profile data to compensate for errors in the previous deposition layers. If the profile data of the proceeding deposition layer indicates that some region of the fabricated object (1778) is too thick, the main control unit (1784) can correct on the next deposition layer by slowing the flow rate of liquid material from the print head (1710) when over that region. Likewise, if the profile data of the proceeding deposition layer indicates that some region of the fabricated object (1778) is too thin, the main control unit (1784) can correct on the next deposition layer by increasing the flow rate of liquid material through the print head (1710) when over that region.

The main control unit (1784) is connected by main control unit communication links (1796) to one or more sub-control units. The apparatus (1700) is illustrated including a first sub-control unit (1786) for controlling the moving stage (1736), a second sub-control unit (1788) for controlling the extractor electrode (1722), and a third sub-control unit (1790) for controlling a heater (such as heater (1658) of FIG. 16A). Other embodiments may have more or fewer sub-control units, depending on the components they have.

Although not shown, the apparatus (1600) or (1700) can include a microscope to study droplet ejection, precise placement, and other aspects of the deposition process. An example of a suitable microscope is a Scanning Electron Microscope (SEM).

An exemplary method for fabricating a Single Electron Transistor (SET), such as but not limited to the SETs illustrated in FIGS. 13-15, will now be described with reference to flowchart (1800) of FIG. 18. For convenience, the fabrication method represented by flowchart (1800) is described in connection with the electrospray apparatus (1600) and (1700) of FIG. 16 and FIG. 17, respectively. The above description of the electrospray apparatus (1600) and (1700) is hereby incorporated into the discussion of the flowchart (1800) of FIG. 18. It should be understood that electrospray apparatus other than those shown in FIGS. 16A, 16B, and 17 and described above may be used for carrying out embodiments of the method, including but not limited to the embodiment illustrated in the flowchart (1800) of FIG. 18. It should further be understood that the various steps of the flowchart (1800) may be combined with one another, separated into sub-steps, practiced in a different sequence than shown, or otherwise modified, including by the omission of one or more of the steps of the flowchart (1800).

Ambient conditions (e.g., temperature, humidity, and gas composition (e.g., air)) may be practiced in carrying out the various steps described herein.

Fabrication of the Substrate (1802)

Figure 18:
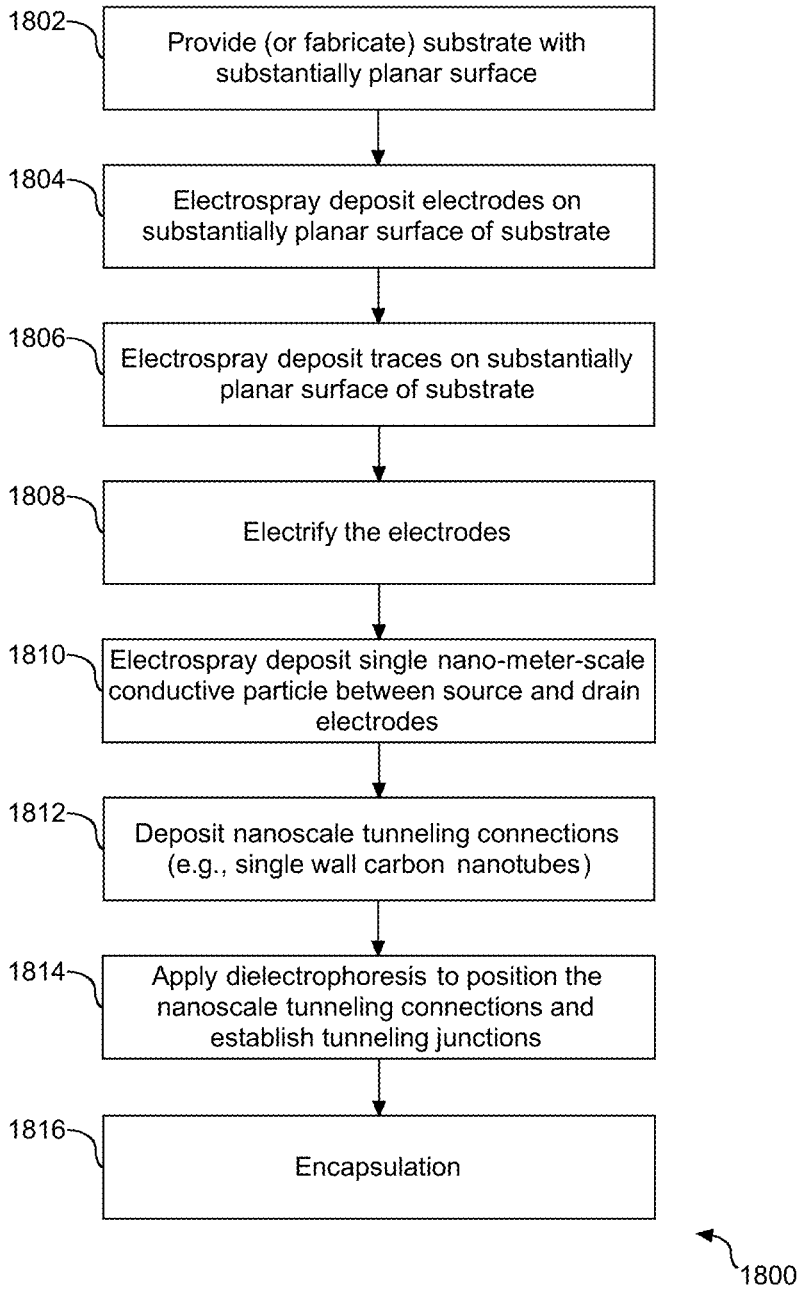
FIG. 18 is a flowchart of a single electron transistor fabrication method according to an exemplary embodiment.

Referring now to the flowchart (1800) of FIG. 18, a substrate (also referred to as a wafer) (e.g., (1432) and (1532) of FIGS. 14 and 15, respectively) having a substantially planar surface is provided (1802), either as a prefabricated substrate (or wafer) or by fabrication of the substrate (wafer). In an exemplary embodiment, the substrate, e.g., (1432), (1532) is fabricated by electrospray additive manufacturing using, for example, the electrospray apparatus (1600) or (1700) described above.

As mentioned above, in an exemplary embodiment the substrate (1432), (1532) is made of a material that is inert and/or dielectric, including polymers, especially but not limited to glossy polymers. Representative, non-limiting materials that may be used for the substrate (1432), (1532) include, for example, epoxies, ceramic nano-particle-filled resins (e.g., Grandio™), silica nanoparticle-reinforced epoxies (e.g., Futura Bond™), polydimethylsiloxane (PDMS), polymethylmethacrylate (PMMA), polymethacrylate (PMA), polyvinylalcohol (PVA), polyvinylchloride (PVC), polyacrylic acid (PAA), Mercon™, phenyl-C61-butyric acid methyl ester (PCBM), pentacene, carbazoles, phthalocyanine, and aerogels, such as silica, aluminum, chromia, graphene oxide, and tin oxide aerogels. In an exemplary embodiment, the substrate (1432), (1532) is not made of, and is free of, a semiconductor material, such as silicon, gallium, arsine, carbides, etc. The substrate (1432), (532) is deposited using monodispersed droplets in an exemplary embodiment.

In accordance with an embodiment, the substrate-forming material can be introduced into the electrospray apparatus (1600) or (1700) in a precursor form, including but not limited to monomeric, oligomeric, or pre-polymer form and be subject to polymerization initiated by, for example, the electrospray charge. In accordance with other embodiments, the substrate material may be introduced into the electrospray apparatus (1600) or (1700) as a solution, emulsion, or suspension, and in an embodiment as nanoparticles suspended in a solvent or liquid medium. In an exemplary embodiment, one or more surfactants may also be included to prevent agglomeration of the nanoparticles. Representative surfactants include, but are not limited to, TRITON®-100X, TWEEN®-20, and TWEEN®-80.

In an exemplary embodiment, the substrate-forming material is deposited as nano-scale droplets (or nanodroplets) having diameters in a range of, for example, 20 nanometers to 100 nanometers. During flight and/or upon impact on the object holder (1630), (1730), the carrier liquid evaporates, leaving the deposited nanoparticles to cure and build on one another.

In an exemplary embodiment, the surface of the resulting substrate is hydrophobic. Certain of the above exemplary materials, such as PDMS, are inherently hydrophobic materials. Others may be rendered hydrophobic by, for example, subjecting the surfaces to ionized gas (plasma) treatment.

The electrospray apparatus (1600) or (1700) allows for precise control over substrate thickness and topography. In an embodiment, the substrate is deposited by electrospray additive manufacturing to a thickness of 1 nanometer to 10 microns, although that range is not necessarily limiting. Control over the electrospray process can, in an exemplary embodiment, produce a substrate with a substantially planar surface. In an exemplary embodiment, the substantially planar surface is sufficiently planar to meet strict semiconductor fabrication requirements. In an embodiment, surface variations, as measured by a profilometer, of the area on which the SET is to be deposited are not greater than 5 nanometers, and in an exemplary embodiment not greater than 1 nanometer.

Electrospray Deposition of Electrodes (1804)

The electrodes (e.g., source (1402), (1502A), (1502B), drain (1404), (1504A), (1504B), gate (1406), (1506A), (1506B), and/or backgate) are fabricated directly on the substrate (e.g., (1432), (1532)) via electrospray deposition, more particularly an Electrical Nobility Aerosol Focusing (EMAF) technique. In an exemplary embodiment, the electrospray apparatus (1600) or (1700) is used to practice the EMAF technique.

Representative metals for forming the electrodes include, but are not limited to, gold, silver, and/or copper, although this list is not exhaustive. A representative non-metal for forming the electrodes includes, but is not limited to, graphene, although this list is likewise not limiting. The various electrodes (e.g., source, drain, gate, backgate) can be made of the same material or different materials in any combination.

The electrode-forming droplets discharged from the electrospray apparatus may be comprised of a solution, emulsion, or suspension, and in an embodiment as nanoparticles suspended, dissolved, or otherwise contained in a liquid carrier. In an exemplary embodiment, one or more colloidal inks are used for deposition of the electrodes. In an embodiment, the liquid carrier comprises an organic liquid such as an alcohol, aliphatic hydrocarbon, ester, ketone, others, and combinations including one or more of the same. During flight and/or upon impact on the target surface, the carrier liquid evaporates, leaving the deposited nanoparticle.

In an exemplary embodiment, the electrode-forming droplets comprise aerosols of monodispersed nanodroplets 20 nanometers to 100 nanometers in diameter. In an exemplary embodiment, the nanodroplets are deposited to overlap with one another in an exemplary embodiment to ensure good conductivity. By way of example only, a volumetric flowrate of about 0.1 picoliters per second may be practiced.

Electrospray Deposition of Conductive Traces (1806)

The conductive traces (e.g., conductive lines (1420), (1422), and (1424) in FIG. 14) are deposited in the same manner as described above with respect to the electrodes. The conductive traces and electrodes may be applied simultaneously or consecutively.

Electrification of Electrodes (1808)

The electrodes are grounded to a checked ground on an electrical outlet. The software goes circuit by circuit to check similar to the electronic memory is quality-assured today. All the electrodes are grounded which creates the island target for the fast electrical mobility of the aerosol.

The charges on the nanoparticles and the electrodes average out to deposit the nanoparticles equidistance from electrodes. The electrification of the electrodes is used to precisely place the nanoparticle within the nanocircuit island location. The voltage applied guides the charged nanoparticle to its grounded location.

Electrospray Deposition of Quantum Island (1810)

The quantum islands (e.g., (1310), (1410), (1510A), and (1510B) are deposited using the EMAF technique to electrospray nanodroplets. In an embodiment, the nanodroplets include a conductive particle in a liquid carrier. The conductive particle that forms the quantum island is, according the exemplary embodiments, a metal such as, for example, gold, silver, and/or copper, or a conductive non-metal, such as graphene. The conductive coating may, in turn include a coating comprising, for example, an alkane thiol. In another exemplary embodiment, the conductive particle comprises a substantially non-conductive core with a conductive coating. The core shape may be that of a sphere, for example. An exemplary core material is polystyrene latex (PSL). Suitable conductive coatings include, for example, gold, silver, copper, graphene and/or alkane thiols. In exemplary embodiments the carrier is a colloidal ink discussed above with reference to the electrodes. During flight and/or upon impact on the target surface, the carrier liquid evaporates, leaving the deposited nanoparticle.

Deposition of Nanoscale Connections (1812)

The semiconductor connections or junctions between the electrodes and the quantum island are formed by nanoscale connectors. In an exemplary embodiment, those connectors are carbon nanotubes, and in a particular embodiment conductive single wall carbon nanotubes (SWCNTs). As described above with reference to FIG. 15, nanoscale connectors, e.g., (1534A) and (334B), can each comprise one or more SWCNTs. In an exemplary embodiment, the SWCNTs have lengths in a range of 10 to 100 nanometers. In an additional exemplary embodiment, the SWCNTs have a diameter of about 1 nanometer.

The nanoscale connectors can be deposited, for example, using the electrospray apparatus (1600) or (1700). In an exemplary embodiment, the connectors (e.g., SWCNTs) are deposited as droplets in which the SWCNTs (or other connectors) are suspended in a carrier liquid. An example of a suitable carrier liquid for forming the droplets and entraining the SWCNTs is water. During flight and/or upon impact on the target surface, the carrier liquid (e.g., water) evaporates, leaving the deposited connector(s).

The suspension density affects the number of SWCNTs deposited. For example, a suspension having a SWCNTs suspension density of 10 μg/ml an average of one SWCNT per microliter of suspension. At such suspension densities, however, SWCNTs can agglomerate into bundles, reducing the uniformity of the suspension. To mitigate this problem, the SWCNT suspensions may be subject to horn sonication and subsequently filtered to remove larger bundles remaining after sonication.

Dielectrophoresis (1814)

When the conductive traces (e.g., (1420), (1422), and (1424) in FIG. 14) are powered, the nanoscale connectors (e.g., CNTs, SWCNTs) undergo dielectrophoresis (DEP) alignment movement. DEP relies on the application of electric fields to manipulate and position the CNTs. The aligned connectors electrically connect the source and drain electrodes to the quantum island (e.g., coated nanoparticle) to allow for the passage of electrons, completing the SET circuit. The current signal changes and the electricity flow is terminated when the SWCNTs reach the coated nanoparticle, typically within seconds during the DEP procedure.

The nanoscale connectors act as a bridge spanning the gaps between the electrodes and the single nanometer-scale conductive particle that serves as a quantum island. In an embodiment, after subject to DEP, one or more nanoscale connections establish a first junction between a source electrode and single nanometer-scale conductive particle and a second junction between the drain electrode and the single nanometer-scale conductive particle. In an embodiment, one or more of the SWCNTs extend lengthwise continuously between the source electrode and the drain electrode, coming within 1 nanometer of, and in a particularly exemplary embodiment coming into contact with, the nanometer-scale conductive particle. In another exemplary embodiment, one or more first SWCNTs extend from the source electrode to the single nano-scale conductive particle, and one or more second SWCNTs extend from first drain electrode to the single nano-scale conductive particle.

Initially, the CNTs expand into the gap and bring the two electrodes closer together. Once the bridging began, the primary effect of further CNT deposition is to fill in gaps in the network.

In-situ monitoring of the CNT DEP may be employed by measuring the current, voltage, and phase angle during deposition. The process is monitored by measuring the root-mean-square current amplitude (e.g., 6 mA to 30 mA) and relative phase angle (with the voltage from 0 to 30 degrees) during deposition. In an embodiment, DEP is terminated when the current reaches (e.g., plateaus at) a maximum. The measured data allow for a correlation between the CNT network densities thus establishing the feasibility of a closed-loop system suitable for industrial applications.

In a set of non-limiting experiments, initially the out-of-phase component, which is linearly related to the capacitance in a simple circuit model, rose quickly, and reached a transition point, at approximately one minute, where it changed. This change occurred as the SWCNTs began to bridge the electrode gap. Initially, the SWCNTs were expanding into the gap and bringing the two electrodes closer together. Once the bridging to the coated nanoparticle began, the primary effect of further SWCNT deposition was terminated. The SWCNT were able to rapidly connect to the coated nanoparticle because of the limited distance needed for alignment.

Once formed, the CNT/SWCNT or other connector network quality may be assessed using, for example, scanning electron microscopy (SEM) image analysis.

In an exemplary embodiment, the method comprises deposition of individual CNTs between arrays of electrodes and the assembly of large-area CNT networks. This exemplary DEP technique uses many electrospray-patterned electrodes to assemble CNT networks on a wafer in a manner appropriate for massively parallel device fabrication. The CNTs are deposited only where desired, resulting in negligible wasting of CNTs. In an exemplary embodiment, the technique can be used in a closed-loop system, enabling large-scale industrial application.

Encapsulation (1816)

Encapsulation (1816) of the nanoelectronics is performed principally to protect the SET from interfering effects such as background charge, excessive heat, and/or other hazardous conditions.

As mentioned above, the encapsulation material may be comprised of an aerogel, such as silica, alumina, chromia, graphene oxide, and tin oxide aerogels. The apparatus (1600) or (1700) can be adapted to apply a sol-gel for formation of aerogels. The aerogel may be formed, for example, by printing or spraying a sol-gel onto a surface and allowing the sol-gel to dry at a suitable temperature and pressure, such as atmospheric temperature and atmospheric pressure. According to an embodiment, the sol-gel is sprayed from a print head having a 0.4 mm internal diameter orifice at flow rate in a range of 2 to 5 ml/min, with an applied electrical power of about 20 kilovolts peak-to-peak and a frequency of 22 kHz to generate the monodispersed droplets that are electrically propelled towards the wafer. According to an embodiment, the wafer is moved in the X-Y plane at about 50 mm/second.

According to an embodiment, to prepare the sol-gel, tetraethyl-ortho-silicate (TEOS) is diluted in alcohol (e.g., anhydrous ethanol or isopropanol) to about 10-20% TEOS. A catalyst (e.g., an acid such as dilute HCl, 1M) is added dropwise to the TEOS/alcohol solution while stirring, then allowed to sit (e.g., 24-48 hours) to permit polymerization of the silicate and generation of a sol-gel. The sol-gel is diluted with alcohol and stored at a relatively low temperature (e.g., refrigeration) to slow further polymerization. Before use, the sol-gel may be diluted as for electrospray application to a desired coating thickness.

Electrospraying sol-gel creates a thin film aerogel condensation event. Electrospraying may be conducted in a heated (or elevated temperature) environment to cure the sol-gel and form the aerogel. Suitable elevated temperatures include, for example, 35° C. to 40° C. Cure temperature affects pore size. Generally, pore size increases with increased cure temperature, and decreases with decreased cure temperature. Gel time can be reduced by reducing the amount of alcohol and/or by adding additional catalyst (e.g., an acid such as HCl), although excess catalyst can result in shorter polymeric chains.

One or more energy harvesting devices having nano-scale characteristics can be employed as power sources for circuits including the SETs described herein. The energy harvesting devices described herein provide, for example, a stable voltage of about 1.1 V.

Figure 19:
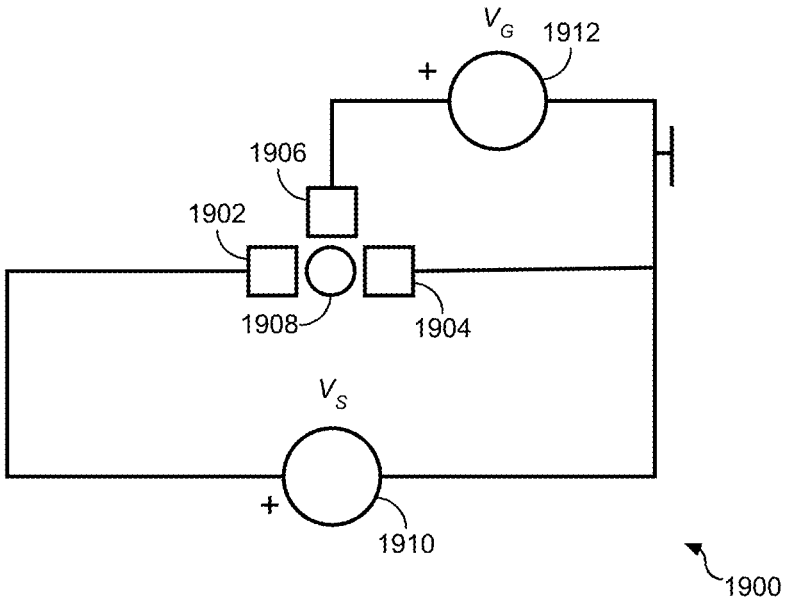
FIG. 19 is a schematic of a circuit containing the single electron transmitter of FIG. 15 with thermionic energy harvesting devices incorporated into the circuit as power sources according to an exemplary embodiment.

FIG. 19 is a schematic fragmented view of circuit diagram including a Single Electron Transistor ("SET"). The circuit diagram, generally designated by reference numeral (1900) in FIG. 19, includes a source electrode (1902), a drain electrode (1904), a gate electrode (1906) each separated by respective junctions from a quantum island (1908). A first voltage source (1910) embodied as a first energy harvesting device applies a voltage $V_S$ to the source electrode (1902) and the drain electrode (1904). A second voltage source (1912) embodied as a second energy harvesting device applies a voltage $V_G$ to the gate electrode (1906). One or more first nanoscale connectors (not shown in FIG. 19), such as CNTs or SWCNTs, connect the source electrode (1902) to the quantum island (1908), and one or more second nanoscale connectors, such as CNTs or SWCNTs, connect the drain electrode (1204) to the quantum island (1908). The gate electrode (1906) is capacitively coupled to the quantum island (1908).

The thermal energy harvesting thermionic devices of exemplary embodiments described herein facilitate generating electrical energy via a long-lived, battery-like device for any size-scale electrical application. Thermal energy harvesting thermionic devices of exemplary embodiments have a conversion efficiency superior to presently available single and double conventional batteries. In addition, the devices of exemplary embodiments described herein may be incorporated into an apparatus for charging a secondary battery and/or powering an electrical load, such as a power-consumption device. The thermal energy harvesting thermionic devices of exemplary embodiments described herein are light weight, compact, and have a relatively long operating life with an electrical power output at a useful value. Furthermore, in addition to the tailored work functions, the nanoparticle clusters of exemplary embodiments described herein are multiphase nano-composites that include thermoelectric materials. The combination of thermoelectric and thermionic functions within a single device further enhances the power generation capabilities of the thermal energy harvesting thermionic devices.

The conversion of heat into usable electricity enables energy harvesting capable of offsetting, or even replacing, the reliance of electronics on conventional power supplies, such as electrochemical batteries, especially when long-term operation of a large number of electronic devices in dispersed locations is required. Energy harvesting distinguishes itself from batteries and hardwire power owing to inherent advantages, such as outstanding longevity measured in years, little maintenance, and minimal disposal and contamination issues. The thermal energy harvesting thermionic devices of exemplary embodiments described herein demonstrate a novel electric generator with low cost for efficiently harvesting thermal energy. The devices of exemplary embodiments described herein initiate electron flow due to the differences in the Fermi levels of the electrodes without the need for an initial temperature differential or thermal gradient, although in exemplary embodiments heat sources are used to generate the temperature differentials over the course of use.

The thermal energy harvesting thermionic devices of exemplary embodiments described herein are scalable across a large number of power generation requirements. The devices may be designed for applications requiring electric power in the milliwatts (mW), watts (W), kilowatts (kW), and megawatts (MW) ranges.

The production of renewable, sustainable, green energy resources is the critical innovation for sustainable development of human civilization. Embodiments disclosed herein include one or more thermal energy harvesting thermionic devices to power electricity-consuming electronics. Further embodiments disclosed herein include one or more thermal energy harvesting thermionic devices to complement the power of a battery or other electricity-generating system (e.g., an electrical outlet of an AC source) to power electricity-consuming devices. In exemplary embodiments, the thermionic device is a nanoscale energy harvester, and in further exemplary devices is the sole power supply. In an exemplary embodiment, the thermionic device can cause the at least one electronic component of the electronics layer to be substantially autogenous or self-powered.

Aspects of the present embodiments are described herein with reference to one or more of flowchart illustrations and/or block diagrams of methods and apparatus (systems) according to the embodiments. It should be understood that the sequence of steps in those flowcharts may be changed. Further, additional steps may be included and/or illustrated steps omitted.

While particular embodiments have been shown and described, it will be understood to those skilled in the art that, based upon the teachings herein, changes and modifications may be made without departing from its broader aspects. Therefore, the appended claims are to encompass within their scope all such changes and modifications as are within the true spirit and scope of the embodiments. Furthermore, it is to be understood that the embodiments are solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to the embodiments containing only one such element, even when the same claim includes the introductory phrases "one or more" or "at least one" and indefinite articles such as "a" or "an"; the same holds true for the use in the claims of definite articles. As used herein, the term "and/or" means either or both (or any combination or all of the terms or expressed referred to).

The corresponding structures, materials, acts, and equivalents of all means or step plus function elements in the claims below are intended to include any structure, material, or act for performing the function in combination with other claimed elements as specifically claimed. The description of the present embodiments has been presented for purposes of illustration and description, but is not intended to be exhaustive or limited to the embodiments in the form disclosed. Many modifications and variations will be apparent to those of ordinary skill in the art without departing from the scope and spirit of the embodiments. The embodiments were chosen and described in order to best explain the principles of the embodiments and the practical application, and to enable others of ordinary skill in the art to understand the embodiments for various embodiments with various modifications and combinations with one another as are suited to the particular use contemplated. Accordingly, the scope of protection of the embodiment(s) is limited only by the following claims and their equivalents.

What is claimed is:

1. An apparatus, comprising:

an electronics layer comprising at least one electronic component;

a thermal energy harvesting thermionic device configured to receive thermal energy and generate an electrical output for powering the at least one electronic component, the thermal energy harvesting thermionic device comprising:

a cathode;

an anode spaced from the cathode; and a plurality of nanoparticles in at least one medium contained between the cathode and the anode, the nanoparticles configured to permit electron transfer between the cathode and the anode;

an intermediate layer positioned between the thermal energy harvesting thermionic device and the electronics layer, the intermediate layer comprising a gradient thermal expansion material (TEM), the intermediate layer having:

a first surface with a first coefficient of thermal expansion (CTE) facing the thermal energy harvesting thermionic device; and a second surface with a second CTE facing the electronics layer; and the first CTE being quantitatively closer than the second CTE to a CTE of a first surface of the thermal energy harvesting thermionic device facing the first surface of the intermediate layer, the second CTE being quantitatively closer than the first CTE to a CTE of a surface of the electronics layer facing the second surface of the intermediate layer.

2. The apparatus of claim 1, wherein the first CTE of the intermediate layer is within plus or minus 10 percent of the CTE of the first surface of the thermal energy harvesting thermionic device, and wherein the second CTE of the intermediate layer is within plus or minus 10 percent of the CTE of the surface of the electronics layer.

3. The apparatus of claim 1, wherein the first CTE of the intermediate layer is within plus or minus 2 percent of the CTE of the first surface of the thermal energy harvesting thermionic device, and wherein the second CTE of the intermediate layer is within plus or minus 2 percent of the CTE of the surface of the electronics layer.

4. The apparatus of claim 1, wherein the first surface of the intermediate layer is in direct contact with the first surface of the thermal energy harvesting thermionic device, and wherein the second surface of the intermediate layer is in directed contact with the surface of the electronics layer.

5. The apparatus of claim 1, further comprising:

a substrate;

an additional intermediate layer positioned between the substrate and the thermal energy harvesting thermionic device, the additional intermediate layer comprising an additional gradient TEM, the additional intermediate layer having:

a third surface with a third CTE facing the substrate; and a fourth surface opposite to the third surface and facing a second surface of the thermal energy harvesting thermionic device, the fourth surface having a fourth CTE; and the third CTE being quantitatively closer than the fourth CTE to a CTE of a surface of the substrate facing the third surface of the additional intermediate layer, the fourth CTE being quantitatively closer than the third CTE to a CTE of the second surface of the thermal energy harvesting thermionic device facing the fourth surface of the additional intermediate layer.

6. The apparatus of claim 5, wherein the third CTE of the additional intermediate layer is within plus or minus 10 percent of the CTE of the surface of the substrate, and wherein the fourth CTE of the additional intermediate layer is within plus or minus 10 percent of the CTE of the second surface of the thermal energy harvesting thermionic device.

7. The apparatus of claim 5, wherein the third CTE of the additional intermediate layer is within plus or minus 2 percent of the CTE of the surface of the substrate, and wherein the fourth CTE of the additional intermediate layer is within plus or minus 2 percent of the CTE of the second surface of the thermal energy harvesting thermionic device.

8. The apparatus of claim 5, wherein the third surface of the additional intermediate layer is in direct contact with the surface of the substrate, and wherein the fourth surface of the additional intermediate layer is in direct contact with the second surface of the thermal energy harvesting thermionic device.

9. The apparatus of claim 1, wherein the cathode, the anode, and/or a distance between the cathode and the anode has a nano-scale thickness.

10. The apparatus of claim 9, wherein the nano-scale thickness is in a range of 2 nm to 10 nm.

11. The apparatus of claim 1, wherein the cathode and the anode include a first coating and a second coating, respectively, in contact with the at least one medium, the first and second coatings being made of the same or different materials, the same or different materials comprising thorium, aluminum, cerium, scandium, an alkali oxide, an alkaline oxide, or a combination thereof.

12. The apparatus of claim 11, wherein the first coating and/or the second coating comprises cesium oxide.

13. The apparatus of claim 11, wherein the first coating covers 50 to 70 percent of a surface of the cathode and wherein the second coating covers 50 to 70 percent of a surface of the anode, the respective surfaces of the cathode and the anode facing one another.

14. The apparatus of claim 1, wherein a distance between the cathode and the anode is 1 nm to 10 nm.

15. The apparatus of claim 1, wherein the plurality of nanoparticles comprises a first plurality of gold nanoparticles and a second plurality of silver nanoparticles.

16. The apparatus of claim 1, further comprising a housing enclosing the electronics layer, the thermionic device, and the first intermediate layer.

17. The apparatus of claim 1, wherein the electronic component comprises a single electron transistor, the single electron transistor comprising:

a substrate having a substantially planar surface;

a source electrode on the substantially planar surface;

a drain electrode on the substantially planar surface spaced apart from the source electrode by a gap;

a gate electrode on the substantially planar surface; and a single nanometer-scale conductive particle electrospray deposited in the gap between the electrified source electrode and the drain electrode, the single nanometer-scale conductive particle having an effective size of not greater than 10 nanometers.

18. The apparatus of claim 11, wherein the nano-electronic component further comprises:

at least one carbon nanotube positioned within 1 nanometer of the single nanometer-scale conductive particle, the at least one carbon nanotube establishing a first connection between the source electrode and the single nanometer-scale conductive particle and a second connection between the drain electrode and the single nanometer-scale conductive particle.

19. A system comprising:

an apparatus comprising:

an electronics layer comprising at least one electronic component;

a thermal energy harvesting thermionic device configured to receive thermal energy and generate an electrical output for powering the at least one electronic component, the thermal energy harvesting thermionic device comprising:

a cathode;

an anode spaced from the cathode; and a plurality of nanoparticles in at least one medium between the cathode and the anode, the nanoparticles configured to permit electron transfer between the cathode and the anode;

an intermediate layer positioned between the thermal energy harvesting thermionic device and the electronics layer (128), the intermediate layer (124) comprising a gradient thermal expansion material (TEM), the intermediate layer (124) having:

a first surface (124*a*) with a first coefficient of thermal expansion (CTE) facing the thermal energy harvesting thermionic device (114); and a second surface (124*b*) with a second CTE facing the electronics layer (128); and the first CTE being quantitatively closer than the second CTE to a CTE of a first surface of the thermal energy harvesting thermionic device facing the first surface of the intermediate layer, the second CTE being quantitatively closer than the first CTE to a CTE of a surface of the electronics layer facing the second surface of the intermediate layer; and an electrically conductive path configured to electrically couple the thermal energy harvesting thermionic device and the at least one electronic component of the electronics layer.

20. A method of making an apparatus, comprising:

electrospray depositing an electronics layer comprising at least one electronic component;

electrospray depositing a thermal energy harvesting thermionic device comprising:

a cathode;

an anode spaced from the cathode; and a plurality of nanoparticles in at least one medium between the cathode and the anode, the nanoparticles configured to permit electron transfer between the cathode and the anode; and electrospray depositing an intermediate layer, the intermediate layer positioned in the apparatus between the thermal energy harvesting thermionic device and the electronics layer, the intermediate layer comprising a gradient thermal expansion material (TEM), the intermediate layer having a first surface with a first coefficient of thermal expansion (CTE) facing the thermal energy harvesting thermionic device, and a second surface with a second CTE facing the electronics layer, the first CTE being quantitatively closer than the second CTE to a CTE of a first surface of the thermal energy harvesting thermionic device positioned proximal to the first surface of the intermediate layer, the second CTE being quantitatively closer than the first CTE to a CTE of a surface of the electronics layer positioned proximal to the second surface of the intermediate layer.

21. The method of claim 20, wherein the electrospray depositing of the intermediate layer precedes the electrospray depositing of the thermal energy harvesting thermionic device or the electronics layer.

* * * * *